US006147648A

United States Patent [19]

Granholm et al.

[11] Patent Number: 6,147,648

[45] Date of Patent: Nov. 14, 2000

[54] DUAL POLARIZATION ANTENNA ARRAY WITH VERY LOW CROSS POLARIZATION AND LOW SIDE LOBES

[76] Inventors: Johan Granholm, Dag Hammerskjölds Allé 27, 5.tv, DK-2100 Copenhagen Ø; Kim Woelders, Tornehøj 18, DK-3520 Farum, both of Denmark

[21] Appl. No.: 09/155,648

[22] PCT Filed: Mar. 26, 1997

[86] PCT No.: PCT/DK97/00141

§ 371 Date: Oct. 2, 1998

§ 102(e) Date: Oct. 2, 1998

[87] PCT Pub. No.: WO97/38465

PCT Pub. Date: Oct. 16, 1997

[30] Foreign Application Priority Data

Apr. 3, 1996 [DK] Denmark ..... 0397/96

[51] Int. Cl.[7] ..... H01Q 1/38; H01Q 21/06; H01Q 21/24

[52] U.S. Cl. ..... 343/700 MS; 343/844; 343/853

[58] Field of Search ..... 343/700 MS, 853, 343/844; H01Q 1/36, 21/06, 21/24

[56] References Cited

U.S. PATENT DOCUMENTS

| | | | |
|---|---|---|---|
| 4,464,663 | 8/1984 | Lalezari et al. | 343/700 MS |
| 4,866,451 | 9/1989 | Chen | 343/700 MS |

FOREIGN PATENT DOCUMENTS

| | | |
|---|---|---|
| 0434268 | 6/1991 | European Pat. Off. . |
| 4000763 | 7/1991 | Germany . |
| 2242316 | 9/1991 | United Kingdom . |

OTHER PUBLICATIONS

IEE Proceedings H Microwaves, Antennas & Propagation., vol. 139, No. 5, Oct. 1992 pp. 465–471.

1994 IEEE AP–S International Symposium and URSI Radio Science Meeting, Microstrip Antenna for Polarimetric C–Band SAR.

"The Definition of Cross Polarization," A.C. Ludwig, IEEE Trans. Antennas and Propagation, vol. AP–21, Jan. 1973, pp. 116–119.

*Primary Examiner*—Michael C. Wimer

[57] ABSTRACT

The present invention relates to an antenna array adapted to radiate or receive electromagnetic waves of one or two polarizations with very low cross polarization and low sidelobes. An antenna array comprising many antenna elements, e.g., more than ten antenna elements, is provided in which formation of grating lobes are inhibited in selected directions of the radiation and cross polarization within the main lobe is suppressed at least 30 dB below the main lobe peak value. According to a preferred embodiment of the invention, the antenna elements of the antenna array comprise probe-fed patches, preferably rectangular patches, more preferred, square patches. Further, it is preferred that the feed probes are positioned at the axis of symmetry of the square or rectangular patches.

16 Claims, 54 Drawing Sheets

38

ABCD

ABDC

ACBD

ABCD-C

ABCD-A

ABCD-B

ABCD-D

DUAL POLARIZATION ANTENNA ARRAY WITH VERY LOW CROSS POLARIZATION AND LOW SIDE LOBES

This application is the national phase under 35 U.S.C. 371 of prior PCT International Application No. PCT/DK97/00141 which has an International filing date of Mar. 26, 1997 which designated the United States of America, the entire contents of which are hereby incorporated by reference.

FIELD OF THE INVENTION

The present invention relates to an antenna array adapted to radiate or receive electromagnetic waves of one or two polarizations with very low cross polarization and low side lobes.

BACKGROUND OF THE INVENTION

Dual polarized antennas are used in a wide range of applications, such as radar and radiometer systems (ground based as well as aircraft and satellite borne), systems for reception of satellite TV, radio links, data transmission networks (LAN and WAN). Typically, the operating frequency of such antennas is within the range from 1 GHz to 100 Ghz (microwave and millimeter waves).

Single polarized antennas, i.e. antennas radiating electromagnetic waves of a single polarization, are also used in a broad range of applications, such as in cellular radio and other personal communication systems operating in the VHF, UHF and microwave frequency range (e.g. L and S band).

Dual polarization antennas of the planar type are more and more commonly used for reception of satellite TV, typically, because of the possibility of frequency reuse, i.e. two TV channels may be transmitted simultaneously on the same frequency from the same satellite or from closely spaced satellites, with orthogonal polarization. Due to the orthogonality, the two channels can be received independently provided that the receiving antenna has the required low cross polarization between the two polarizations so that the two signals can be discriminated without mutual interference. Due to the increasing amount of wireless data communication throughout the frequency spectrum, it is expected that antennas with low cross polarization will gain wider use in the near future, first of all because of the possibility of doubling the data transmission capacity within a specific frequency range by utilization of orthogonal polarizations of the transmitted electromagnetic waves, and secondly because of the fact that some wireless data communication systems, such as high speed data communication systems utilizing dual polarizations, are sensitive to mutual interference, the sensitivity can be reduced by adopting antennas with low cross polarization.

Also, transmission of signals to or from mobile/portable radios may be enhanced by transmission of dual polarized signals to mobile/portable antennas with low cross polarization as the possibility of signal drop outs may be decreased. Signal drop outs are caused by the fact that signals received at the mobile/portable antenna, typically, have propagated to the antenna along multiple paths, e.g. due to reflections, e.g. by buildings. Signals of a given polarization travelling along different paths may then cancel each other at specific positions of the mobile/portable antenna depending upon the phase and amplitude relationship of the signals at different positions. However, as phases typically differ for signals of different polarizations, a signal drop out caused by cancellation of the signal of one polarization may be eliminated by switching of the receiver to the signal of the other polarization.

Dual polarized microstrip antenna arrays comprising one or more resonant radiating or receiving patches are known in the art. Typically, the resonant radiating or receiving patches are square shaped, the side of the square being substantially equal to one half wavelength at the transmitting and/or receiving frequency as measured in the dielectric of the microstrip antenna element. Each patch of the array is connected to a feeding network for transmission of a signal to be radiated by the patch, or, for transmission of a signal received by the patch to a receiver. Each patch is, for example, fed from one side of the patch for excitation of electromagnetic radiation of a polarization orthogonal to the side of the patch. A feed line connected to an adjacent orthogonal side of the square can then be utilized to excite electromagnetic radiation of an orthogonal polarization.

Although there is a degree of isolation between such prior art dual polarized microstrip antennas, there is also unavoidable coupling between the input/output ports. Typically, such feed through is on the order of −25 dB which is undesirably high for many applications.

In U.S. Pat. No. 4,464,663, it is disclosed how to enhance isolation between input/output ports for two differently polarized signals to be radiated by or to be received from a microstrip antenna of the type having integral microstrip feed lines and resonant radiating patches of the above mentioned kind by utilization of dual polarized radiating patches in pairs with one of the polarized feeds being provided back-to-back between the spaced apart pair of patches by a feed line system that incorporates a 180° phase difference of the feeding signals.

In Granholm J., Woelders, K., Dich, M., and Christensen, E. L., "Microstrip Antenna for Polarimetric C-band SAR", IEEE AP-S International Symposium and URSI Radio Science Meeting, Seattle, Wash., Jun. 19–24, 1994, pp. 1844–1847, a 224 element dual linearly polarized microstrip array antenna with low cross polarization that also utilizes dual polarized radiating patches in pairs is disclosed.

It is a disadvantage of known techniques for suppression of cross polarization in dual polarized antenna arrays that the side lobe suppression is insufficient for many applications. It is a major disadvantage of prior art techniques for suppression of cross polarization that undesired grating lobes in the radiation pattern of an antenna array are generated for antenna arrays with many antenna elements, e.g. with more than 6–8 antenna elements.

As further explained below, grating lobes are undesired side lobes in the radiation pattern of an antenna array.

SUMMARY OF THE INVENTION

Typically, in dual polarized antenna arrays, e.g. for radar and radiometer systems, it is strongly desired that the dual polarized antenna array has a very high polarization purity, i.e. high cross-polarization suppression is an important requirement.

For example, in synthetic aperture radar polarimetry, the radar alternately transmits electromagnetic radiation of horizontally polarized radiation and vertically polarized radiation, respectively, towards a surface. Depending upon the characteristics of the surface, the echoes of the electromagnetic radiation reflected from the surface will be of both horizontal and vertical polarization and the ratios between each of the magnitudes of echoes of a specific polarization and the magnitude of the corresponding transmitted pulse of radiation contain information of characteristics of the surface. For example, the magnitudes of the horizontal and vertical echoes, respectively, can be used to estimate the surface roughness and water content of bare soil surfaces. Thus, in order not to blur this information, it is mandatory that the antenna array used for such measurements has a high cross-polarization suppression.

Furthermore it is required that the antenna array side lobes are at a low level in order to avoid detection of false echoes.

Formation of grating lobes is further explained below with reference to the accompanying drawing illustrating prior art antenna arrays.

Further, a theoretical analysis of an embodiment of the invention is given with reference to the accompanying drawing illustrating the embodiment and plots of radiation patterns of the embodiment.

Whenever, throughout the present description, an antenna array for transmission of signals from the array is described, it should be understood that the antenna array may as well be used for reception of signals.

Below, the term radiation pattern is used to designate the directivity of an antenna in a particular direction (used in plots) and to designate the electrical far-field of the antenna in a particular direction (used in theoretical analysis).

In the drawing

Figure 5:
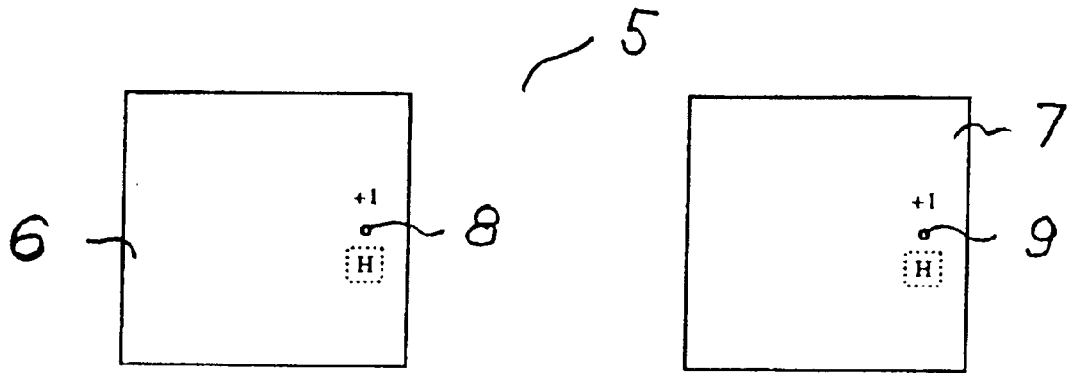
FIG. 5 is a top view of a two-antenna element group.
Figure 6:
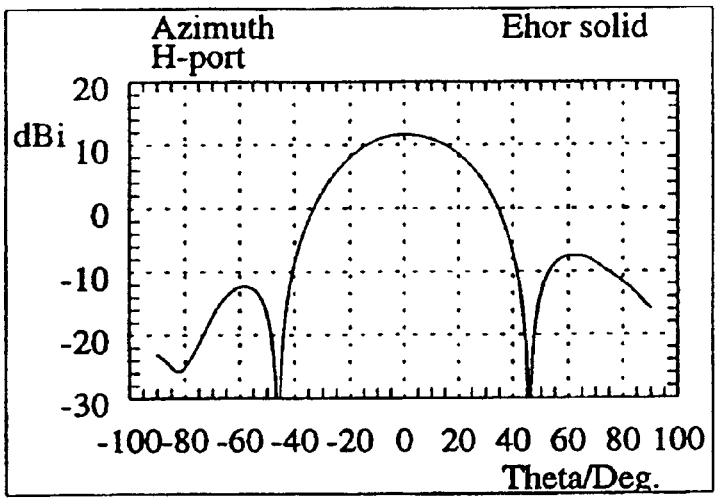
Figure 7:
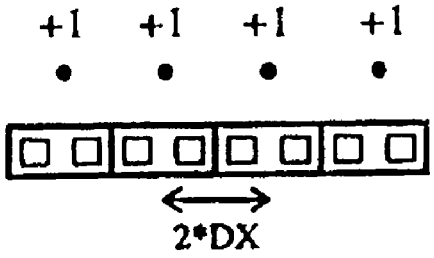
Figure 7:
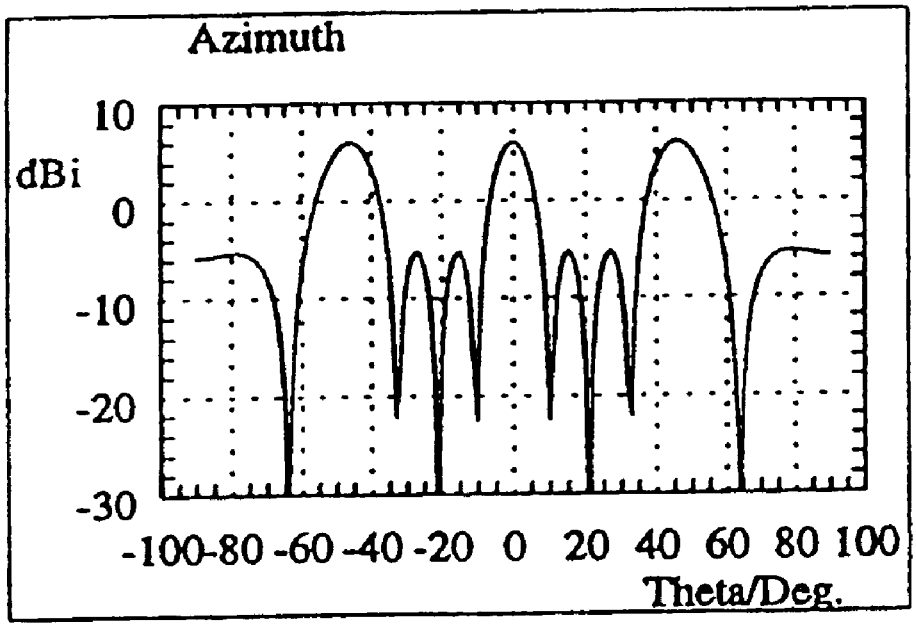
Figure 8:
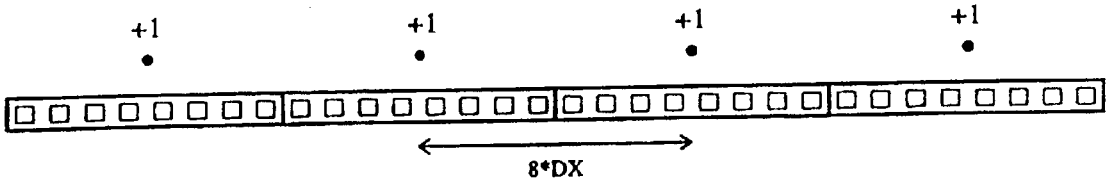
Figure 8:
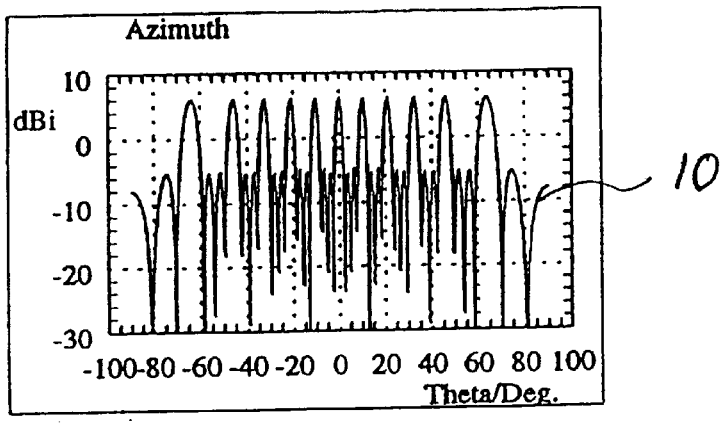
Figure 9:
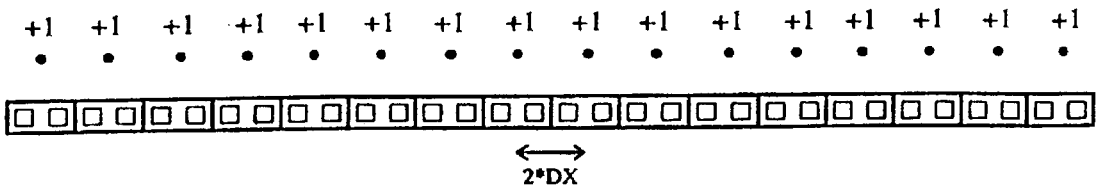
Figure 9:
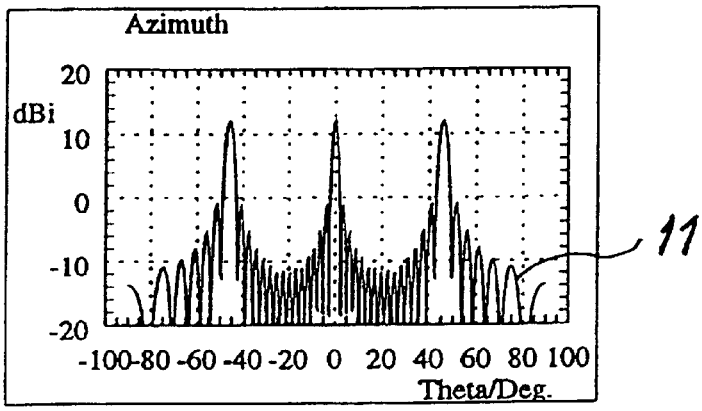
Figure 10:
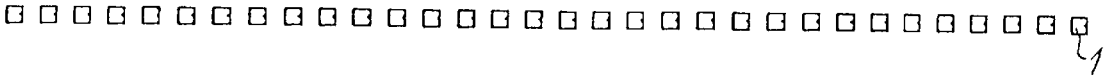
Figure 10:
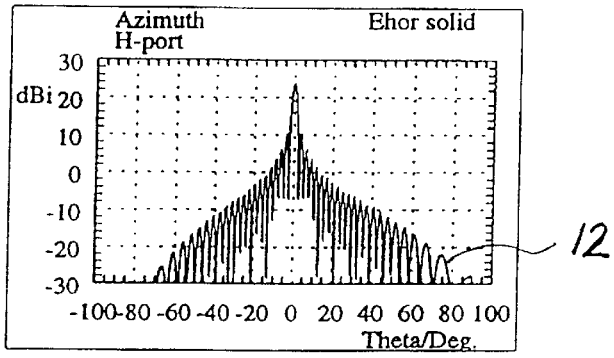
Figure 11:
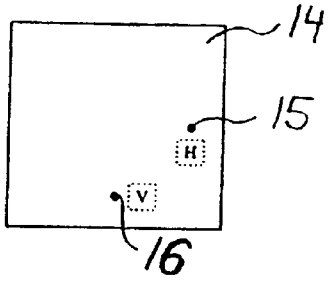
Figure 12:
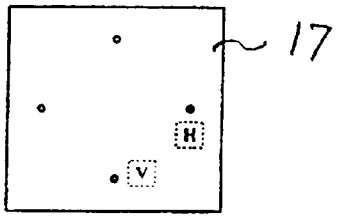
Figure 14:
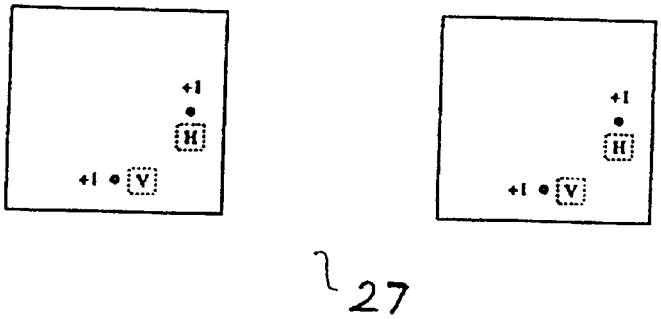
Figure 13:
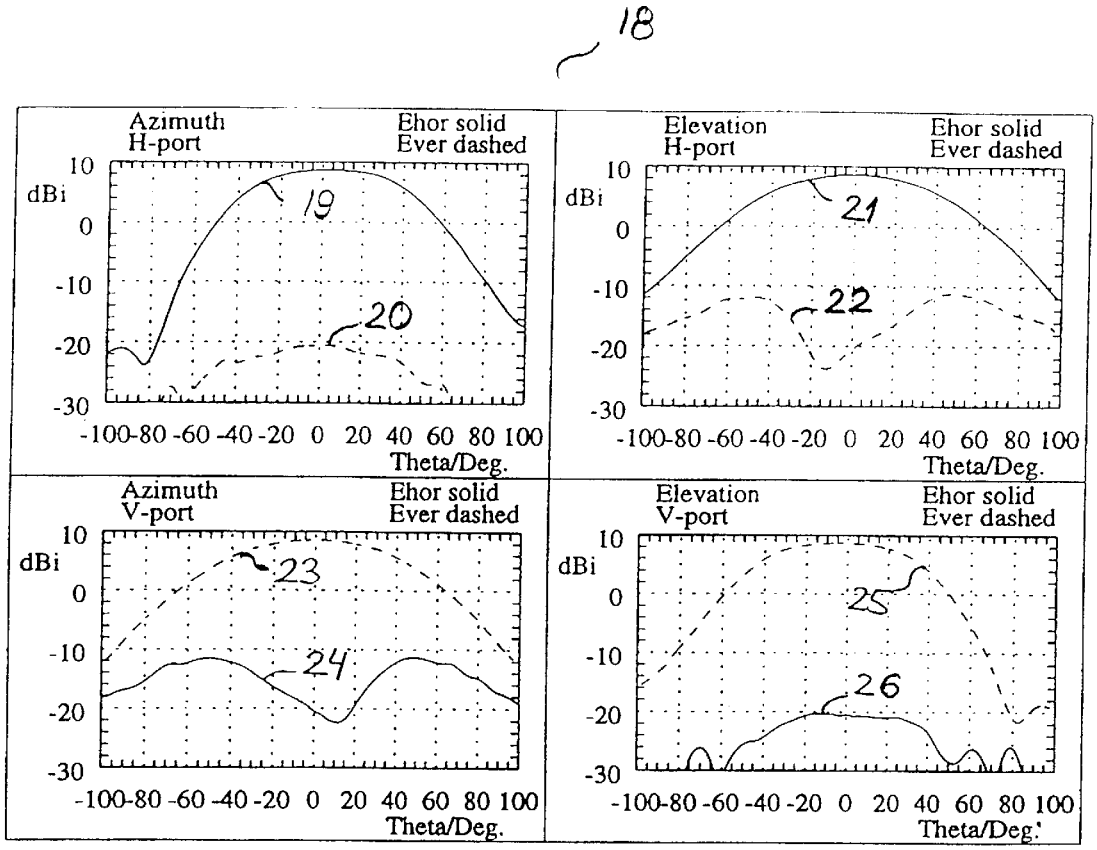
Figure 15:
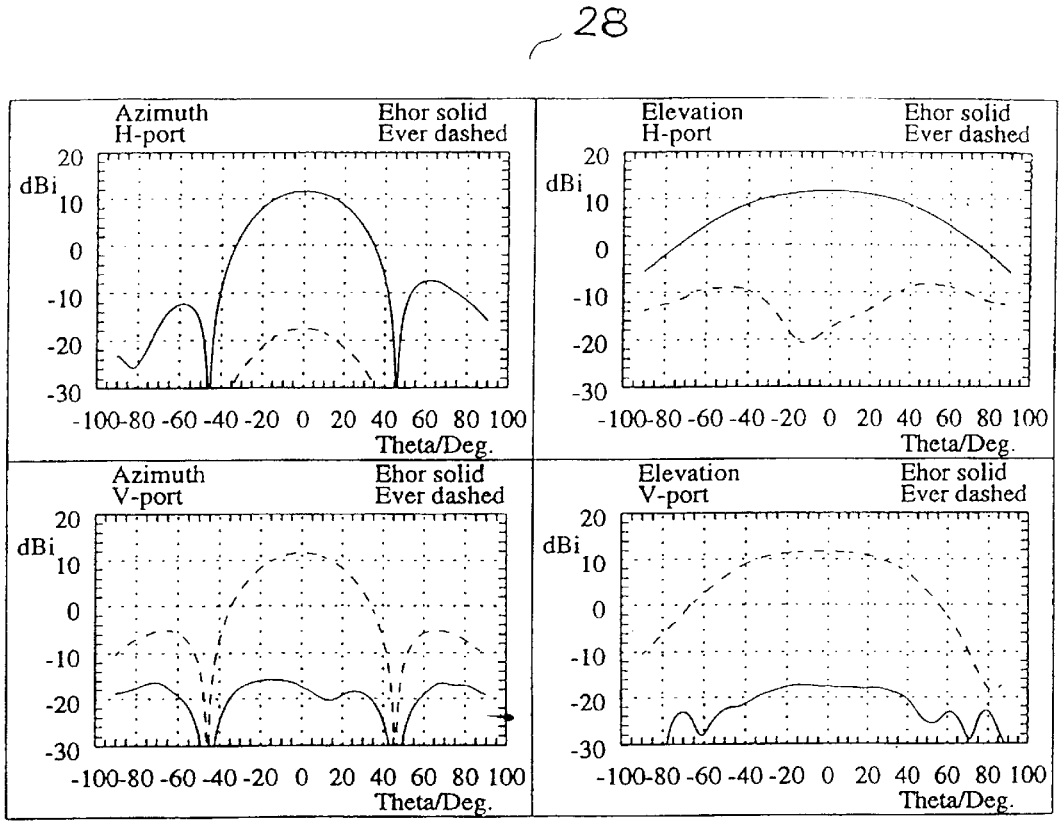
Figure 16:
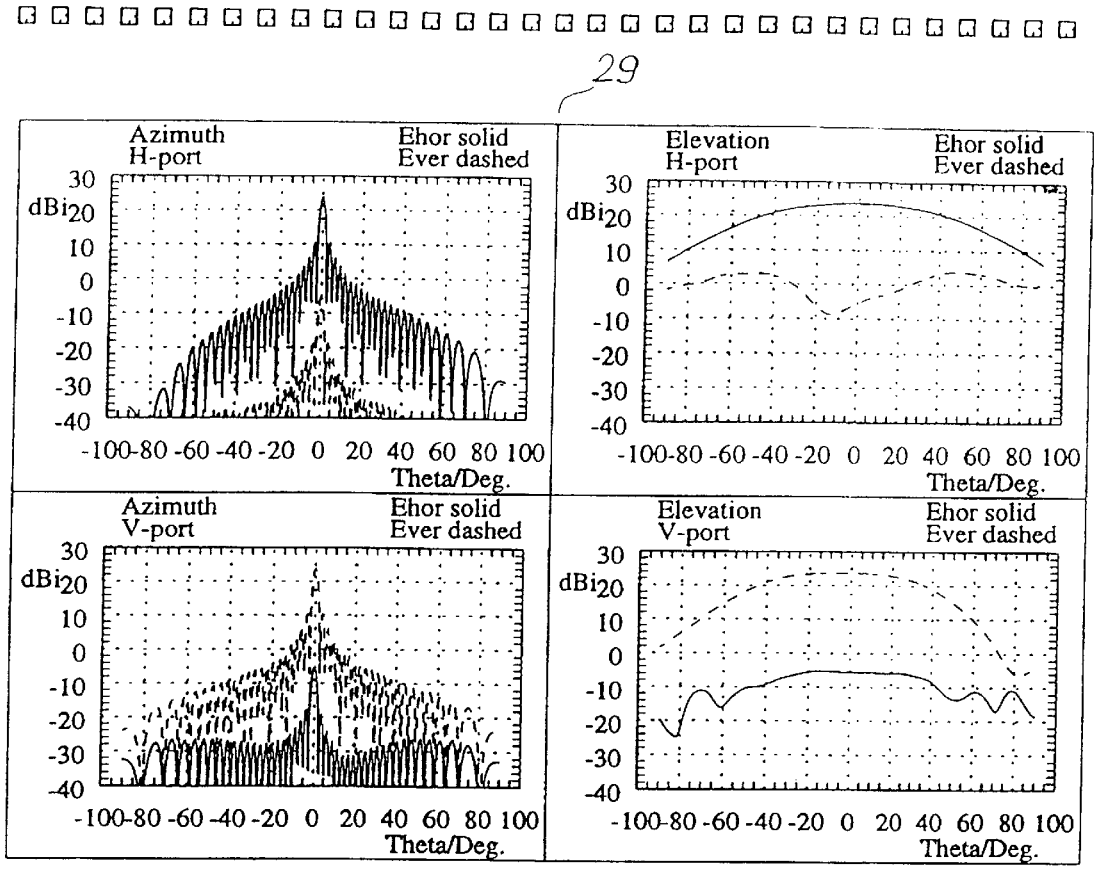
Figure 17:
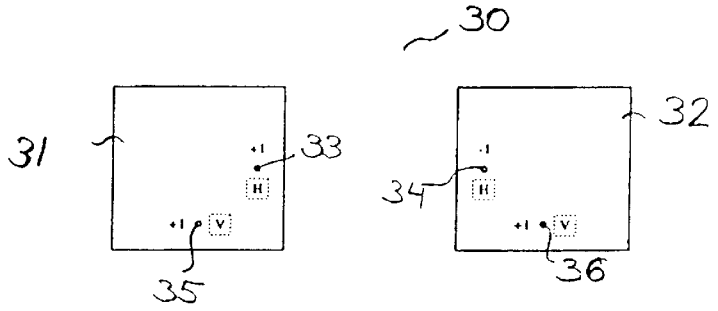
Figure 18:
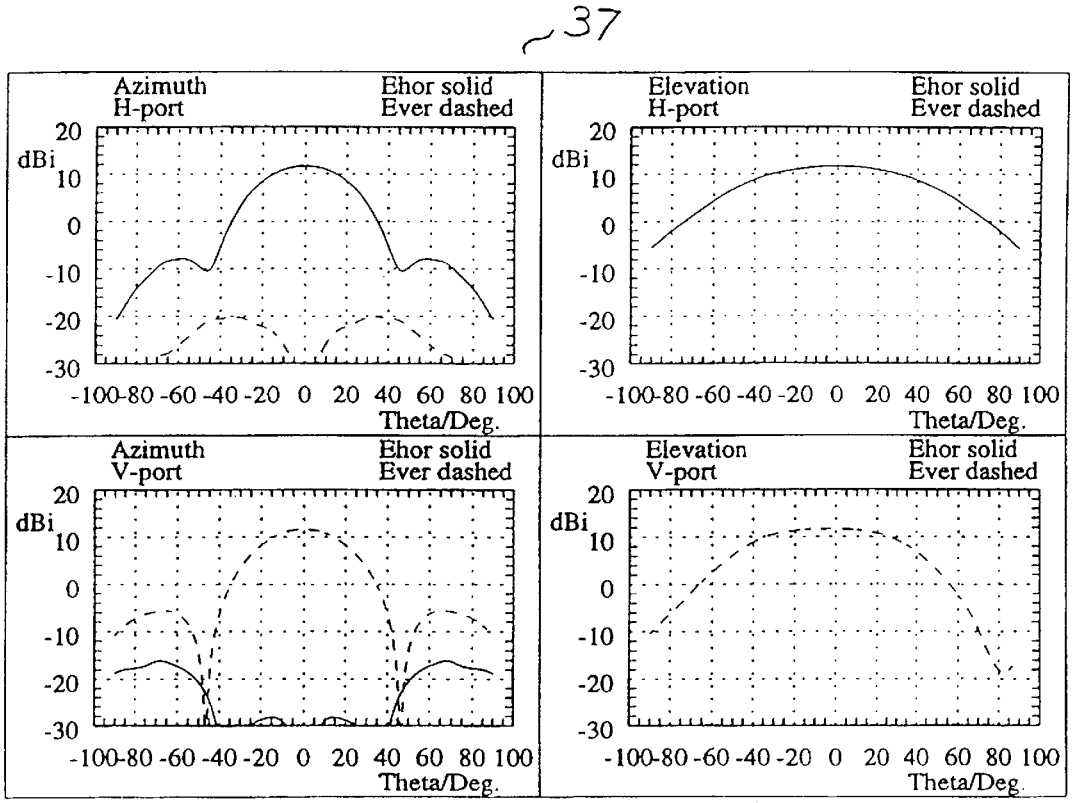
Figure 19:
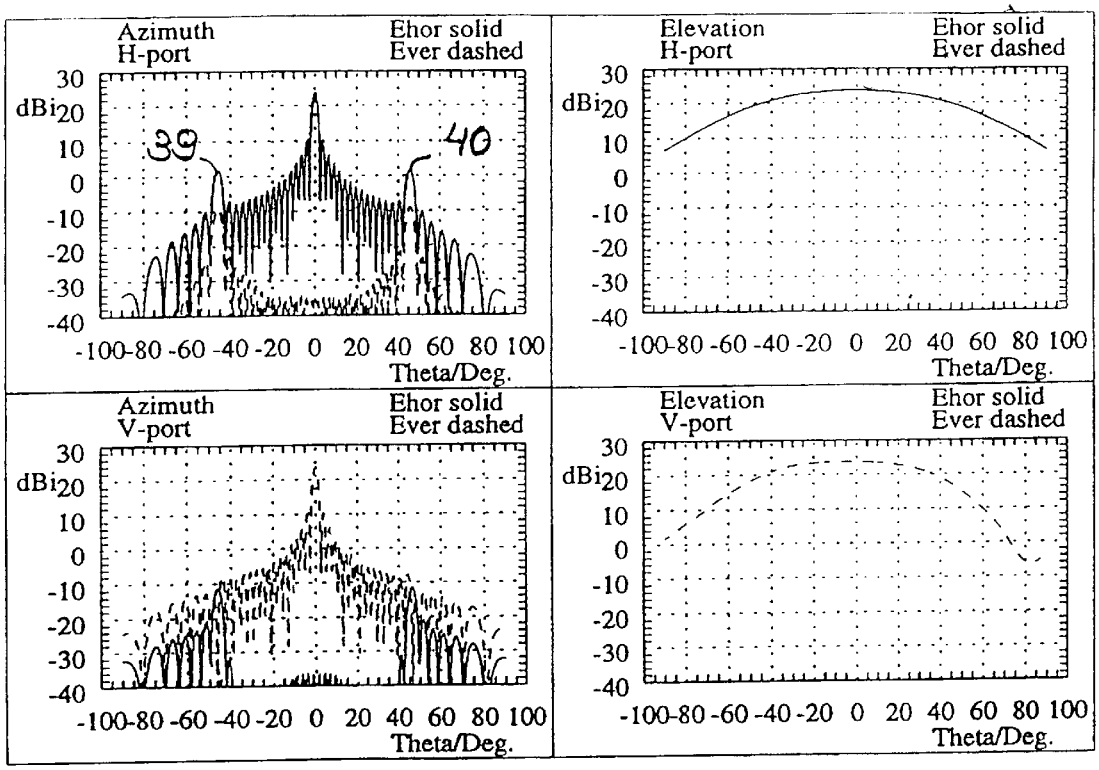
Figure 20A:
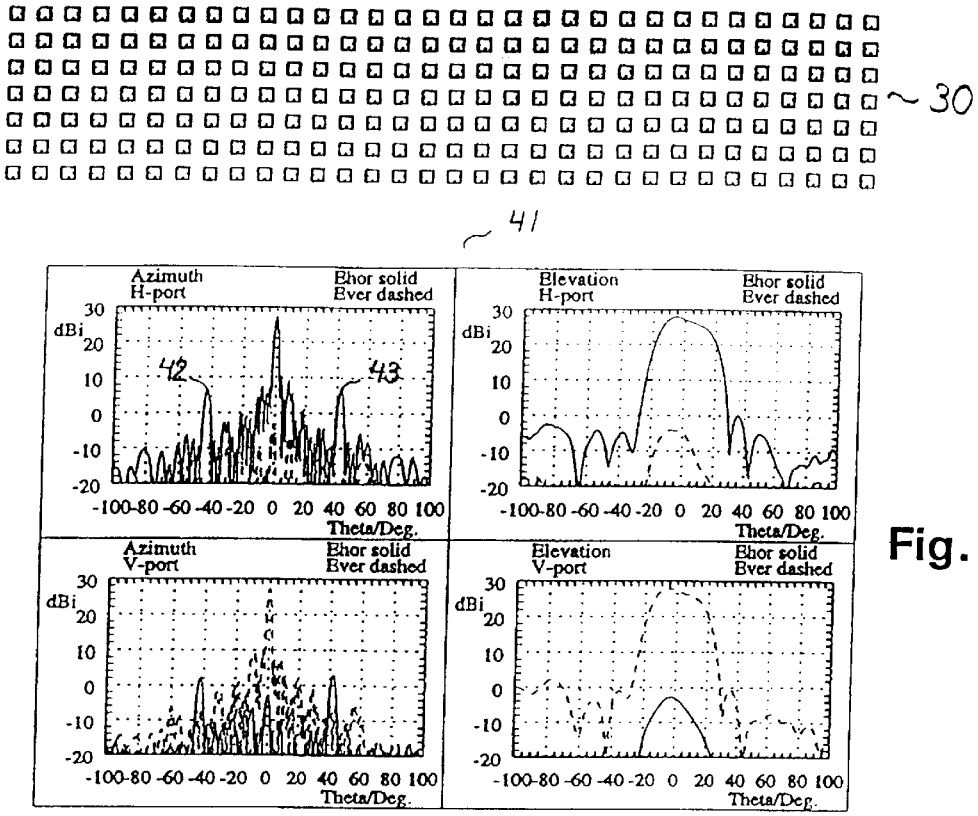
Figure 20B:
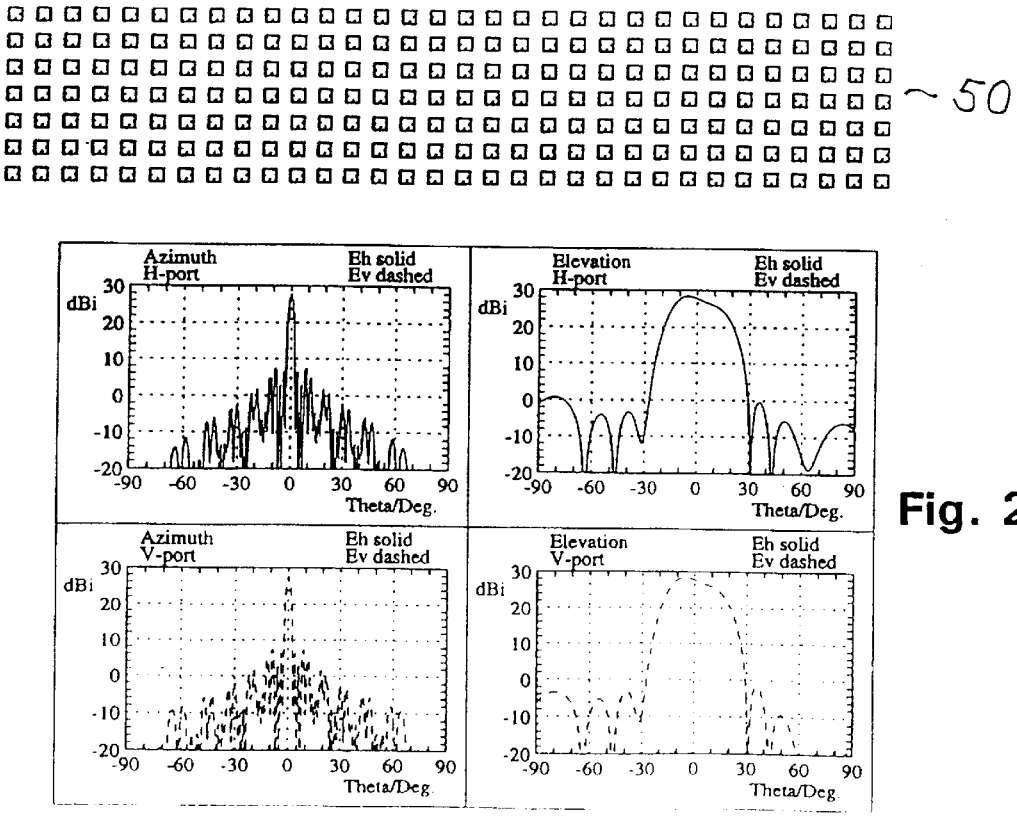
Figure 21:
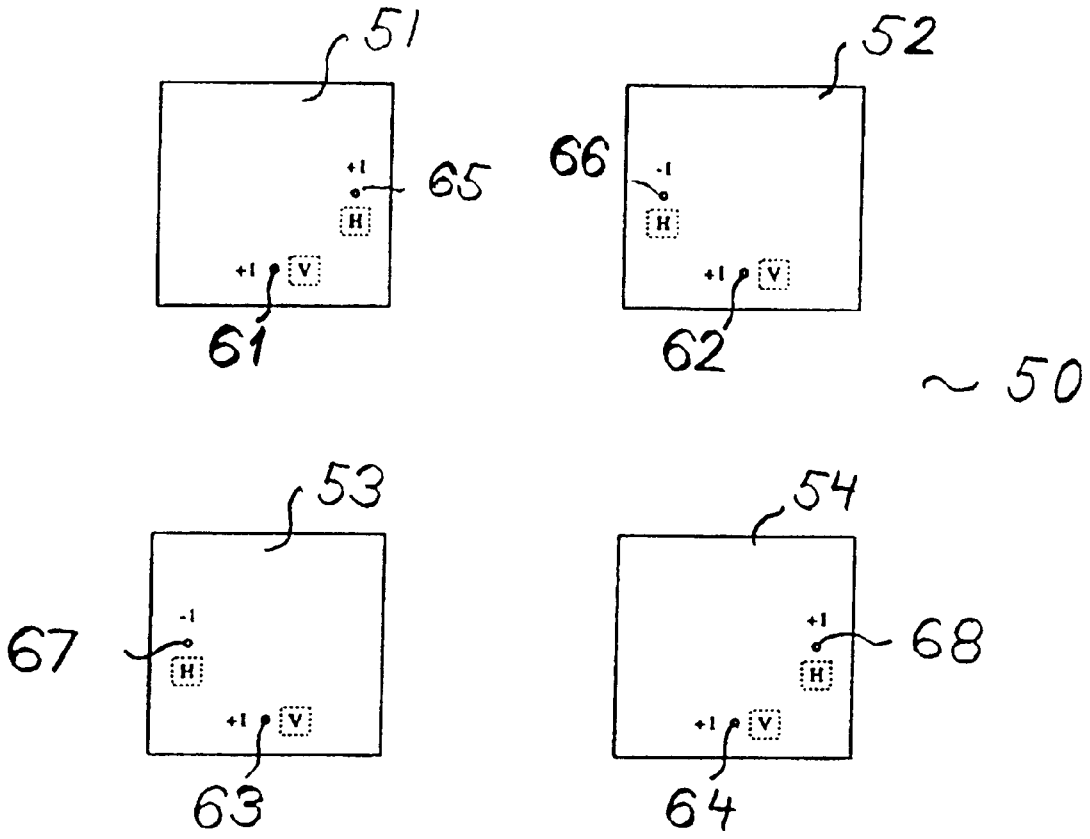
Figure 22:
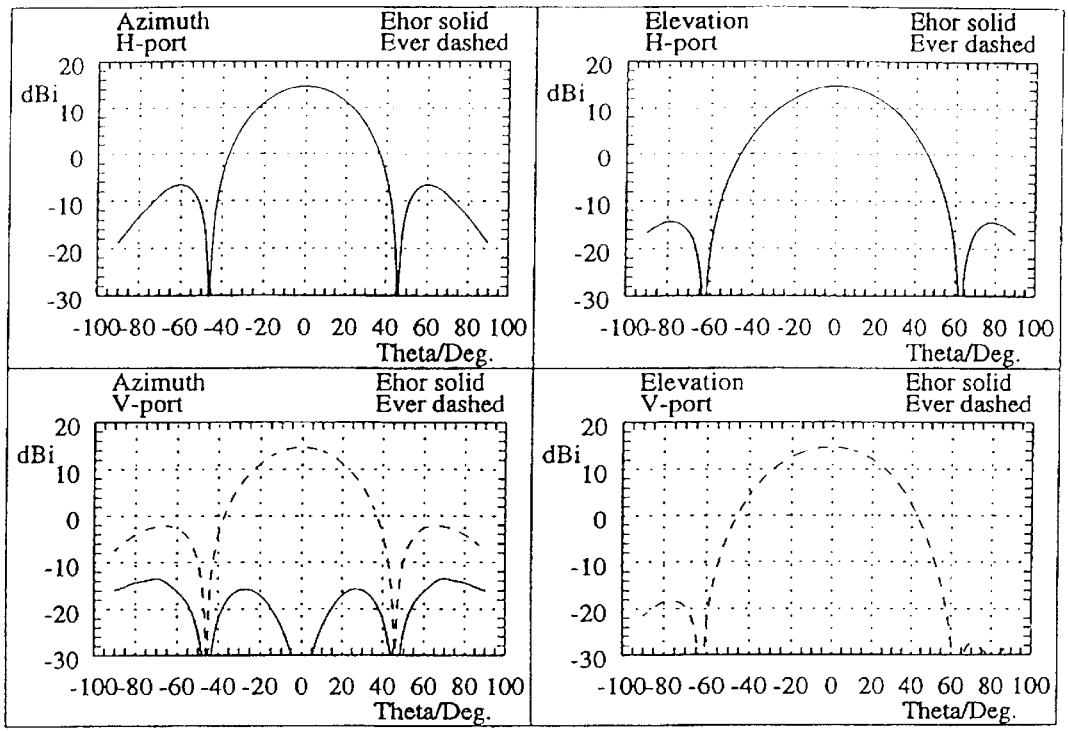
Figure 23:
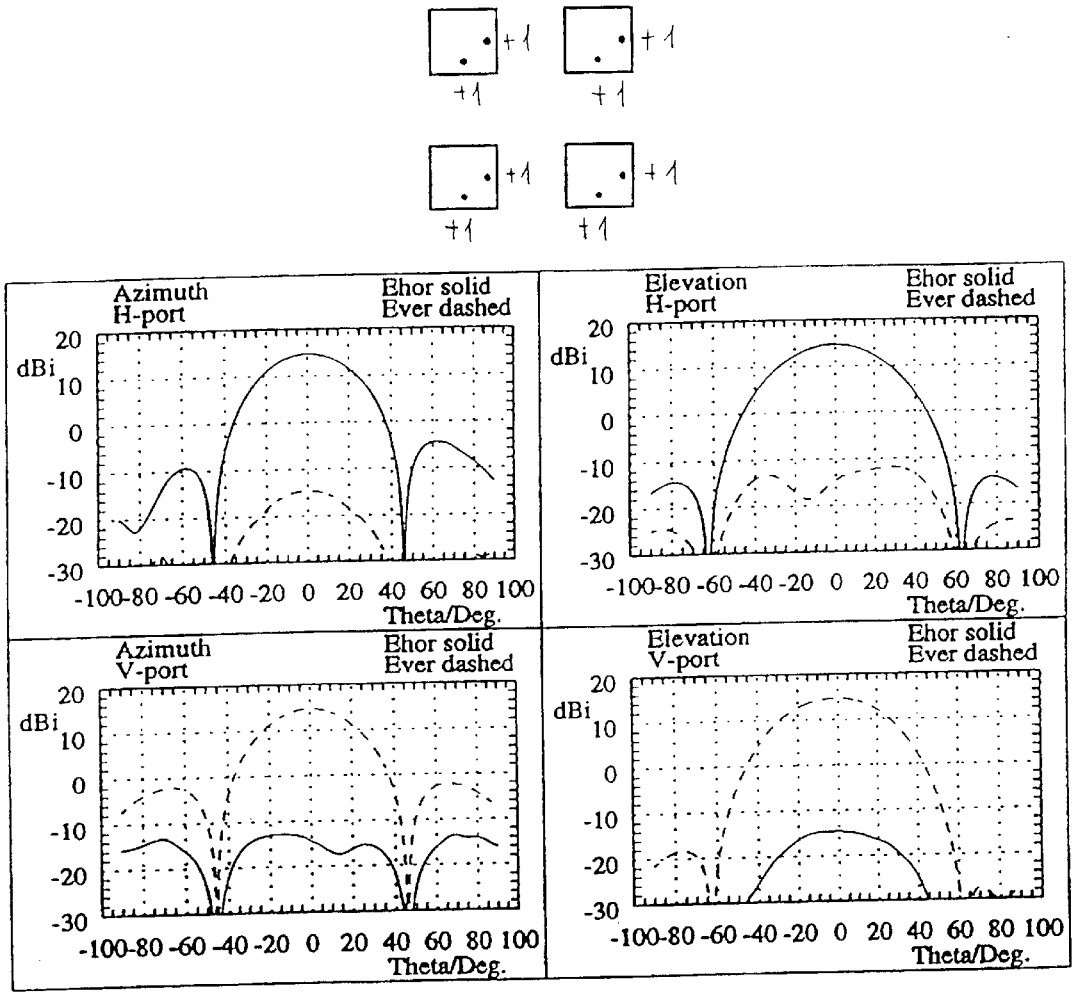
Figure 24:
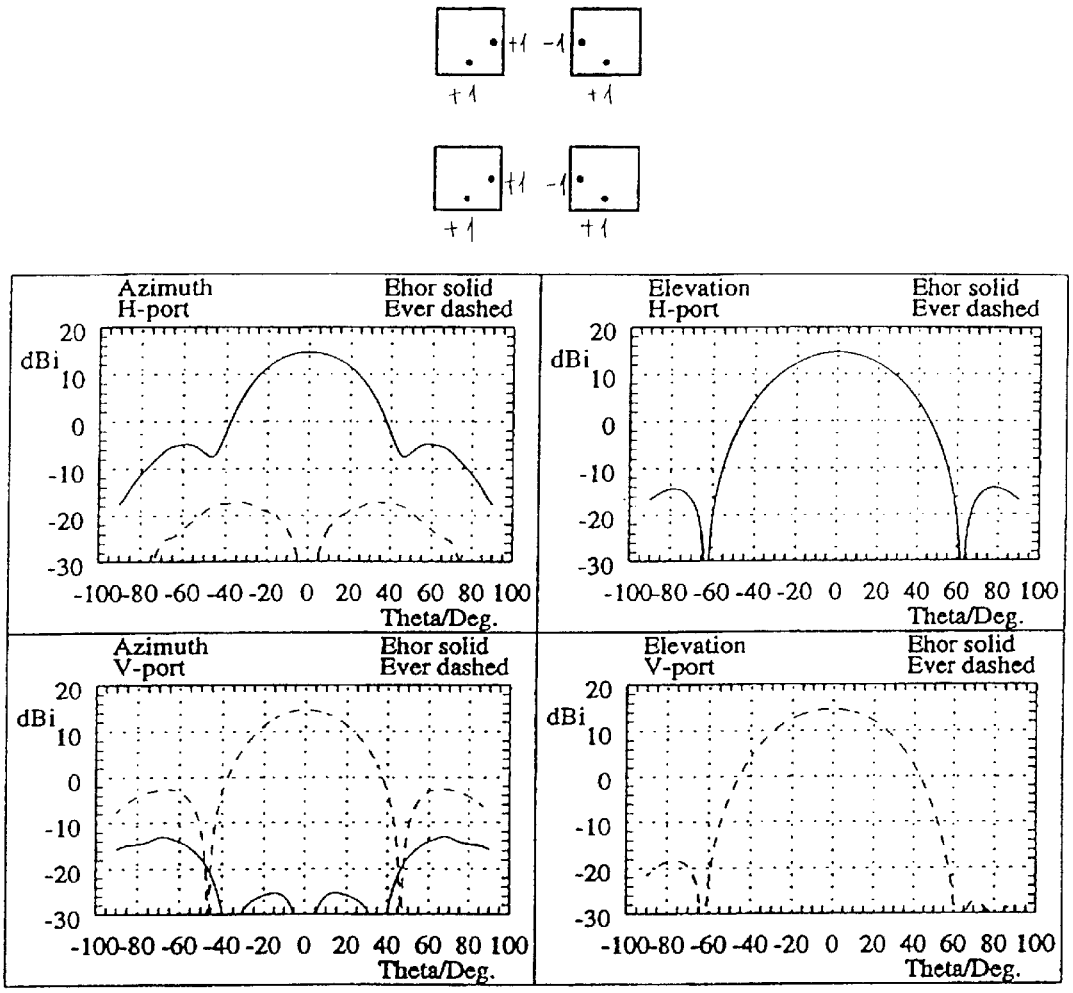
Figure 25:
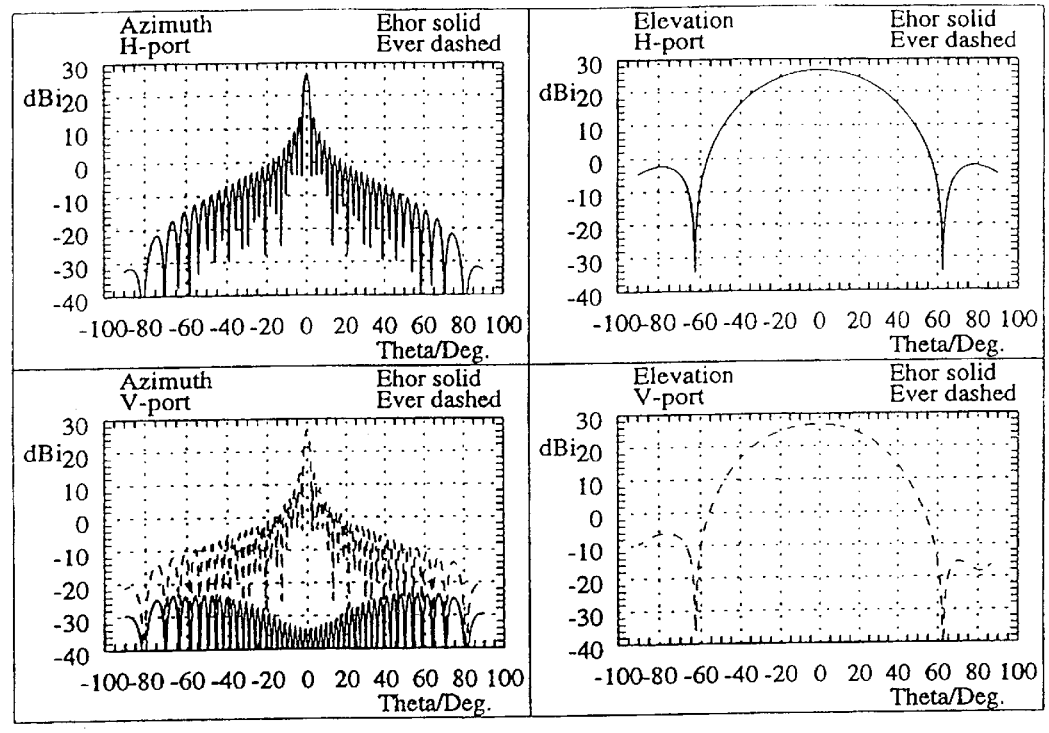
Figure 26:
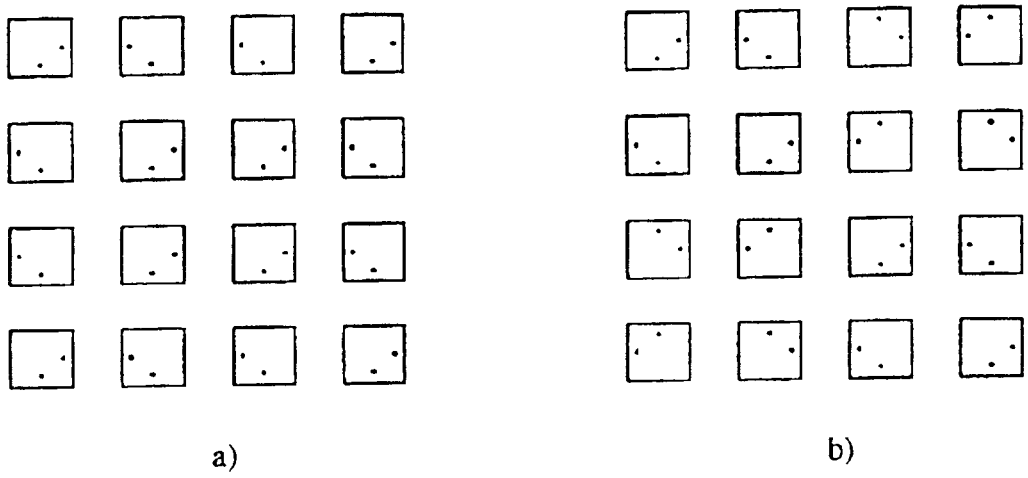
Figure 28:
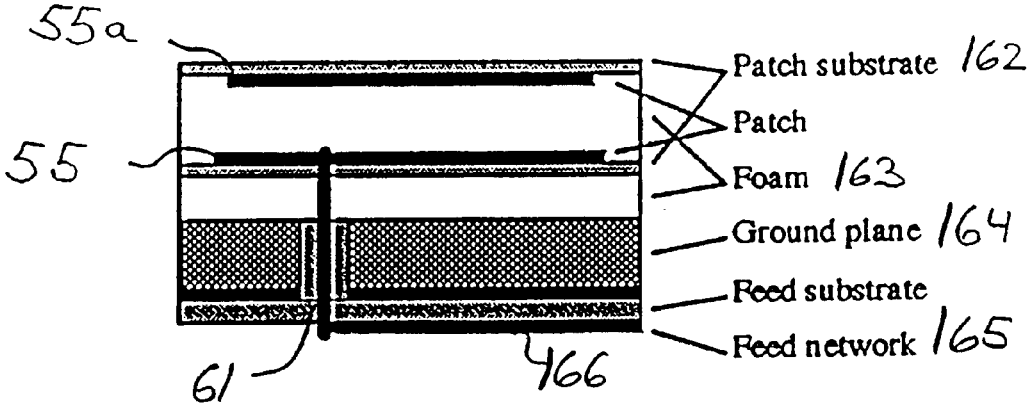
Figure 27:
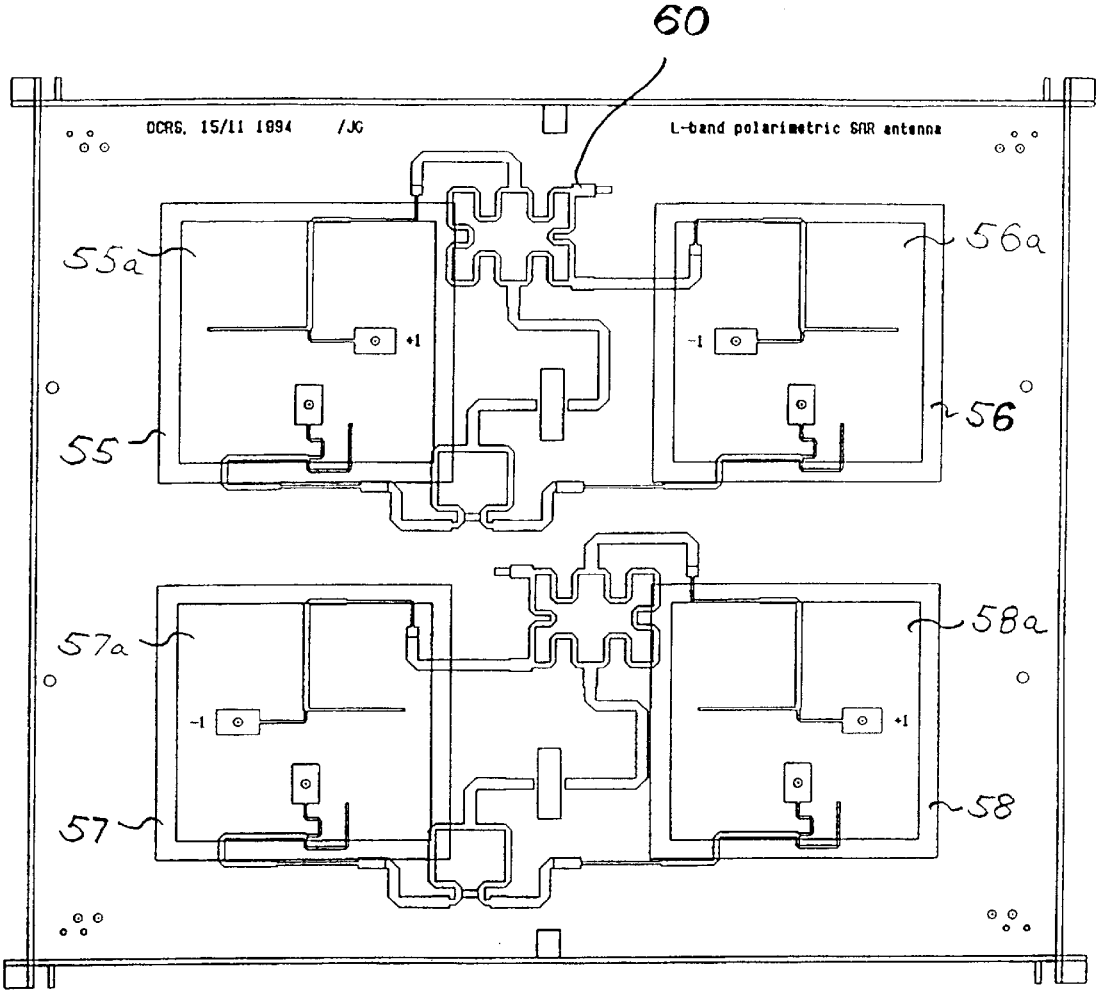
Figure 29:
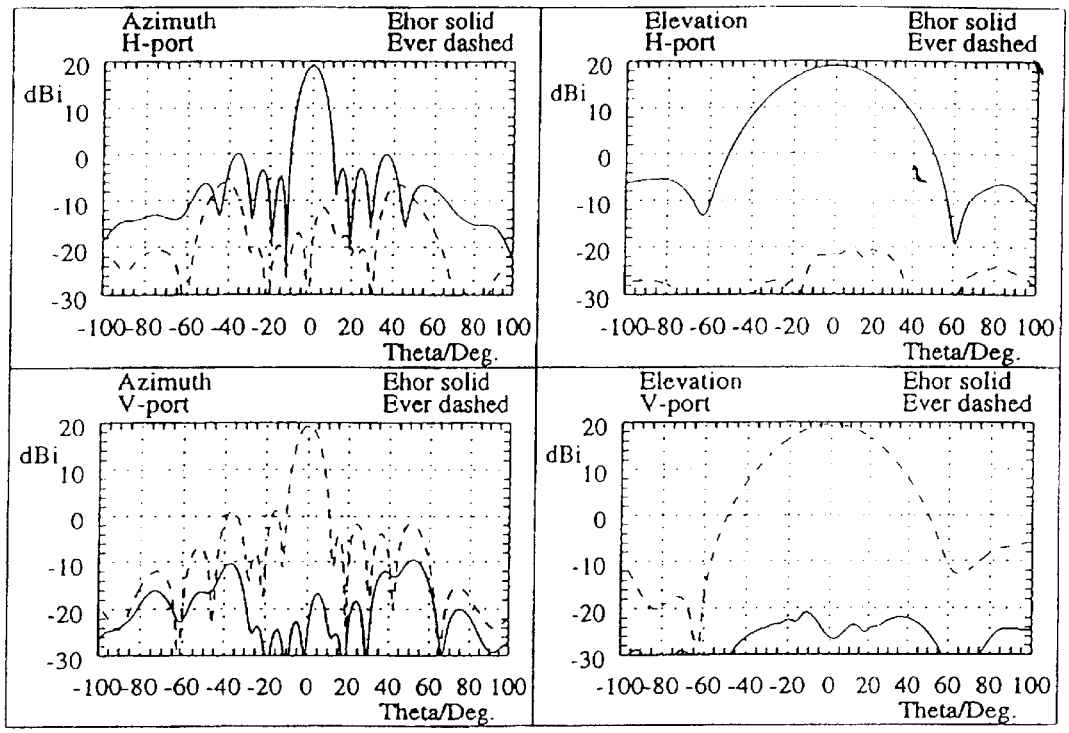
Figure 30:
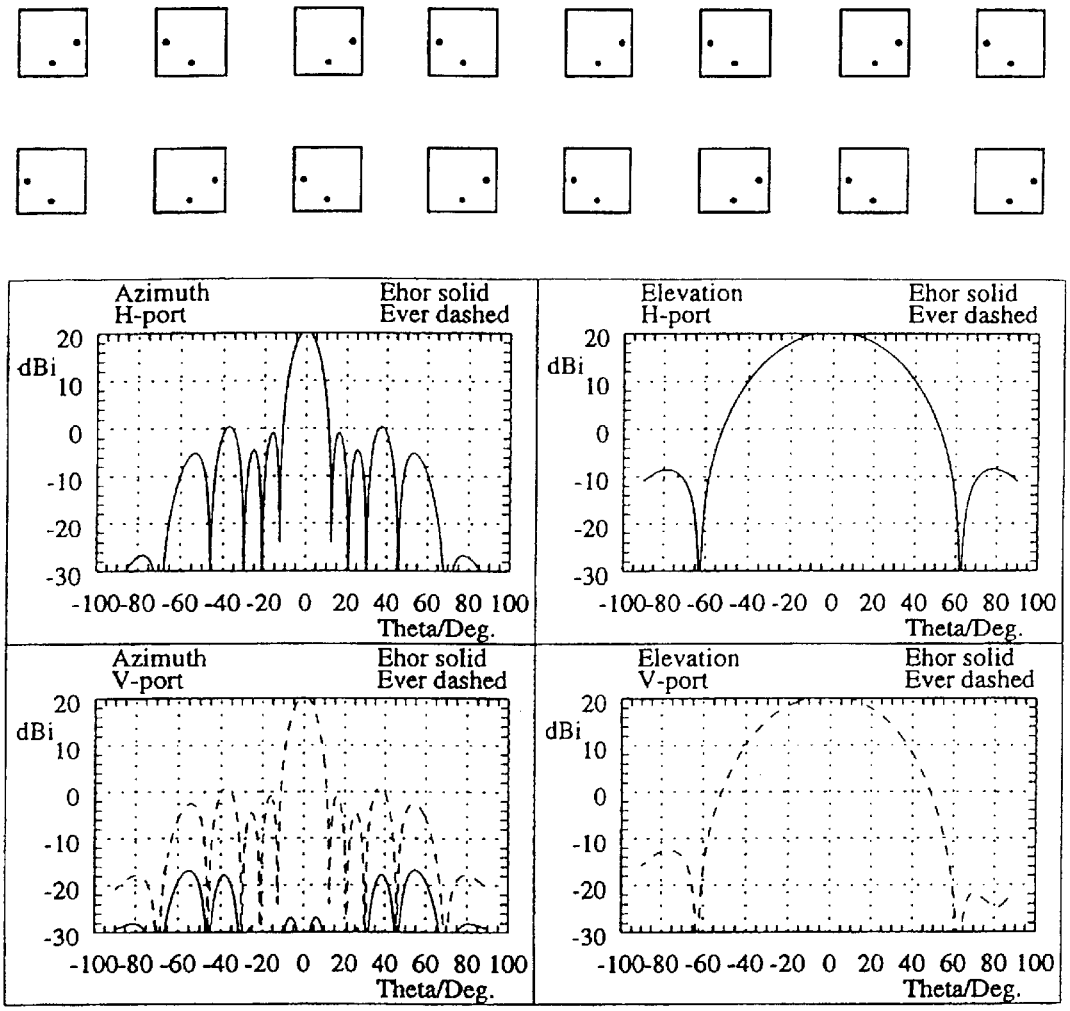
Figure 31:
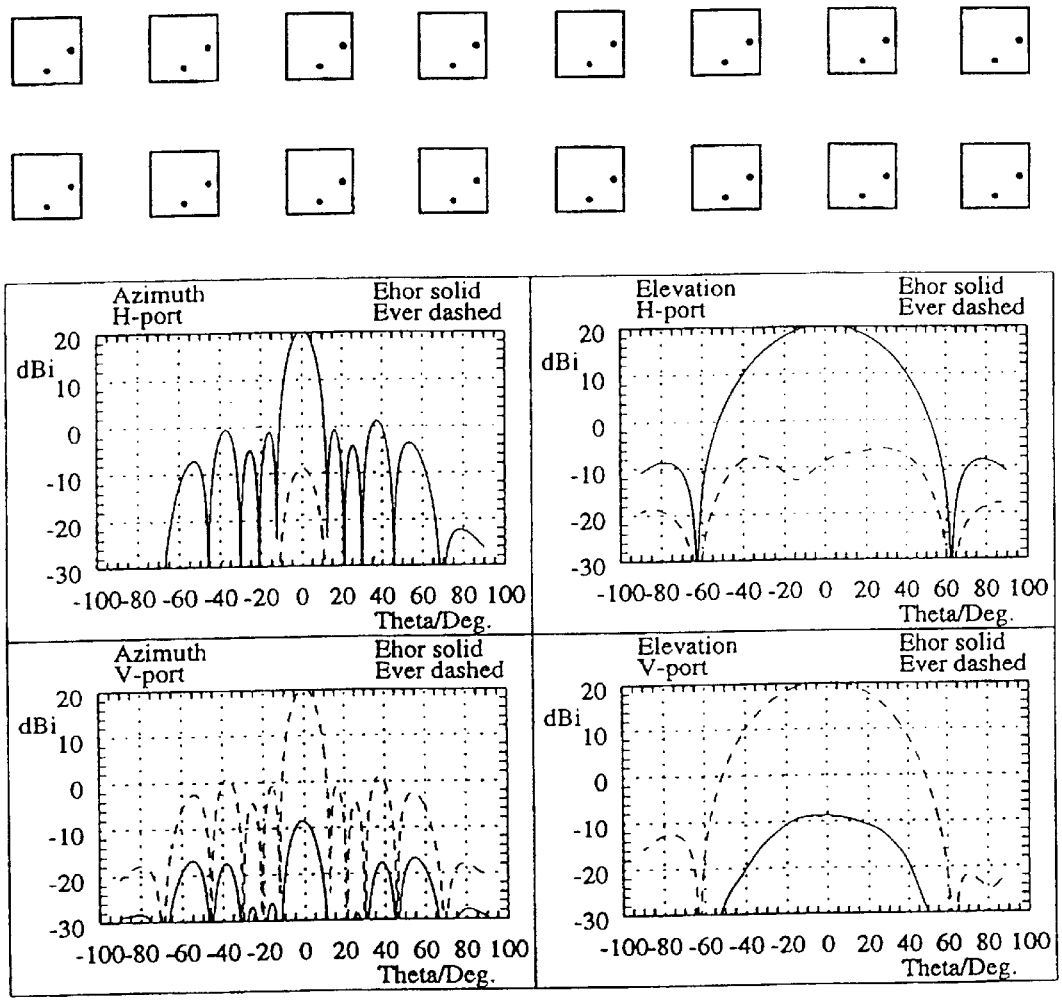
Figure 32:
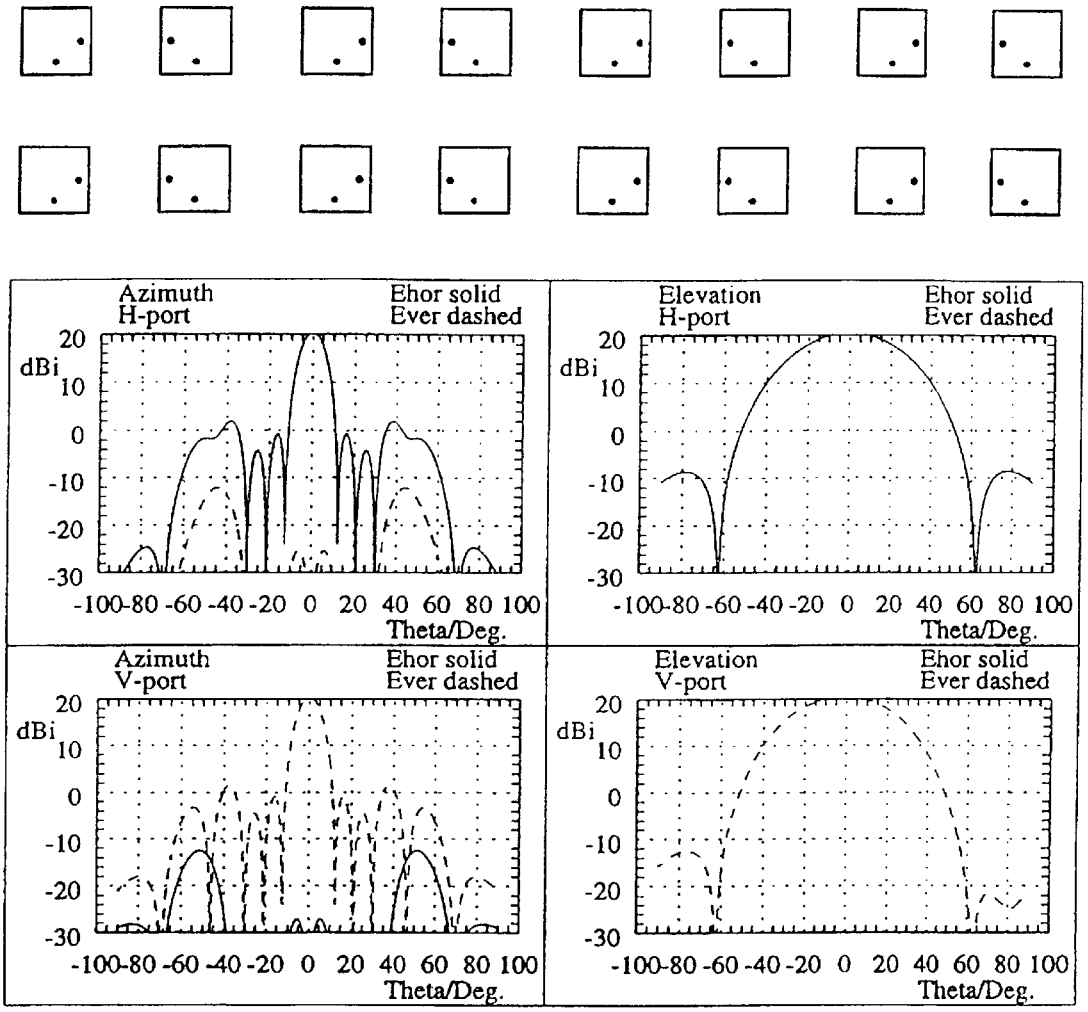
Figure 33:
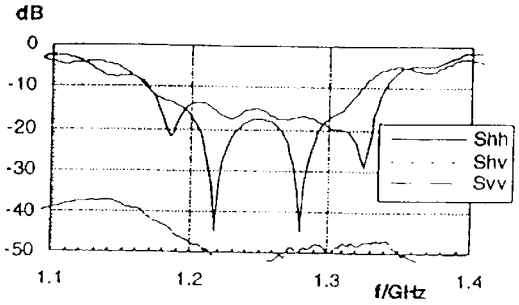
Figure 34:
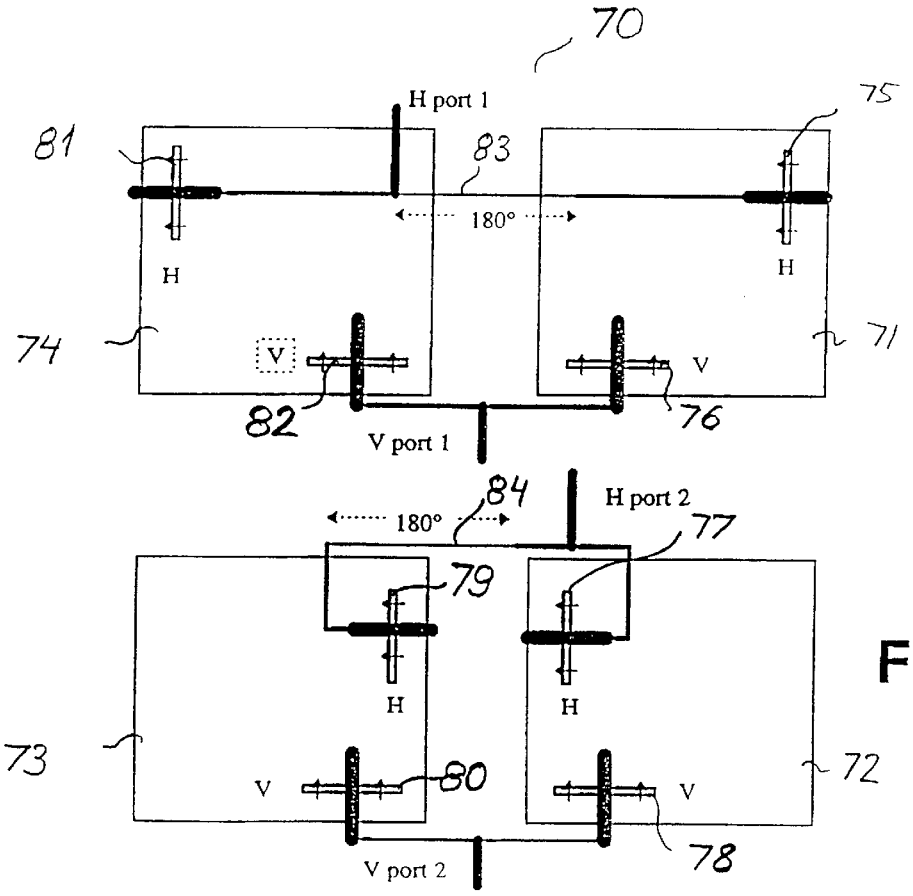
Figure 35:
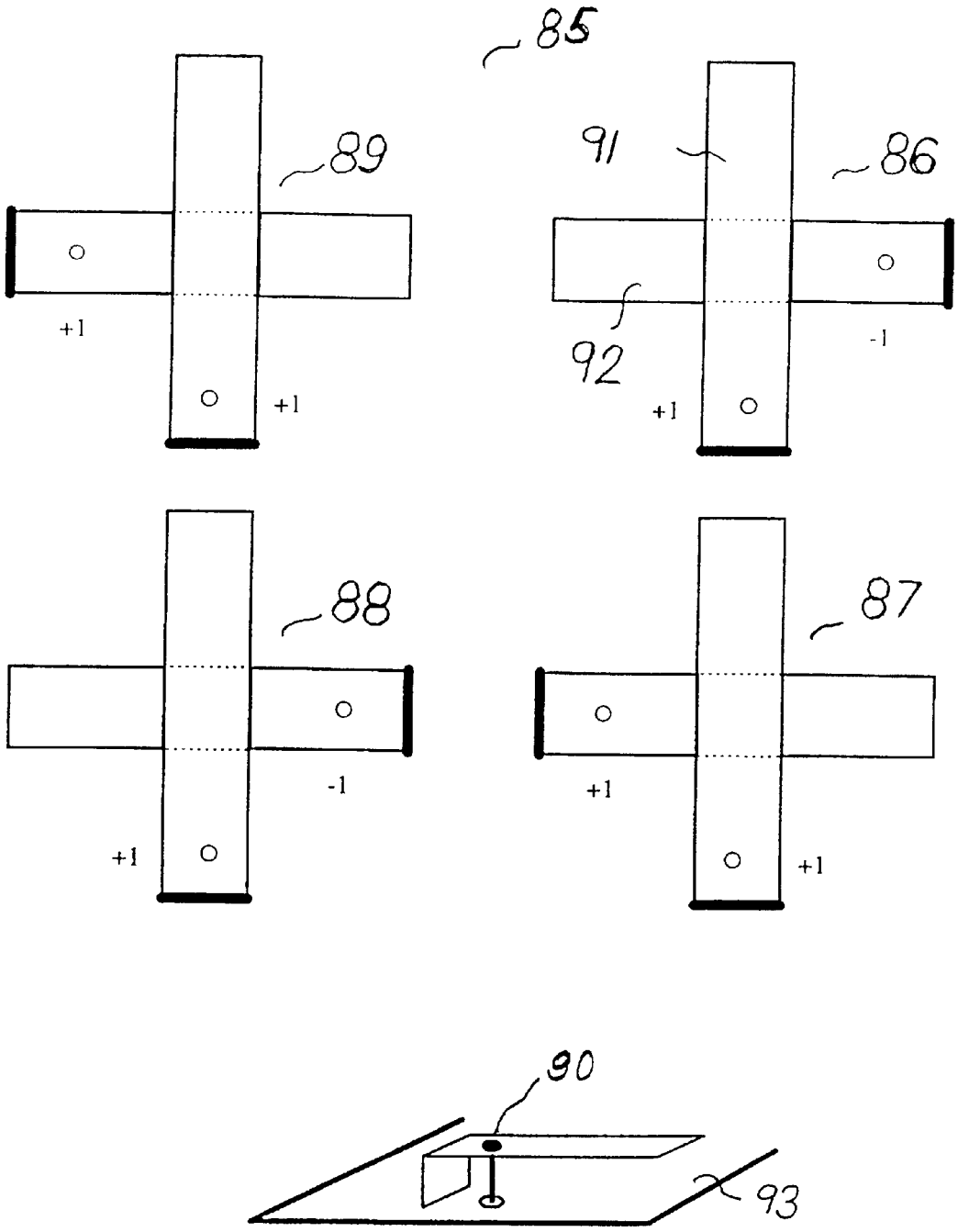
Figure 36:
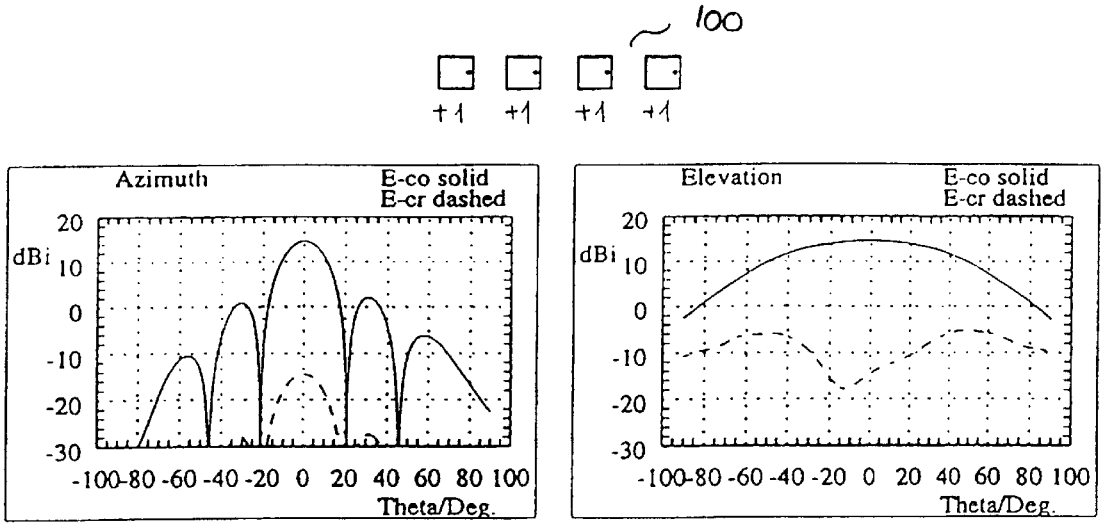
Figure 37:
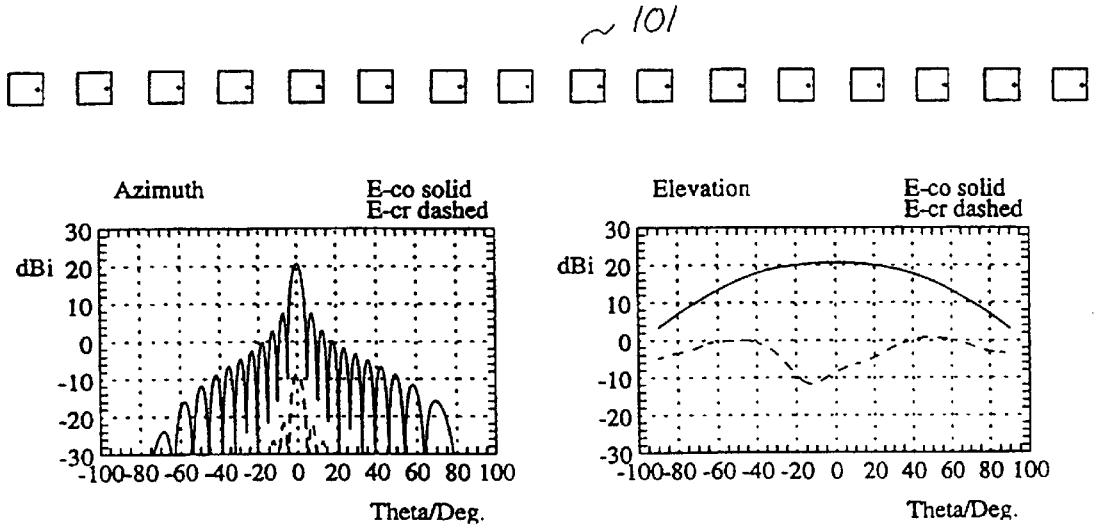
Figure 38:
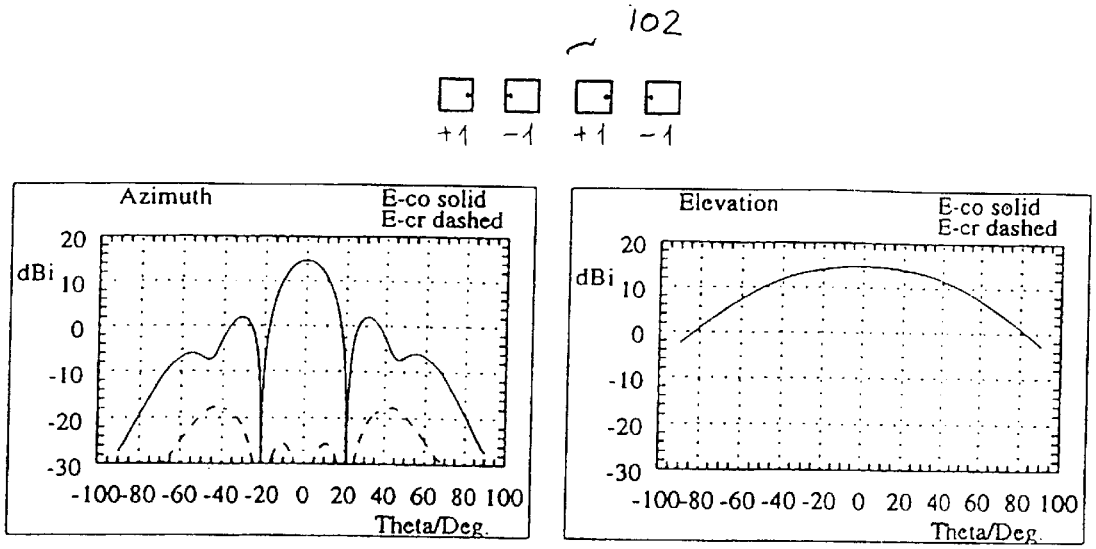
Figure 39:
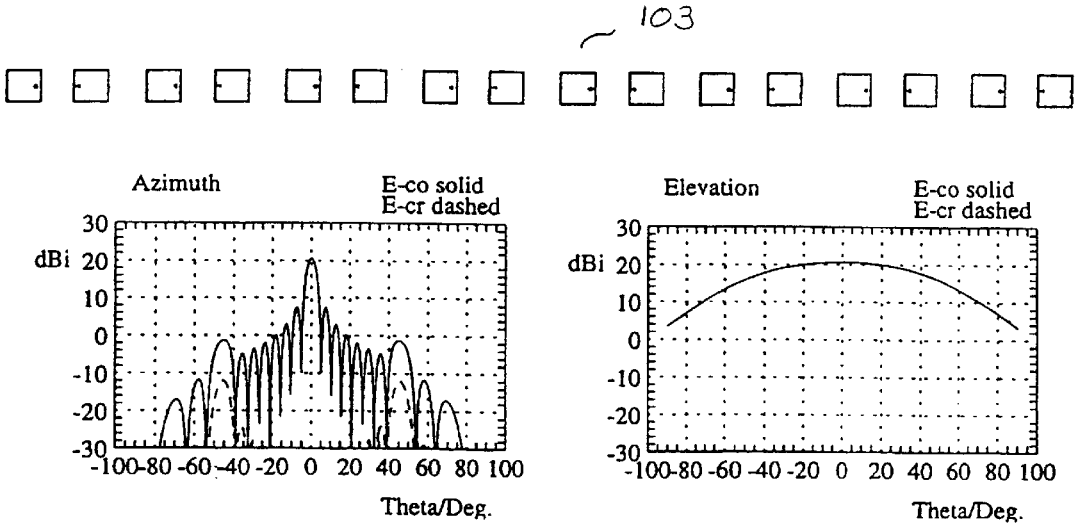
Figure 40:
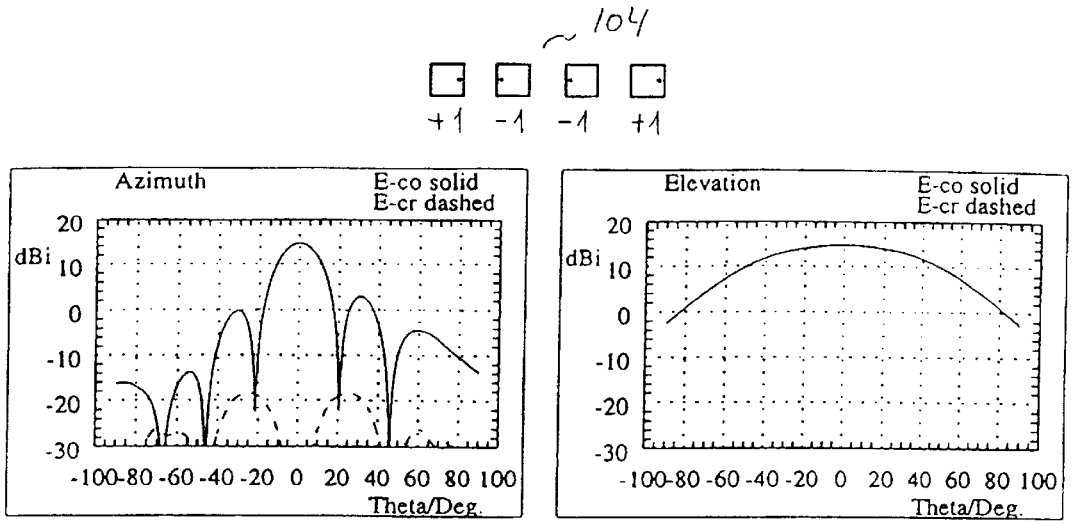
Figure 41:
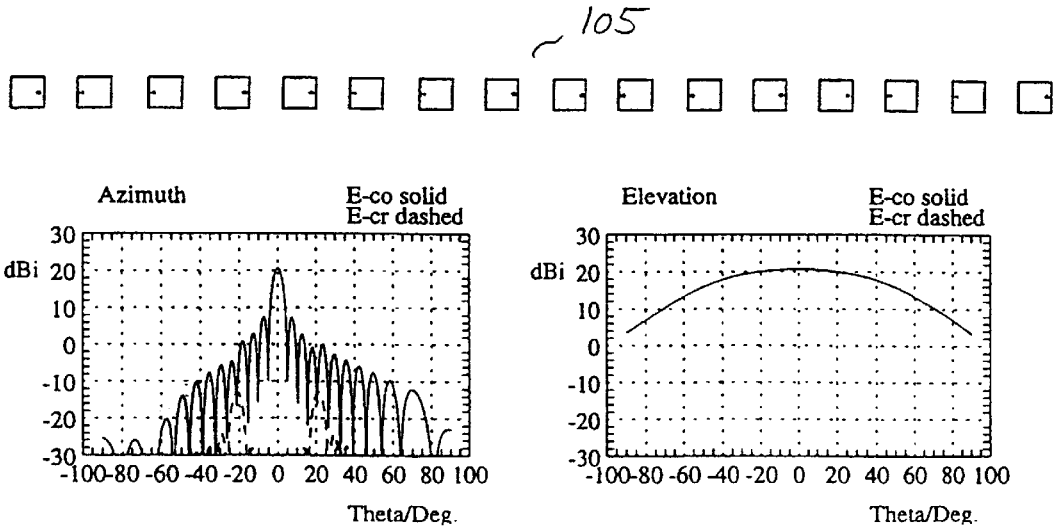
Figure 42:
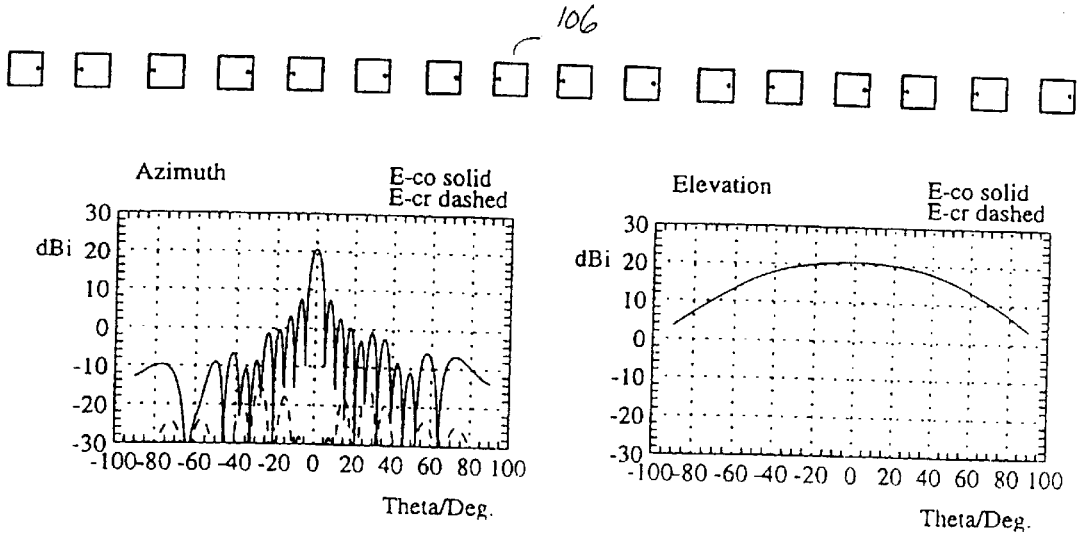
Figure 43:
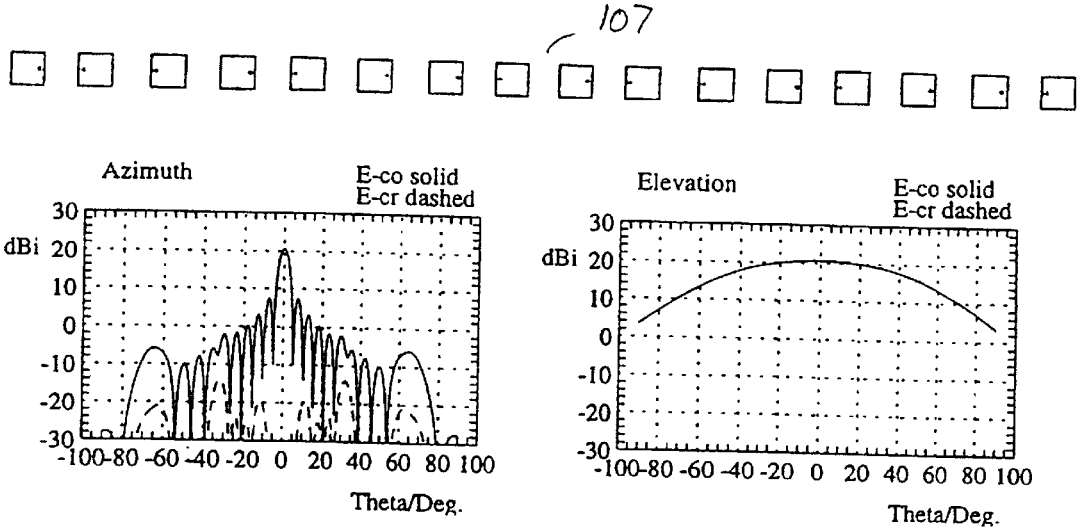
Figure 44:
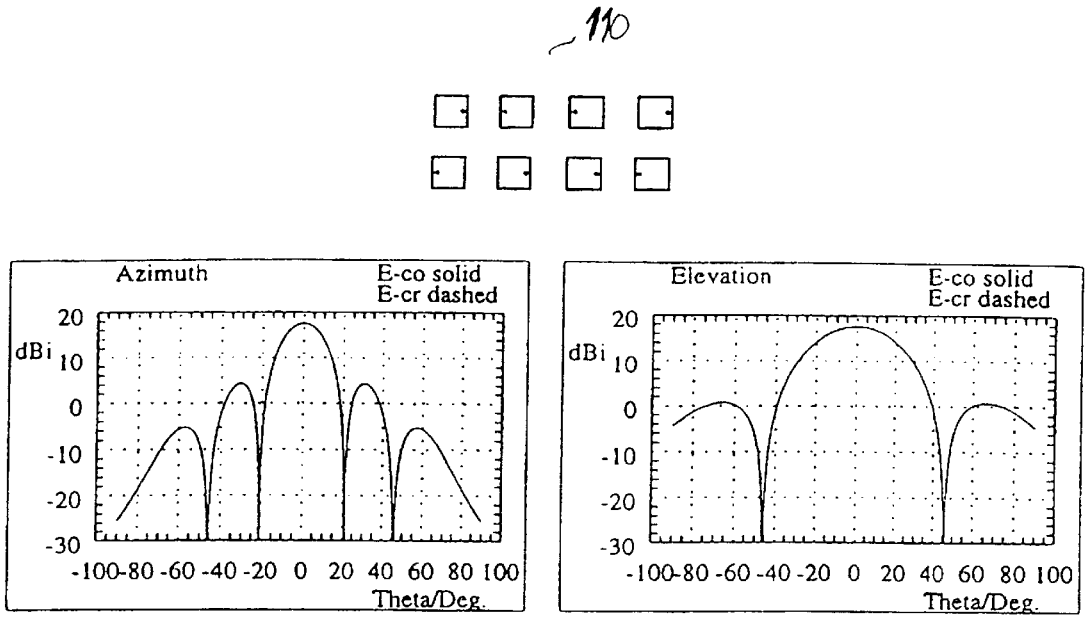
Figure 45:
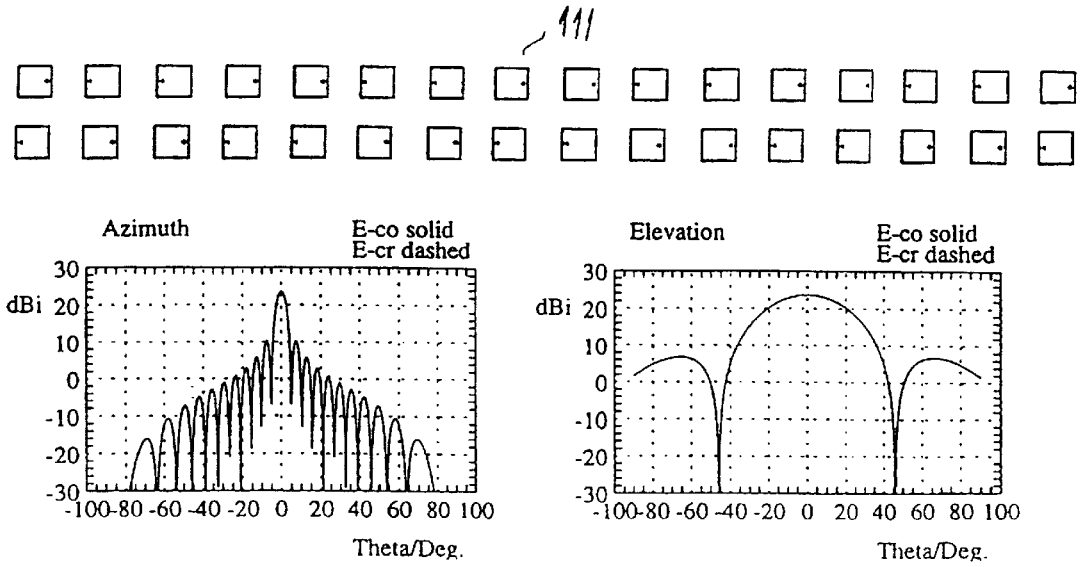
Figure 46:
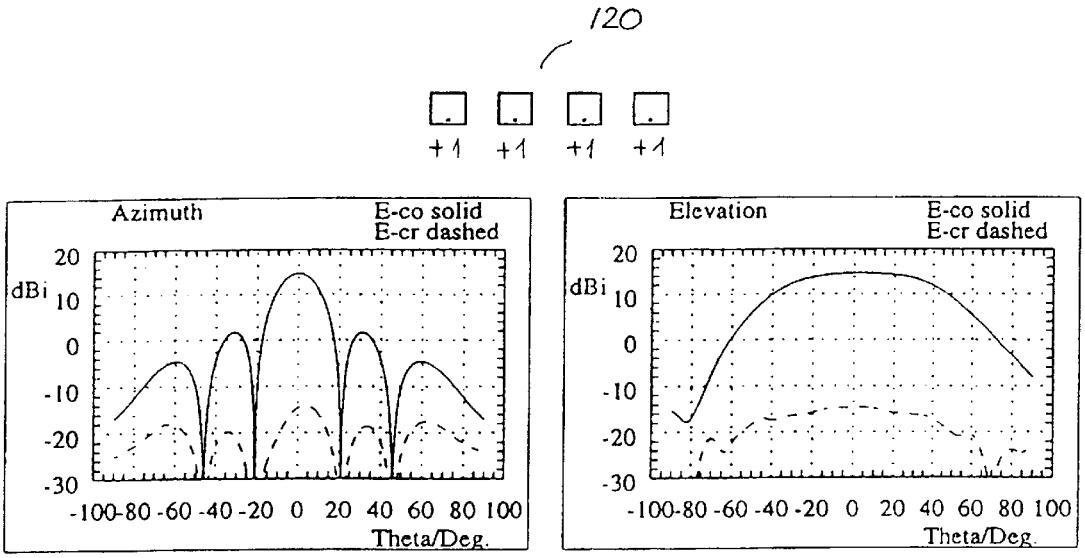
Figure 47:
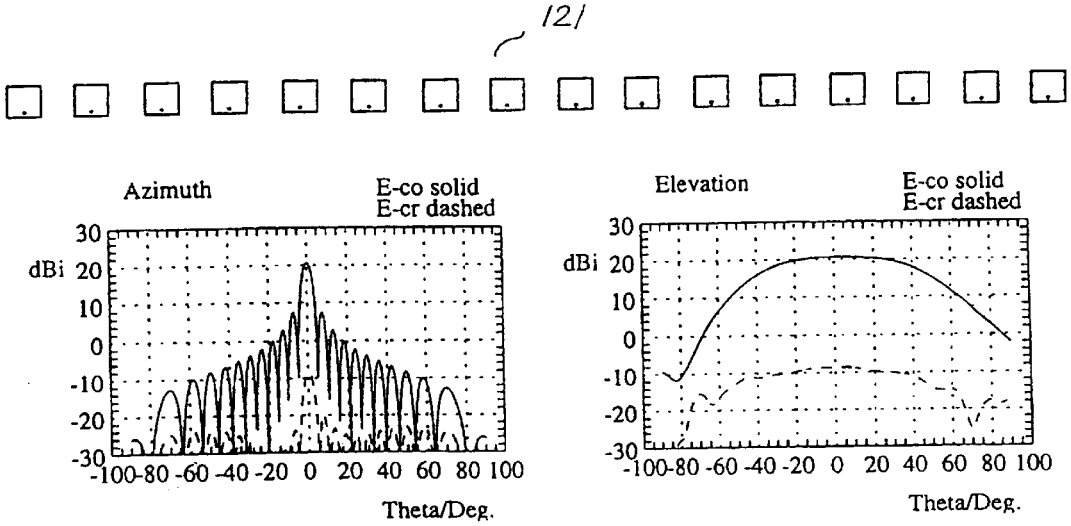
Figure 48:
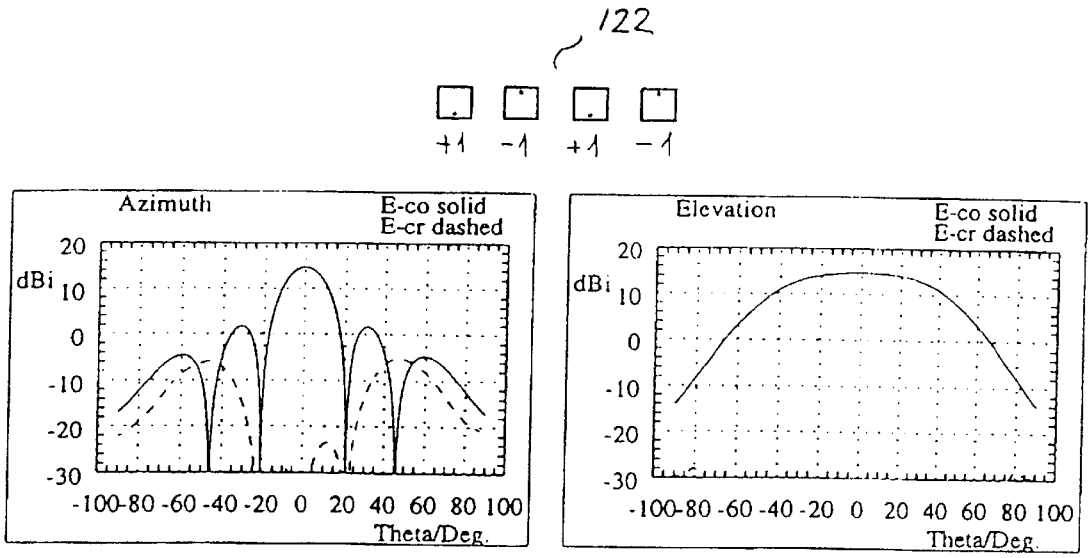
Figure 49:
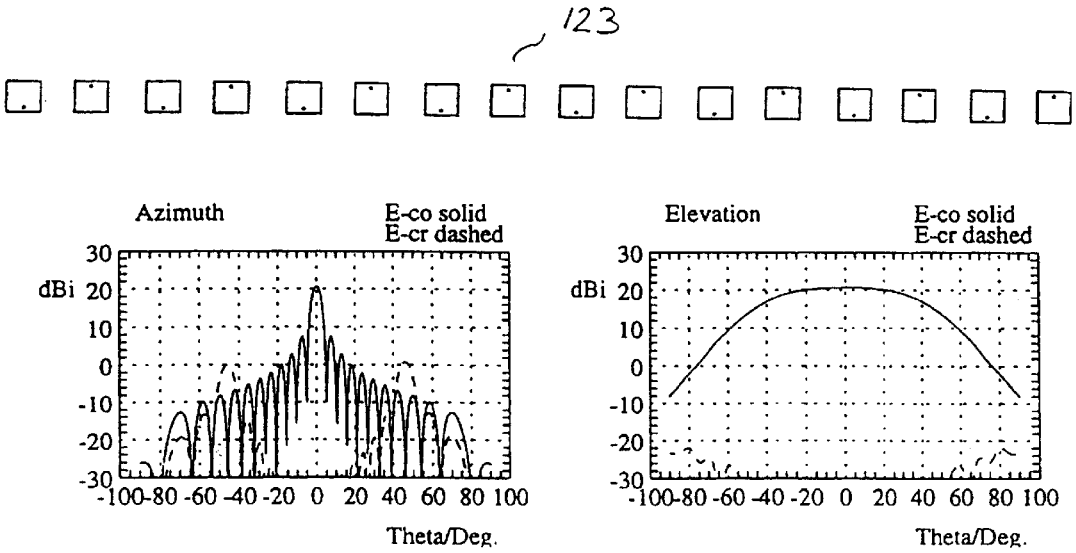
Figure 50:
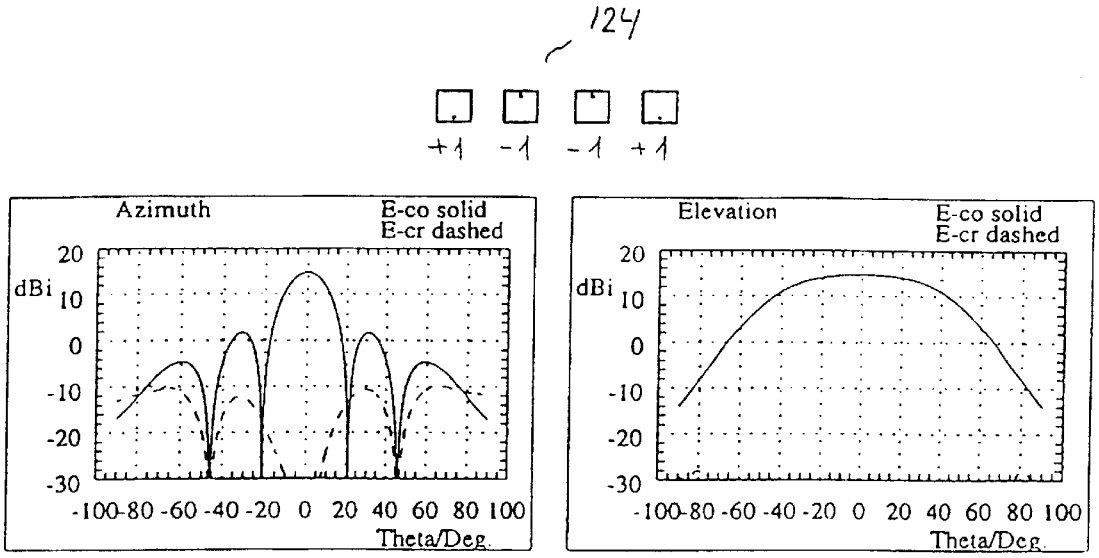
Figure 51:
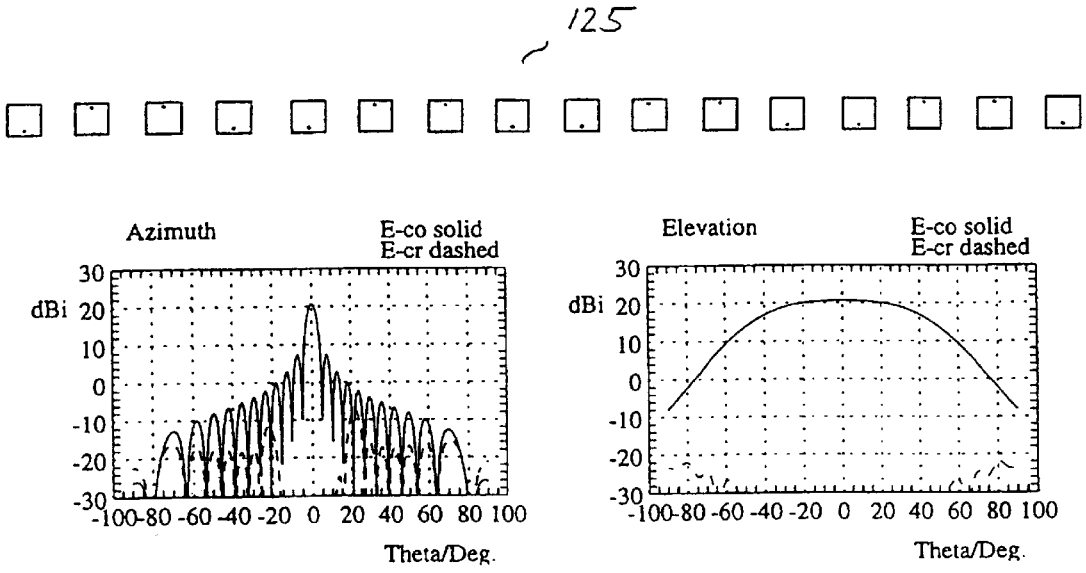
Figure 52:
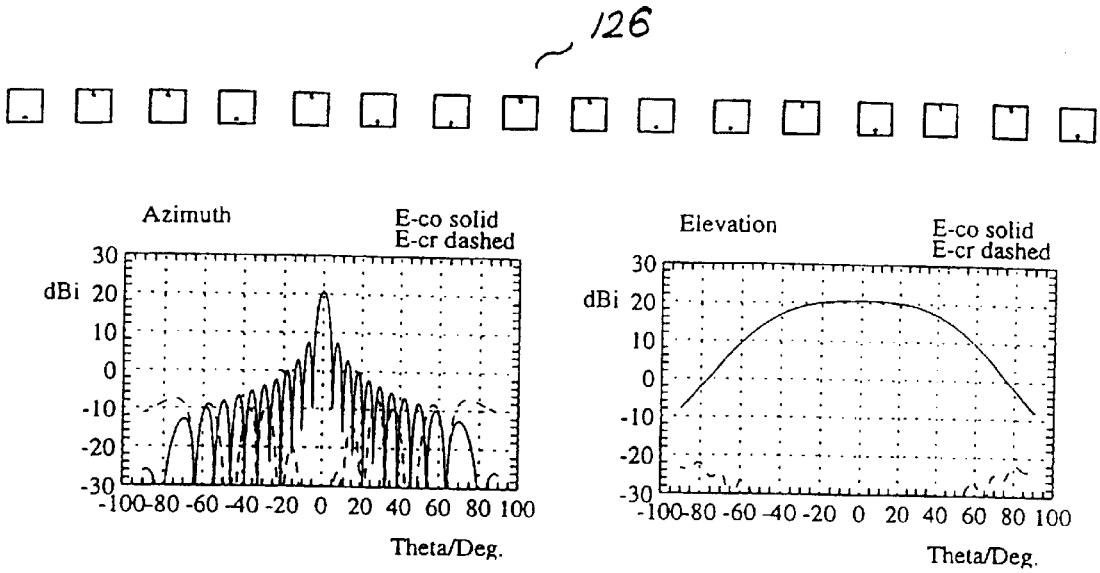
Figure 53:
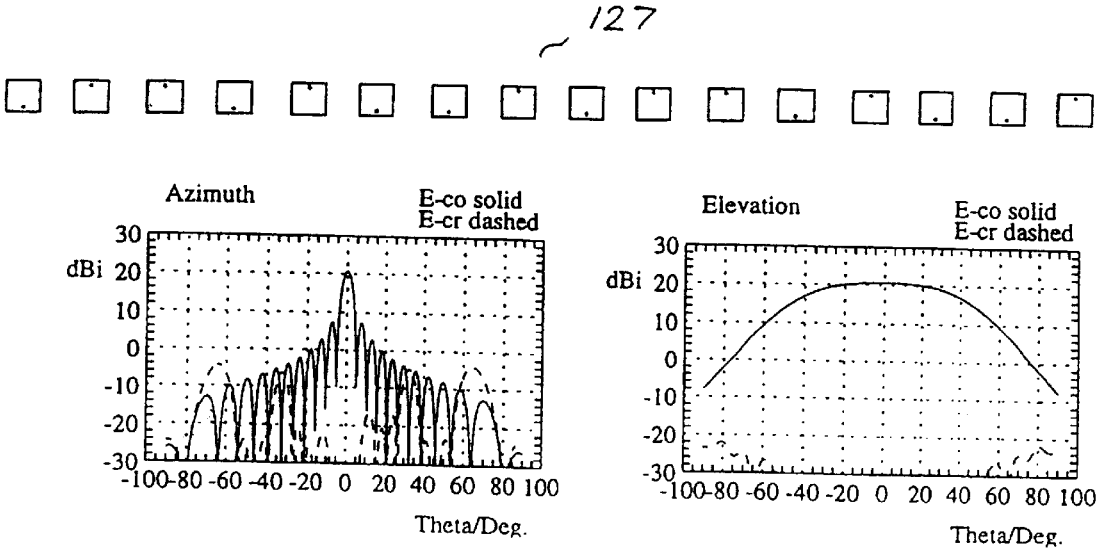
Figure 54:
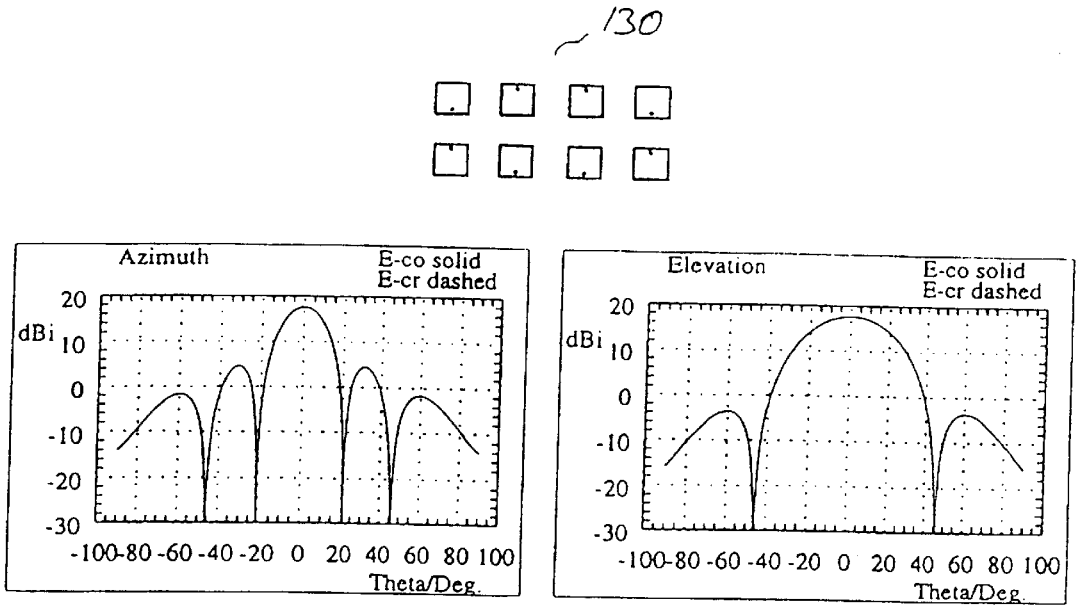
Figure 55:
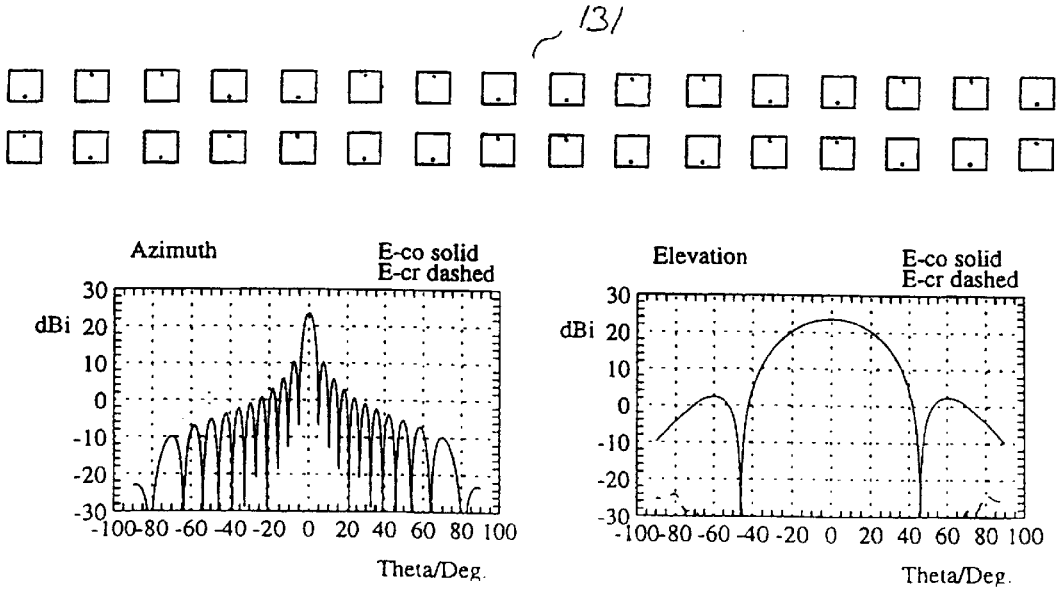
Figure 56:
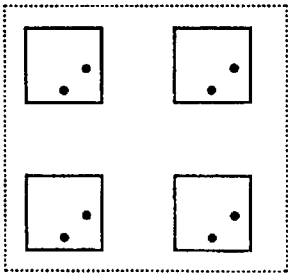
Figure 56:
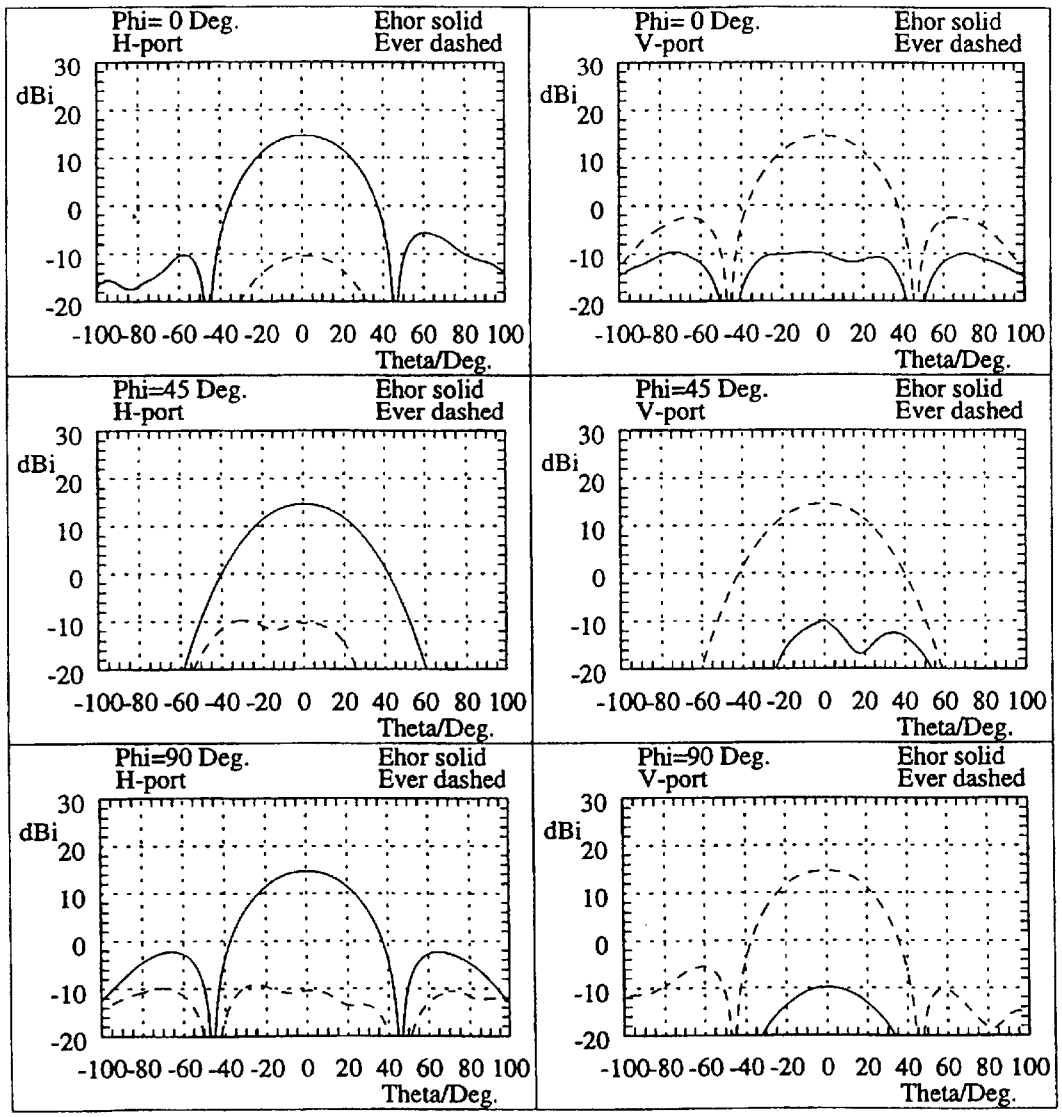
Figure 57:
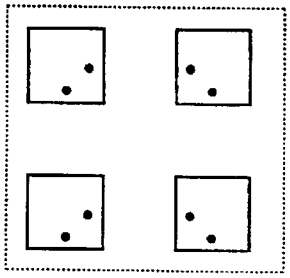
Figure 57:
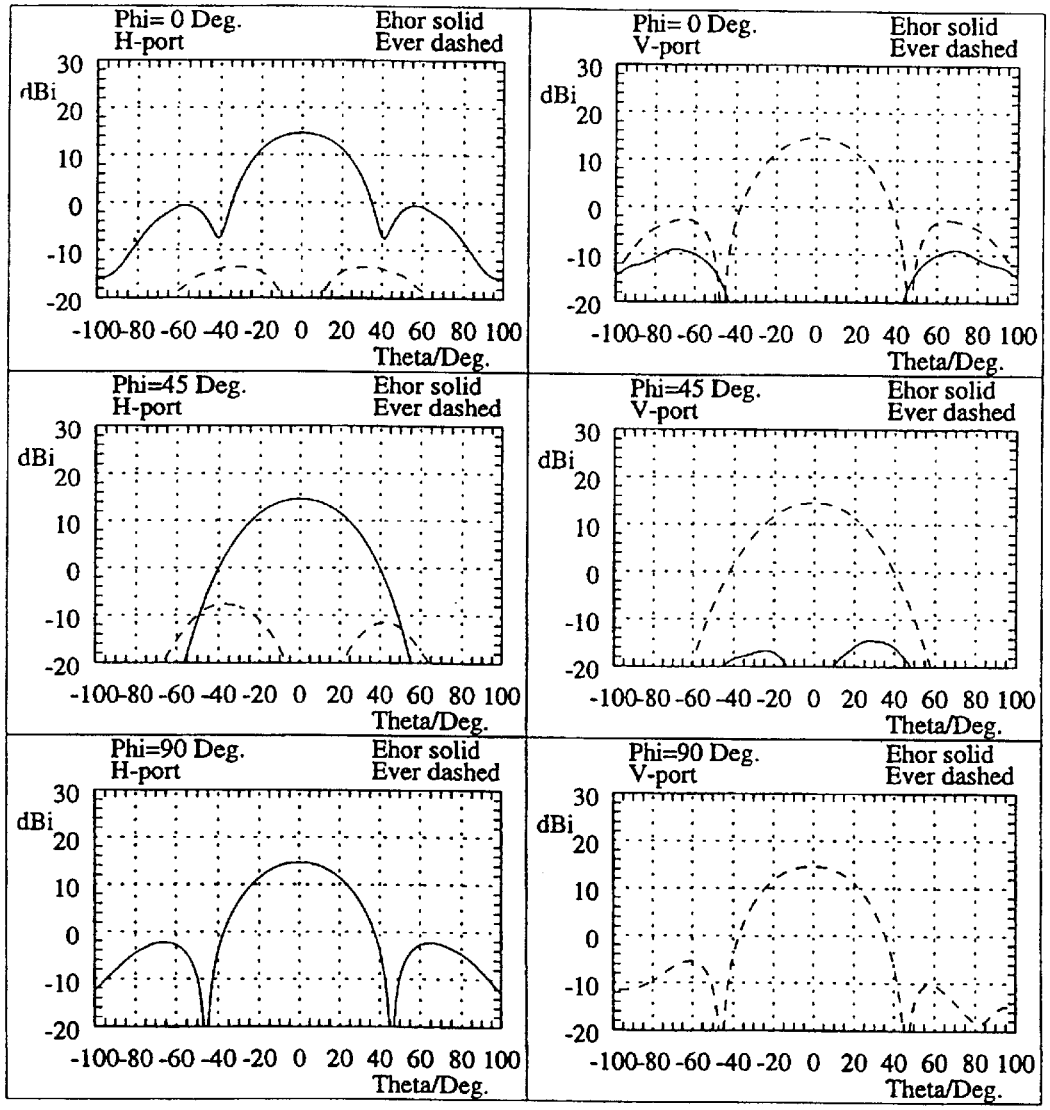
Figure 58:
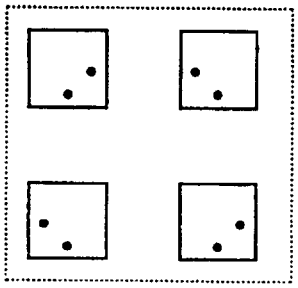
Figure 58:
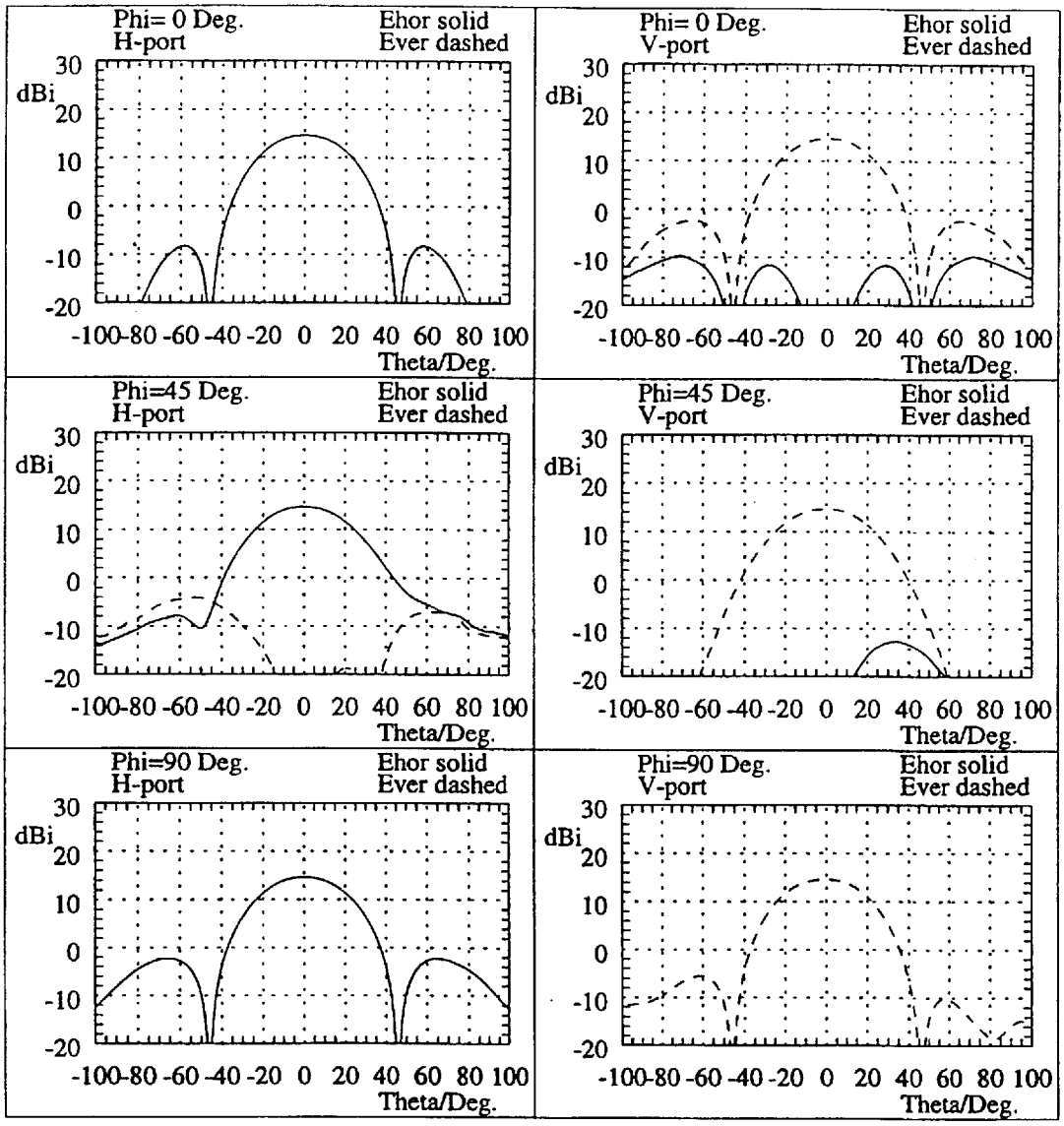
Figure 59:
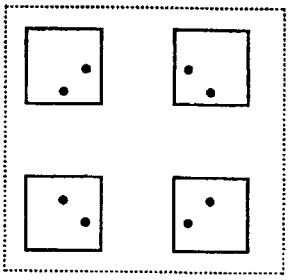
Figure 59:
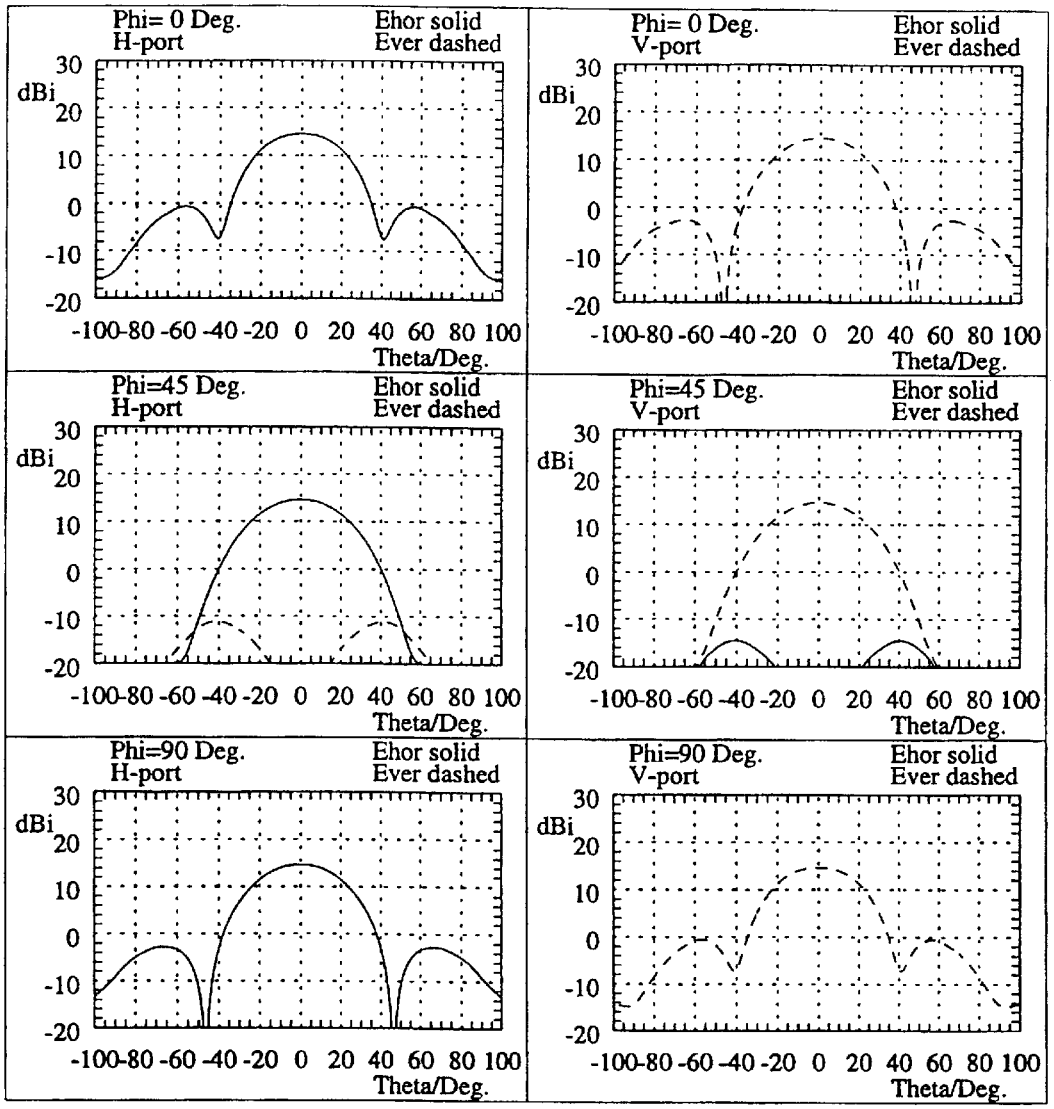
Figure 60:
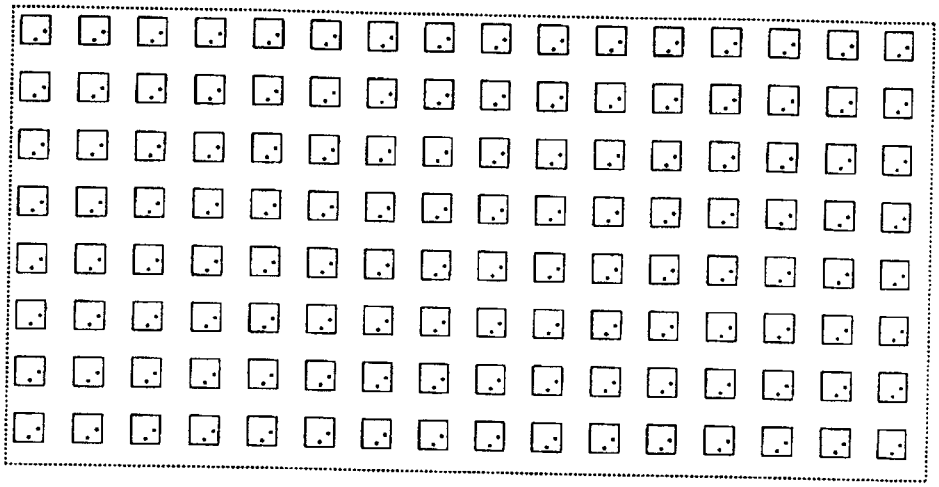
Figure 60:
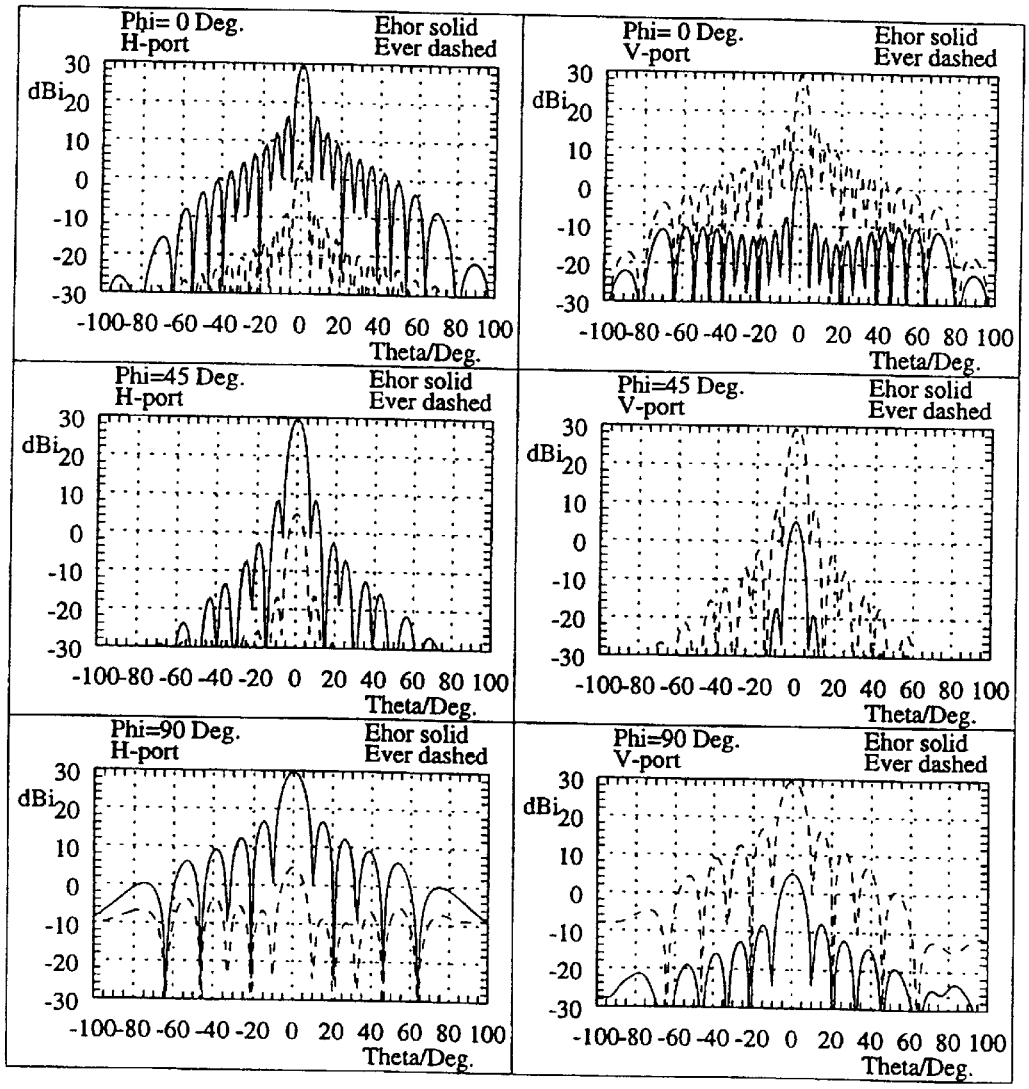
Figure 61:
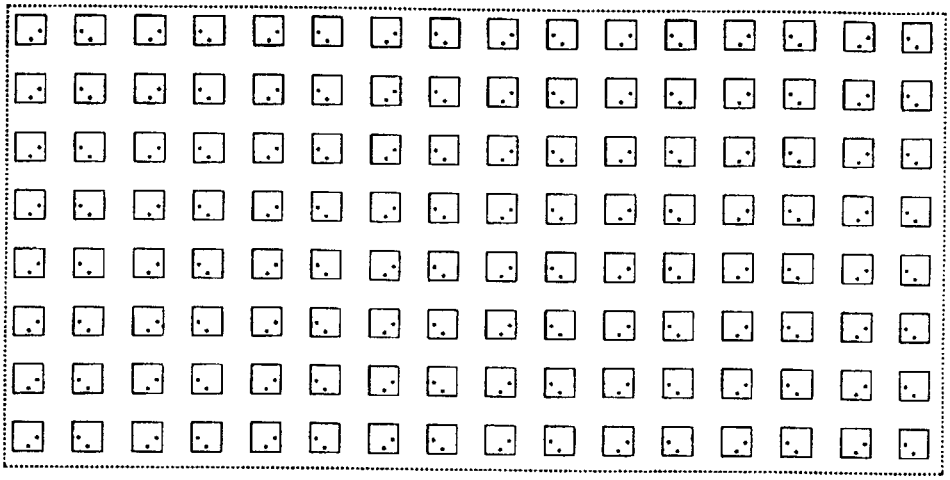
Figure 61:
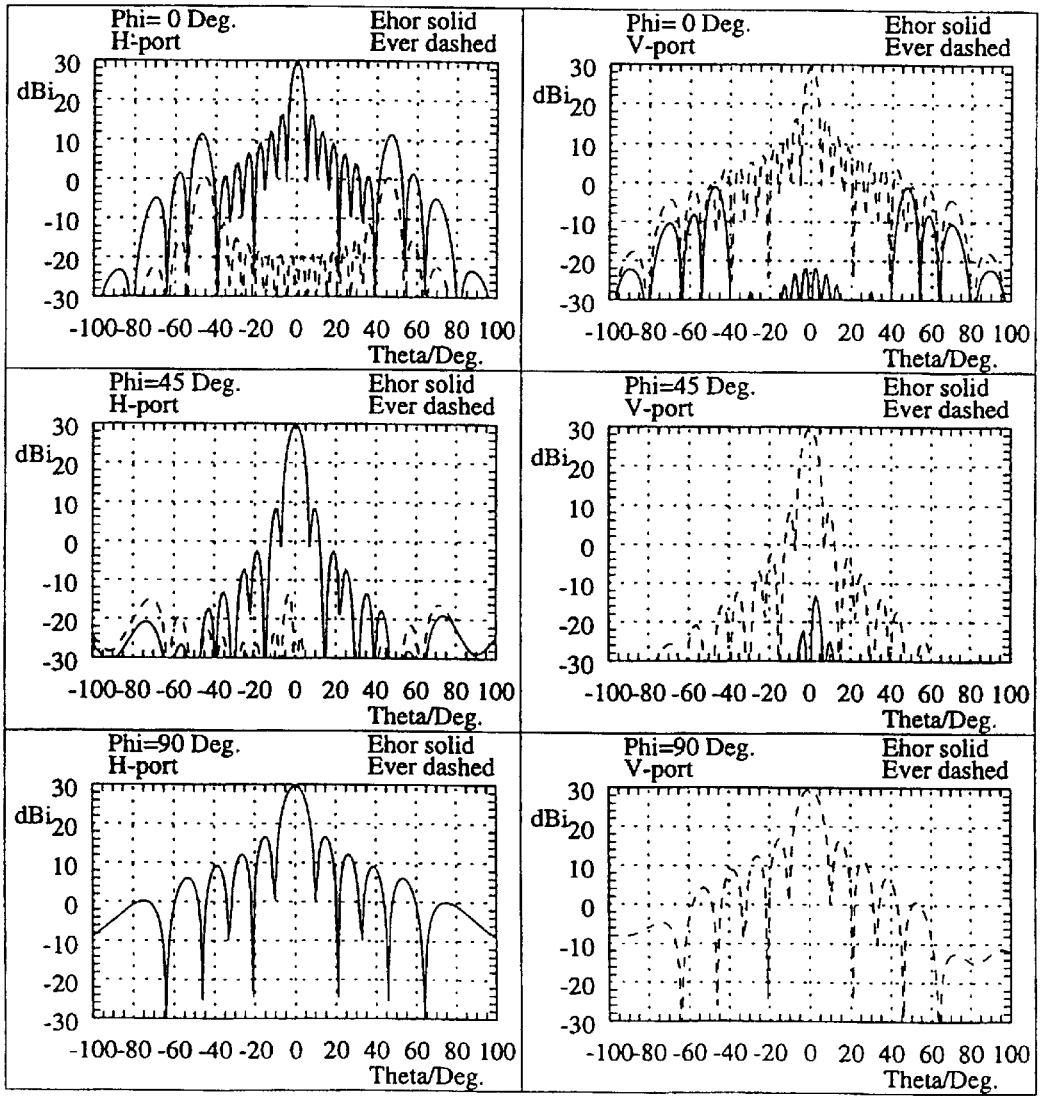
Figure 62:
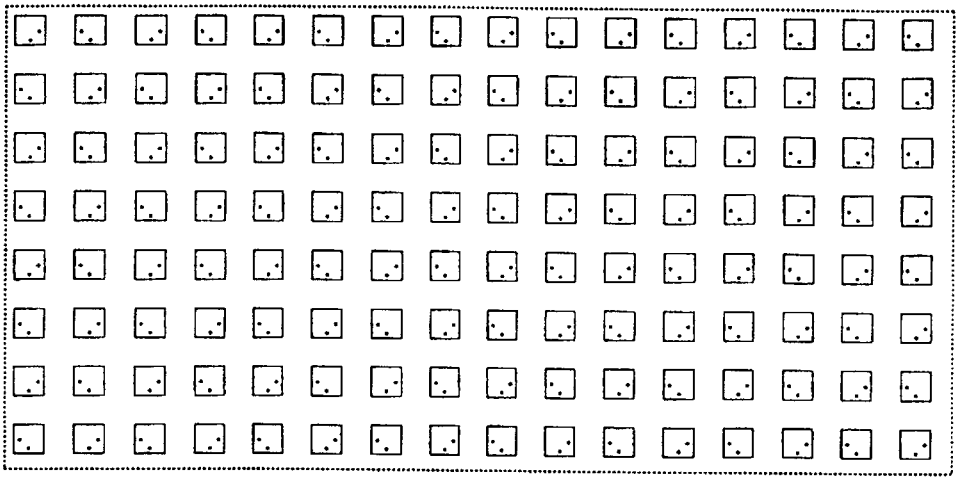
Figure 62:
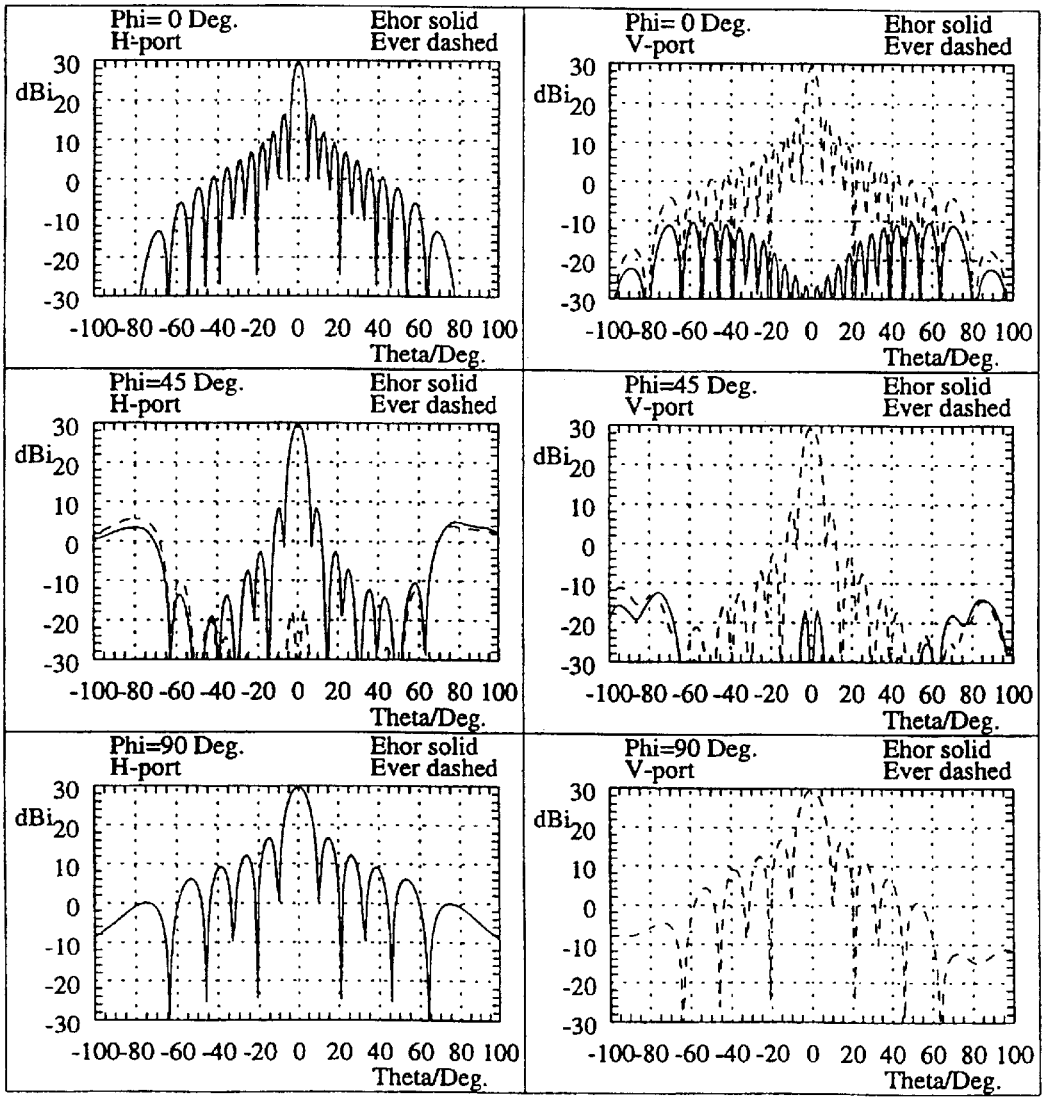
Figure 63:
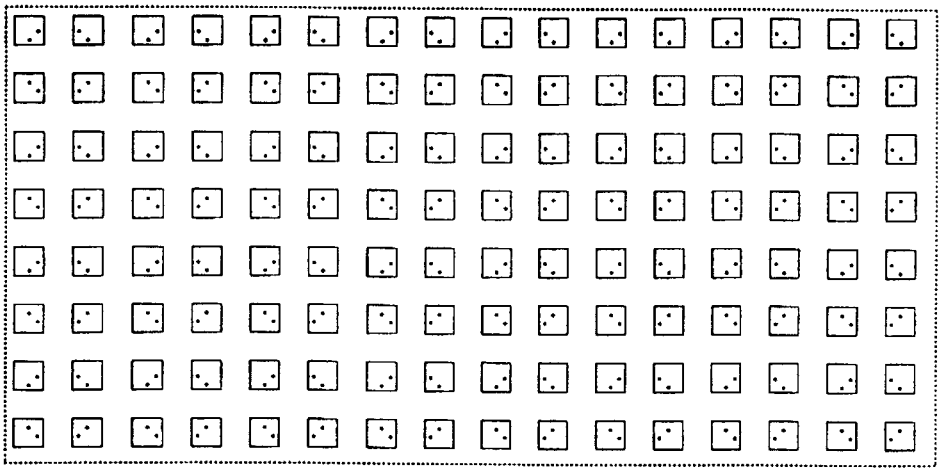
Figure 63:
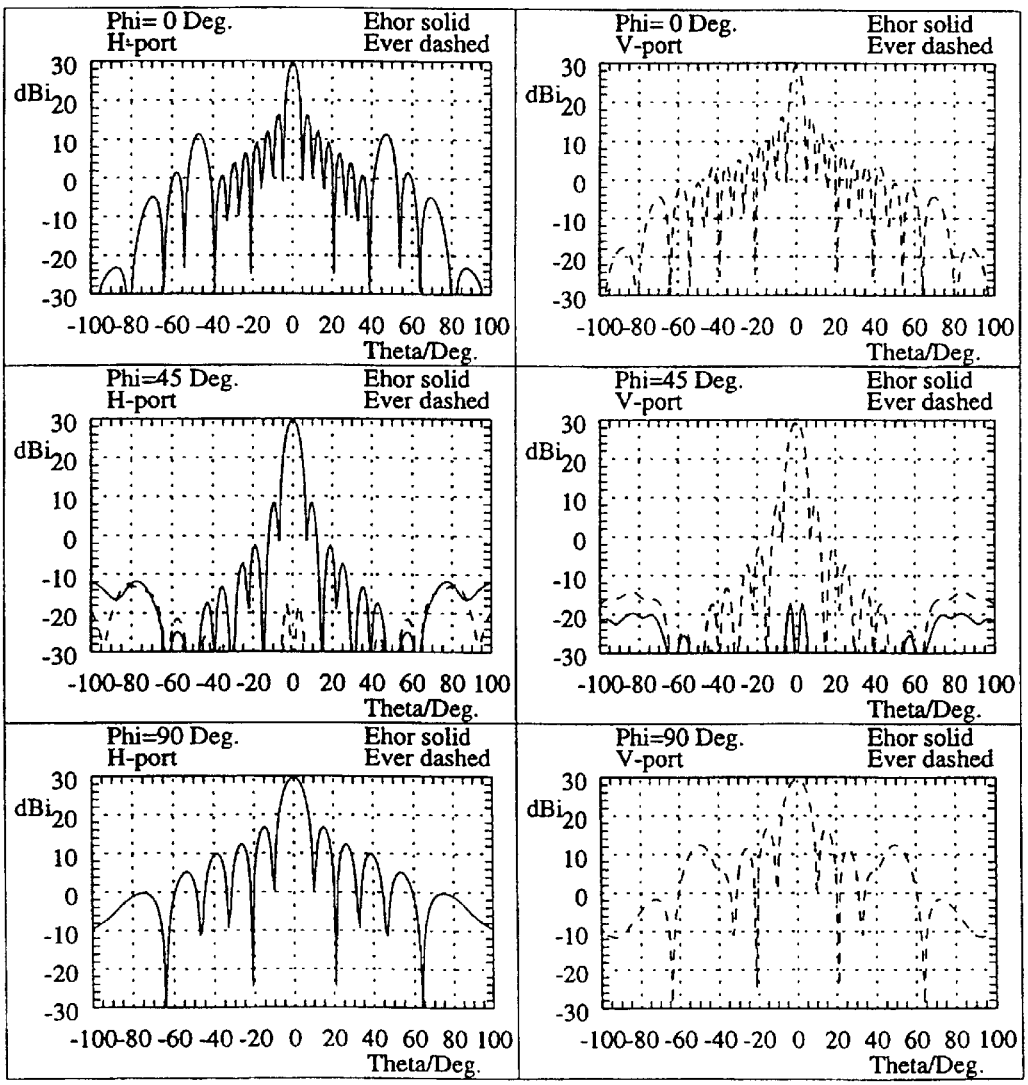
Figure 64:
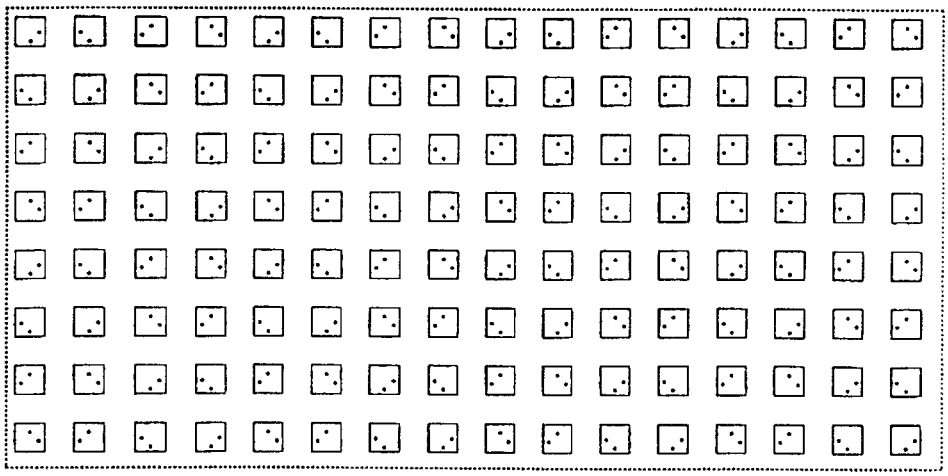
Figure 64:
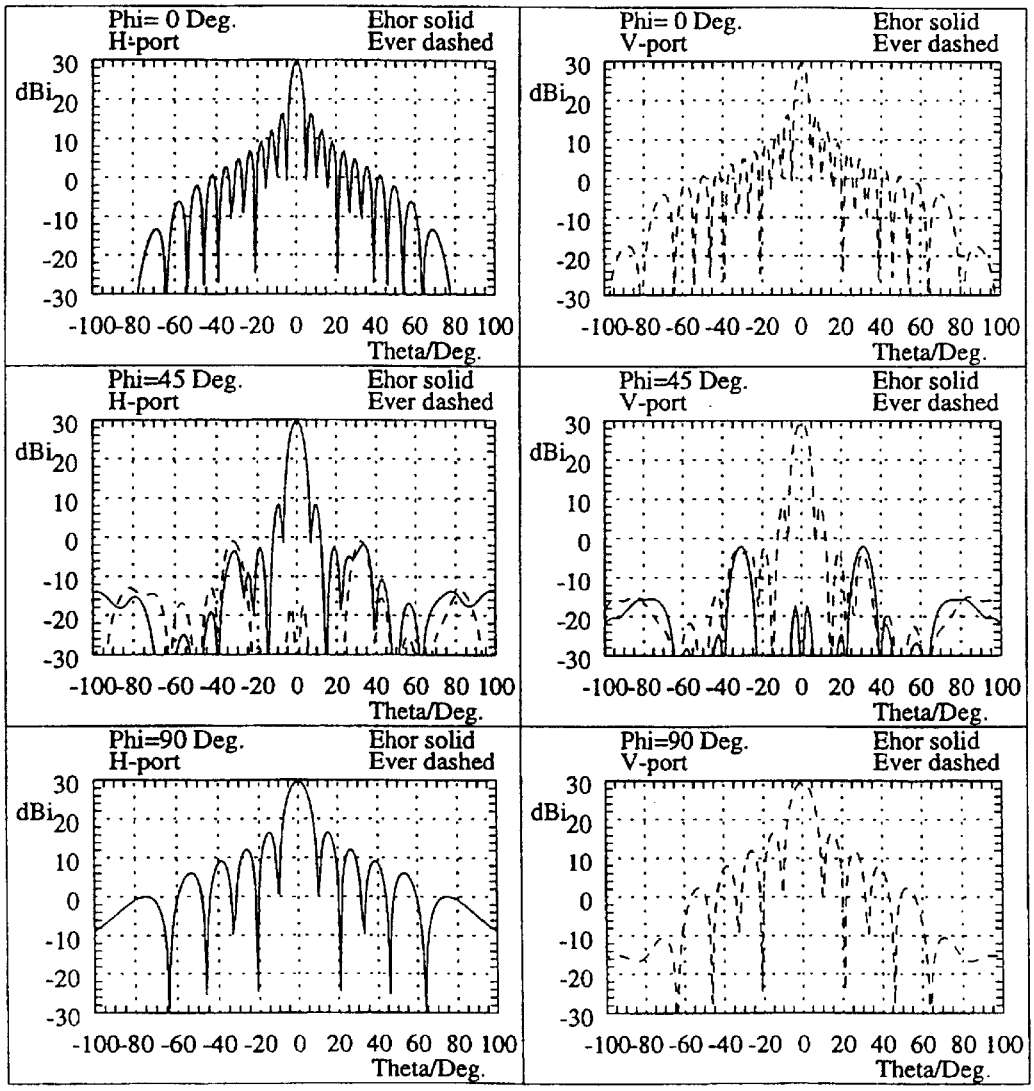
Figure 65:
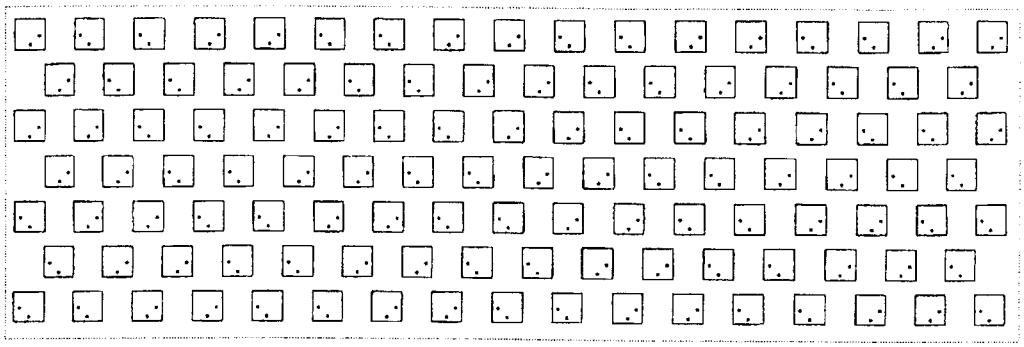
Figure 65:
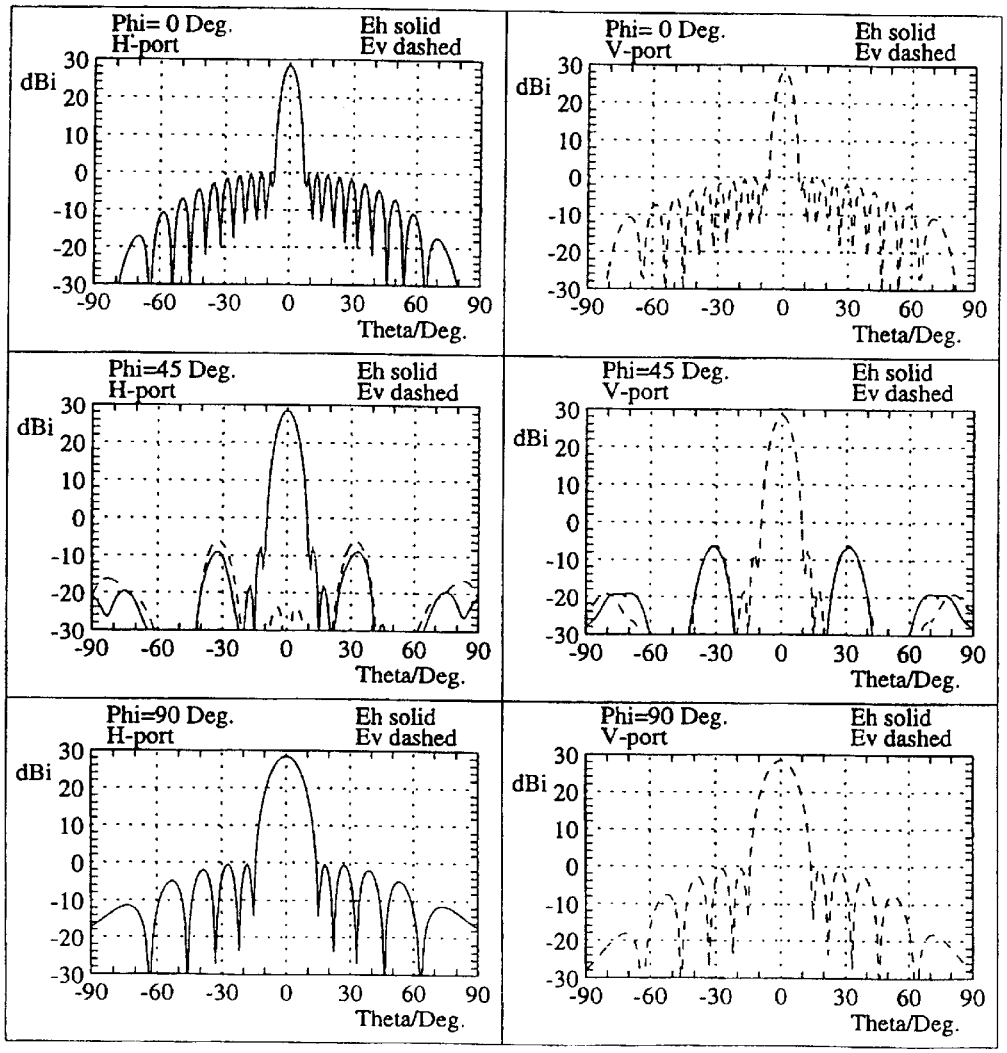
Figure 66:
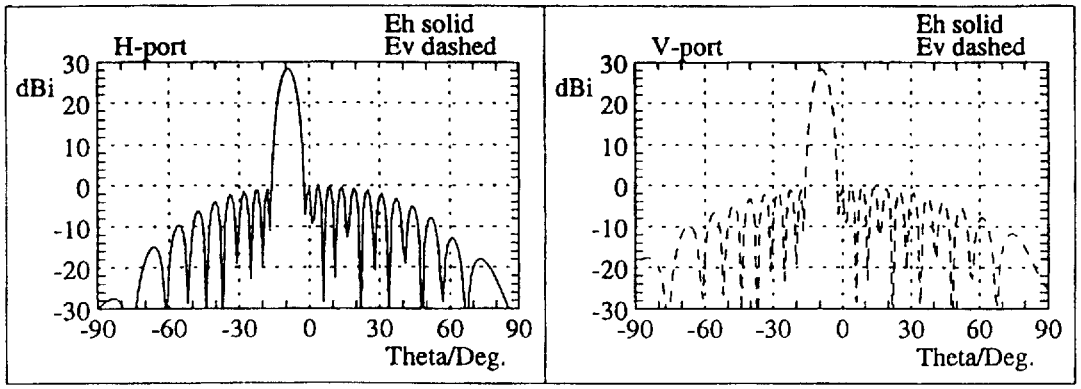
Figure 67:
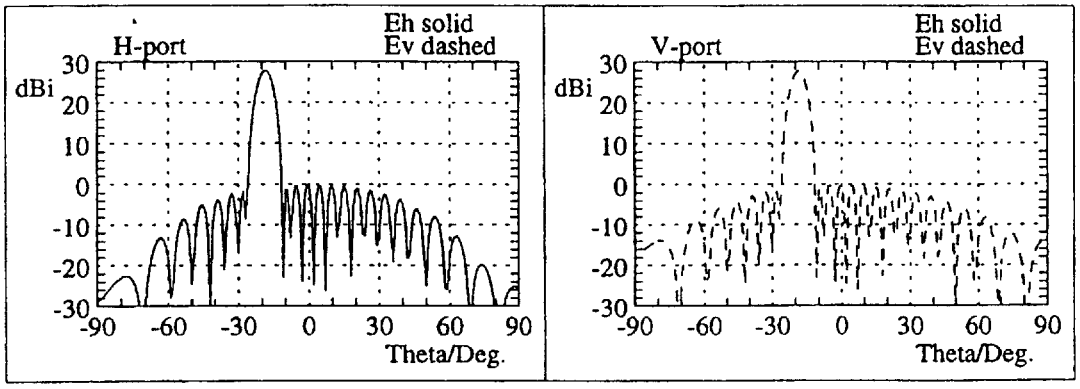
Figure 69:
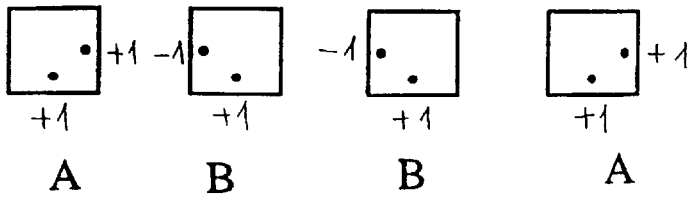
Figure 68:
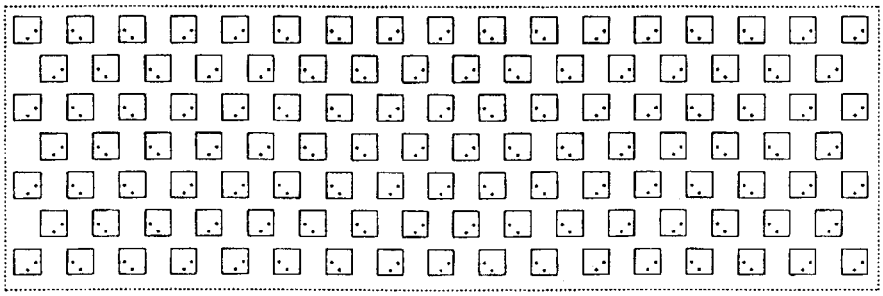
Figure 68:
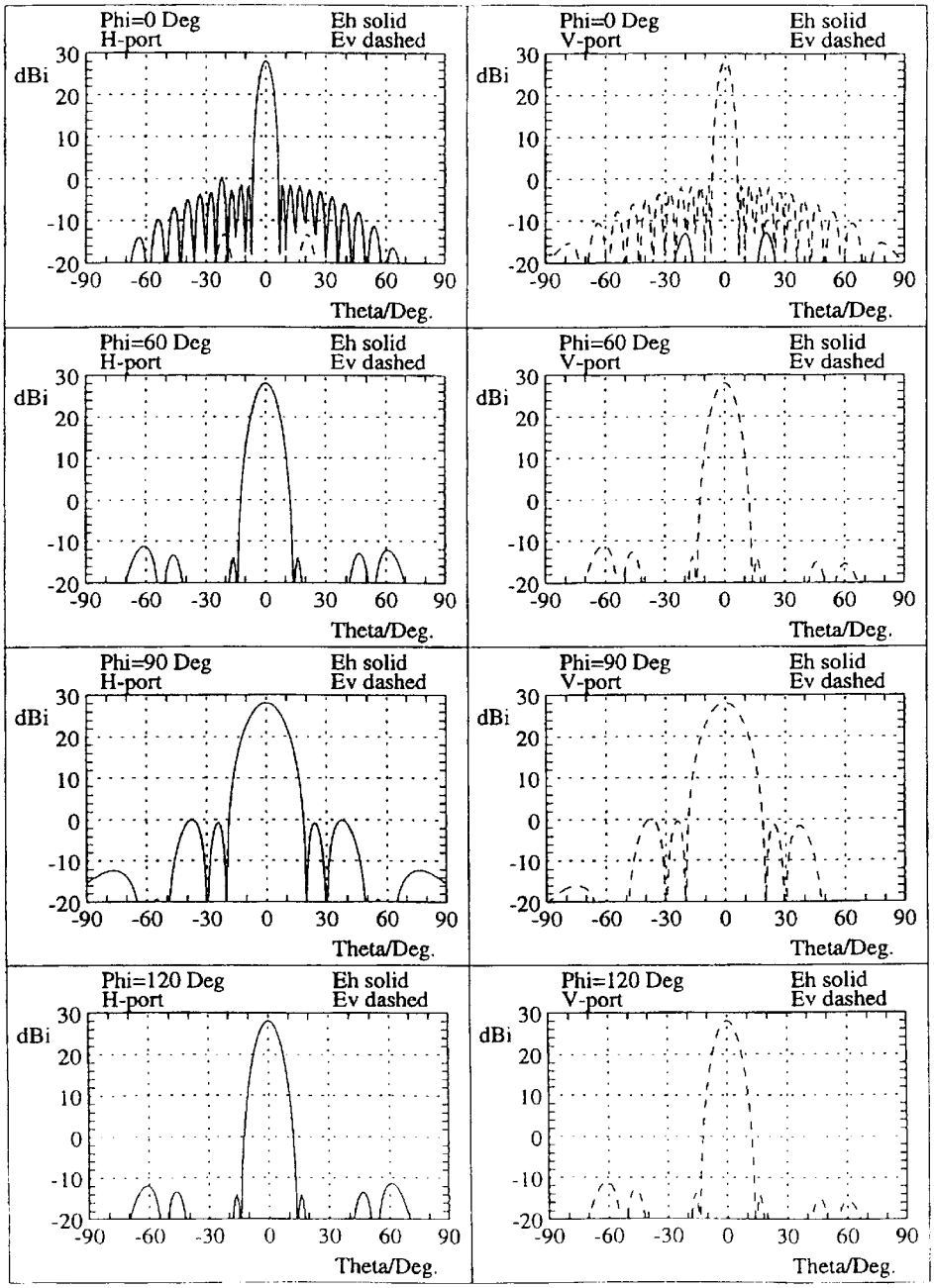
Figure 76:
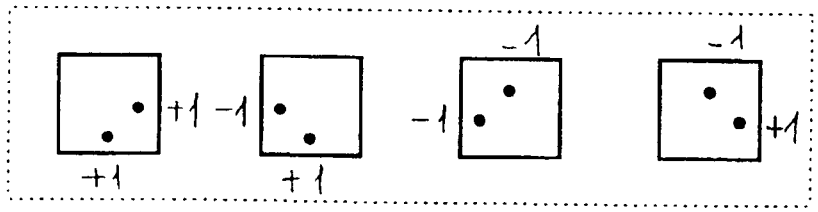
Figure 76:
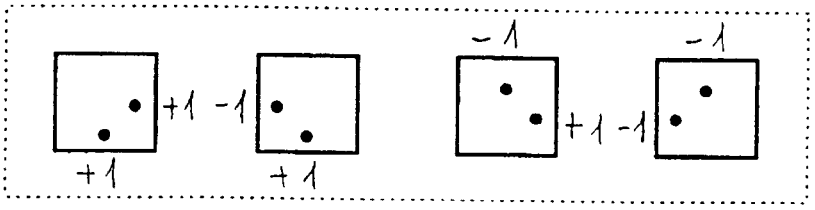
Figure 76:
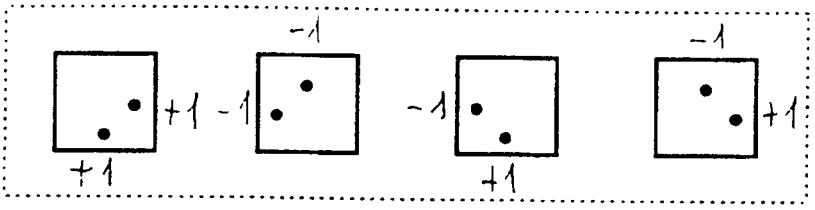
Figure 77:
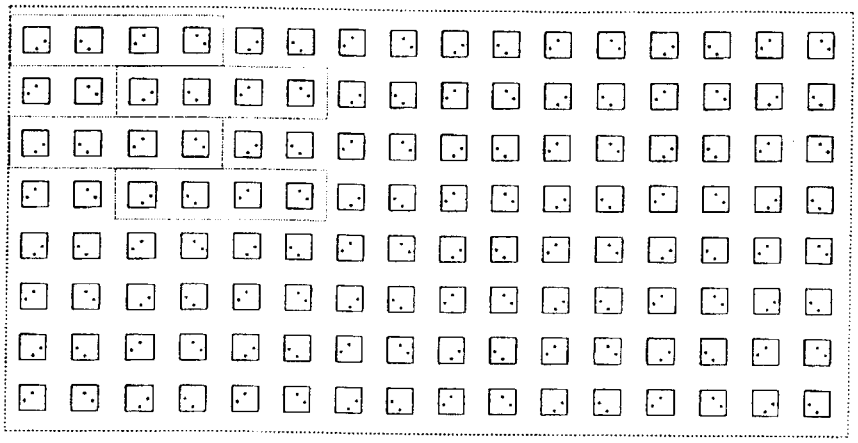
Figure 77:
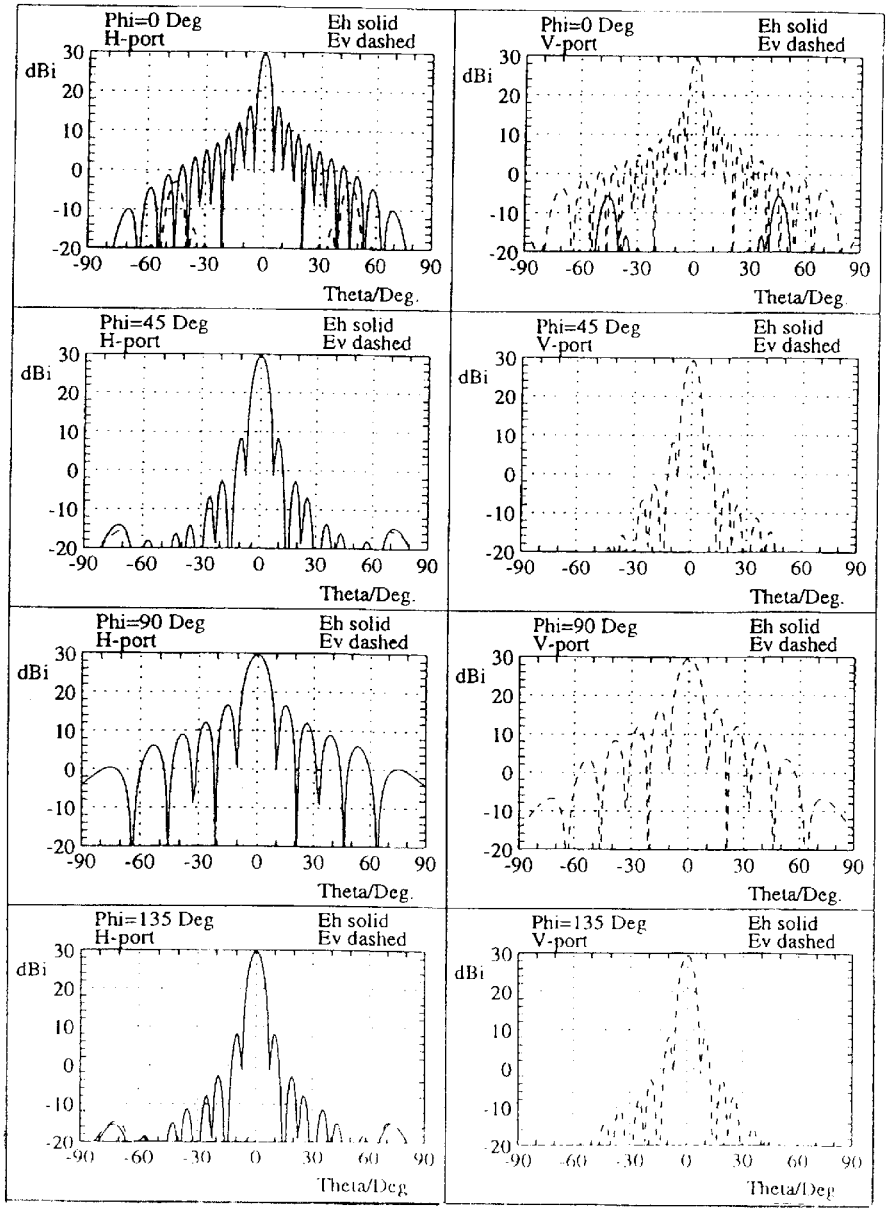
Figure 78:
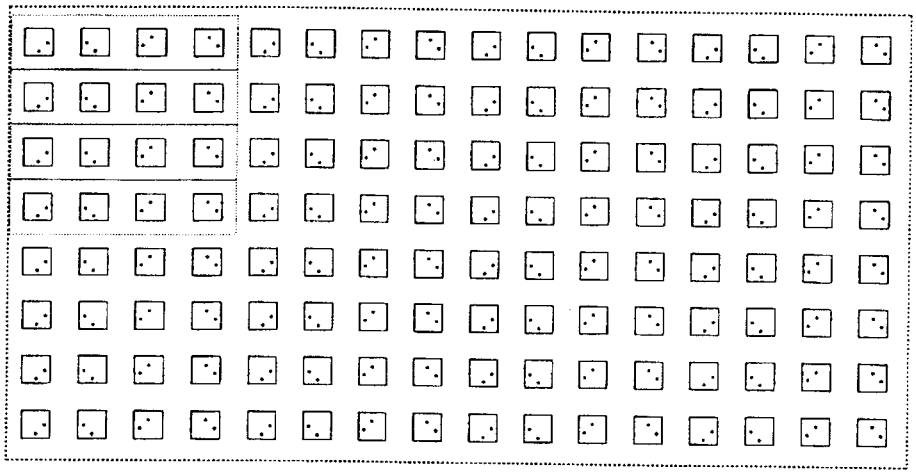
Figure 79:
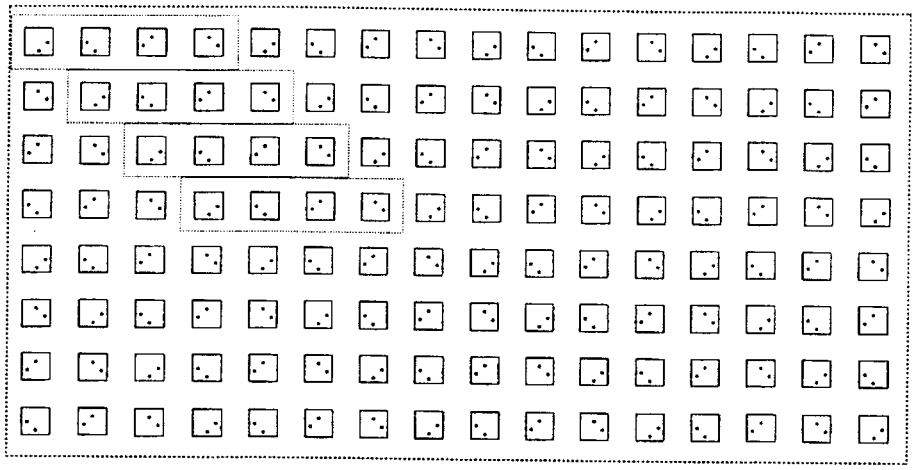
Figure 80:
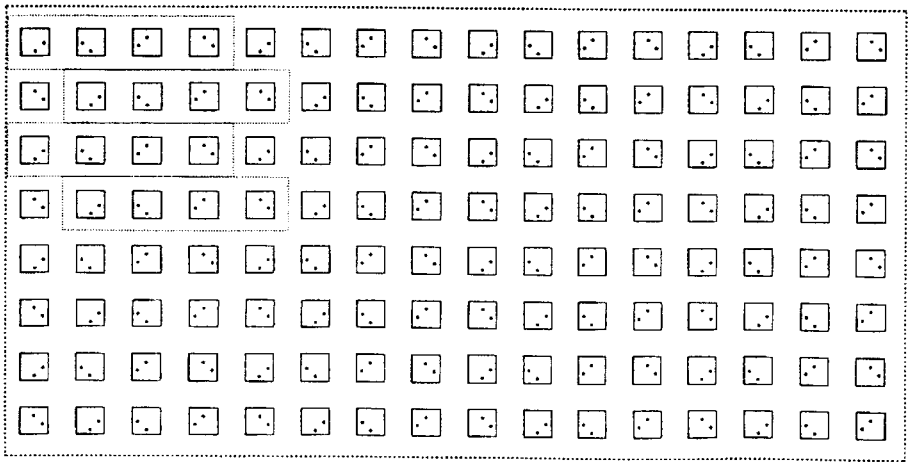

FIG. 6 is a plot of horizontally polarized radiation pattern in the azimuth plane for the two-antenna element group shown in FIG. 5, FIG. 7 is a plot of the group factor in the azimuth plane of a four element group, FIG. 8 is a plot of a panel group factor in the azimuth plane, FIG. 9 is a plot of a 16 element group factor in the azimuth plane, FIG. 10 is a plot of a radiation pattern in the azimuth plane from a 32 element antenna array, FIG. 11 is a top view of a dual polarized patch, FIG. 12 is a top view of a dual polarized patch with two feeding probes per polarization, FIG. 13 is a plot of radiation patterns in the azimuth and elevation planes of a patch shown in FIG. 11, FIG. 14 is a top view of a dual polarized two-antenna element group, FIG. 15 is a plot of radiation patterns in the azimuth and elevation planes for the group shown in FIG. 14, FIG. 16 is a plot of radiation patterns in the azimuth and elevation planes for a 1*32 element antenna array, FIG. 17 is a top view of a dual polarized mirrored two-antenna element group, FIG. 18 is a plot of radiation patterns in the azimuth and elevation planes for the group shown in FIG. 17, FIG. 19 is a plot of radiation patterns in the azimuth and elevation planes for a 1*32 antenna array consisting of groups shown in FIG. 17, FIG. 20*a* shows the element layout and a plot of measured radiation patterns in the azimuth and elevation planes for a 7*32 antenna array, FIG. 20B shows the element layout and a plot of calculated radiation patterns in the azimuth and elevation planes for a 7*32 antenna array according to the invention, FIG. 21 is a top view of a four antenna element group according to the invention, FIG. 22 is a plot of radiation patterns in the azimuth and elevation planes for the group shown in FIG. 21, FIG. 23 is a plot of radiation patterns in the azimuth and elevation planes for the group also shown in the figure, FIG. 24 is a plot of radiation patterns in the azimuth and elevation planes for the group also shown in the figure, FIG. 25 is a plot of radiation patterns in the azimuth and elevation planes for an antenna array consisting of 16 groups shown in FIG. 21, FIG. 26 illustrates alternative configurations of coupling positions of antenna elements arranged in four antenna element groups according to the invention, FIG. 27 shows a microstrip feeding network and patches for an L-band dual polarized 2×2 element stacked patch antenna array, FIG. 28 shows a cross section of one element (stacked patch) of the L-band antenna, FIG. 29 is a plot of measured radiation patterns in the azimuth and elevation planes for the L-band antenna, FIG. 30 shows the layout and a plot of calculated radiation patterns in the azimuth and elevation planes for the L-band antenna, FIG. 31 is a plot of radiation patterns in the azimuth and elevation planes for the group also shown in the figure, FIG. 32 is a plot of radiation patterns in the azimuth and elevation planes for the group also shown in the figure, FIG. 33 is a plot of the measured input reflection coefficients at the inputs to the L-band antenna and the transmission between the inputs, FIG. 34 shows a four antenna element group of aperture coupled microstrip antenna elements according to the invention, FIG. 35 shows a four antenna element group of a planar inverted-F antennas according to the invention, FIG. 36 shows the layout and radiation pattern of a horizontally polarized antenna array with four antenna elements, FIG. 37 shows the layout and radiation pattern of a horizontally polarized antenna array with 16 antenna elements, FIG. 38 shows the layout and radiation pattern of a horizontally polarized antenna array with four antenna elements with mirrored feeding points, FIG. 39 shows the layout and radiation pattern of a horizontally polarized antenna array with 16 antenna elements with mirrored feeding points, FIG. 40 shows the layout and radiation pattern of a horizontally polarized four antenna element array according to the invention, FIG. 41 shows the layout and radiation pattern of a horizontally polarized 16 antenna element array according to the invention, FIG. 42 shows an alternative layout and radiation pattern of a horizontally polarized 16 antenna element array according to the invention, FIG. 43 shows an alternative layout and radiation pattern of a horizontally polarized 16 antenna element array according to the invention, FIG. 44 shows the layout and radiation pattern of a horizontally polarized array according to the invention consisting of 2*4 antenna elements, FIG. 45 shows the layout and radiation pattern of a horizontally polarized array according to the invention consisting of 2*16 antenna elements, FIG. 46 shows the layout and radiation pattern of a vertically polarized antenna array with four antenna elements, FIG. 47 shows the layout and radiation pattern of a vertically polarized antenna array with 16 antenna elements, FIG. 48 shows the layout and radiation pattern of a vertically polarized antenna array with four antenna elements with mirrored feeding points, FIG. 49 shows the layout and radiation pattern of a vertically polarized antenna array with 16 antenna elements with mirrored feeding points, FIG. 50 shows the layout and radiation pattern of a vertically polarized four antenna element array according to the invention, FIG. 51 shows the layout and radiation pattern of a vertically polarized 16 antenna element array according to the invention, FIG. 52 shows an alternative layout and radiation pattern of a vertically polarized 16 antenna element array according to the invention, FIG. 53 shows an alternative layout and radiation pattern of a vertically polarized 16 antenna element array according to the invention, FIG. 54 shows the layout and radiation pattern of a vertically polarized array according to the invention consisting of 2*4 antenna elements, and FIG. 55 shows the layout and radiation pattern of a vertically polarized array according to the invention consisting of 2*16 antenna elements, FIG. 56 shows the layout and radiation pattern of a dual-polarized 2×2 element antenna array, FIG. 57 shows the layout and radiation pattern of a dual-polarized 2×2 element antenna array, FIG. 58 shows the layout and radiation pattern of a dual-polarized 2×2 element antenna array according to the invention, FIG. 59 shows the layout and radiation pattern of a dual-polarized 2×2 element antenna array, FIG. 60 shows the layout and radiation pattern of a dual-polarized 8×16 element antenna array, FIG. 61 shows the layout and radiation pattern of a dual-polarized 8×16 element antenna array, FIG. 62 shows the layout and radiation pattern of a dual-polarized 8×16 element antenna array according to the invention, FIG. 63 shows the layout and radiation pattern of a dual-polarized 8×16 element antenna array, FIG. 64 shows the layout and radiation pattern of a dual-polarized 8×16 element antenna array according to the invention, FIG. 65 shows the layout and radiation pattern of a dual-polarized 8×16 element antenna array according to the invention, FIG. 66 shows the calculated radiation pattern of a dual-polarized 8×16 element antenna array according to the invention, FIG. 67 shows the calculated radiation pattern of a dual-polarized 8×16 element antenna array according to the invention, FIG. 68 shows a triangular grid configuration and the corresponding calculated radiation pattern of an antenna array according to the invention, FIG. 69 shows a four-element linear group according to the invention, FIGS. 70–75 show various triangular grid embodiments of the invention, FIG. 76 shows three different four-element linear groups according to the invention, FIG. 77 shows an antenna array comprising one of the four-element groups shown in FIG. 76 and the corresponding radiation pattern, and FIGS. 78–80 show various alternative lay-outs of antenna arrays comprising the same four-element group as the array shown in FIG. 77.

It is well-known that the radiation pattern of arrays of identical (of type and orientation) antenna elements is equal to the antenna element radiation pattern times the group factor. This formulae will be used in the following to calculate the radiation patterns of large antenna arrays from radiation patterns of smaller groups of radiating antenna elements.

The spacing between the centre of the individual radiating antenna elements is designated $d_x$. $d_x$ is typically app. 0.7 times the free-space wavelength. In the examples below $d_x$ is equal to 0.7 times the free-space wavelength.

The radiation pattern of an array of antenna elements can be found from:

$$\overline{E_{array}}(\theta, \varphi) = \sum_i G_i(\theta, \varphi)\overline{E_i}(\theta, \varphi) \tag{1}$$

$$G_i(\theta, \varphi) = A_i e^{jB_i(\theta,\varphi)}$$

$$B_i(\theta, \varphi) = k_0 \sin\theta(x_i \cos\varphi + y_i \sin\varphi)$$

$A_i$ is the complex excitation of the i'th antenna element,
$(x_i, y_i)$ is the position of the i'th antenna element,
$k_0$ is equal to $$\frac{2\pi}{\lambda_0},$$

$\lambda_0$ is the free space wavelength,
$\overline{E_i}(\theta\phi)$ is the antenna element radiation pattern of the i'th antenna element, and
$G_i(\theta\phi)$ is the antenna element group factor for the i'th antenna element.

Note, that if all antenna elements are identical:

$$\overline{E_{array}}(\theta, \varphi) = G(\theta, \varphi)\overline{E_{antenna}}(\theta, \varphi) \tag{2}$$

$$G(\theta, \varphi) = \sum_i G_i(\theta, \varphi)$$

$G(\theta\phi)$ is denoted the array group factor.

Figure 1:
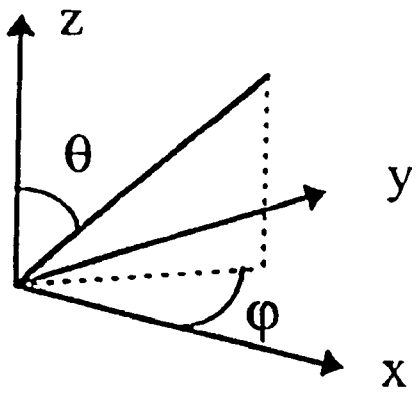
FIG. 1 illustrates the definition of $\theta$ and $\phi$.
Figure 2:
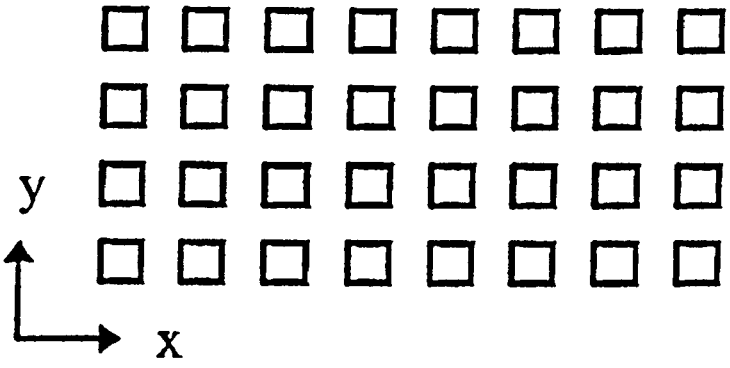
FIG. 2 shows a layout of an antenna array.

The co-ordinate system is shown in FIG. 1.

The antenna element is typically located (substantially) in the x-y plane. The direction perpendicular to the x-y plane is denoted boresight. Typically, the main lobe of the antenna element includes the boresight direction. The x-z plane is designated the azimuth plane in which $\phi=0$ and $\theta$ ranges from $-\pi$ to $\pi$. The y-z plane is designated the elevation plane in which $\phi=\pi/2$ and $\theta$ ranges from $-\pi$ to $\pi$.

In typical antenna arrays a number of similar antenna elements are located in a rectangular grid as shown in FIG.

2. For an increasing number of antenna elements positioned along a specific direction (e.g. azimuth), the radiation pattern, i.e. the main lobe, in that direction gets narrower.

The electrical field of the electromagnetic radiation radiated by an antenna element can be expressed as:

$$\overline{E}(\theta, \varphi) = \begin{Bmatrix} E_h(\theta, \varphi) \\ E_v(\theta, \varphi) \end{Bmatrix} \tag{3}$$

$E_h$ and $E_v$ are the horizontally and vertically polarized components of the electric field. $E_h$ and $E_v$ can be defined in various ways depending on the application, e.g. refer to Ludwig, A. C., "The Definition of Cross Polarization", IEEE Trans. Antennas and Propagation, Vol. AP-21, January 1973, pp. 116–119 which is hereby incorporated by reference. For planar arrays for synthetic aperture radar systems, "Ludwig 3" is appropriate whereas when antennas with toroidal radiation patterns as used on satellites are considered, "Ludwig 2" is more suitable. The exact definition of $E_h$ and $E_v$ is not important in the present context. Below, the elevation plane will be used as a plane of symmetry, therefore the requirement for $E_h$ and $E_v$ is that in the elevation plane $E_h$ is perpendicular to the elevation plane, and $E_v$ is parallel to the elevation plane. In the following, a number of antenna patterns for planar antenna arrays will be shown. In these plots, the "Ludwig 3" cross polarization definition is used.

In the theoretical analysis below, dual polarized antenna elements for radiation and/or reception of horizontally ($E_h$) and/or vertically ($E_v$) polarized electromagnetic radiation are considered.

The amplitude and phase of a signal transmitted to an individual antenna element for radiation by the antenna element is denoted the antenna element excitation.

The polarization purity or cross-polarization suppression of an antenna array is defined as the ratio between the magnitude of the radiated electromagnetic radiation of the excited polarization and the magnitude of the electromagnetic radiation of the orthogonal polarization, e.g. $E_h/E_v$ when the desired polarization is the horizontal polarization.

In the following, the H-port denotes the port utilized for excitation of electromagnetic radiation of horizontal polarization, and the V-port denotes the port utilized for excitation of electromagnetic radiation of vertical polarization.

When the antenna element is excited at one port (the H-port), the radiation pattern as given by (3) is dominated by $E_h$, which is the desired or co-polar field component, whereas $E_v$ is the undesired or cross-polar field component.

If the antenna element is excited at the other port (the V-port), the radiation pattern as given by (3) is dominated by $E_v$, which is the desired field component of the radiation, whereas $E_h$ is the undesired or cross-polar field component.

The electrical field of the electromagnetic radiation radiated by one antenna element can be expressed as:

$$\overline{E}(\theta, \varphi) = \begin{Bmatrix} E_h(\theta, \varphi) \equiv E_h^e(\theta, \varphi) + E_h^o(\theta, \varphi) \\ E_h(\theta, \varphi) \equiv E_h^e(\theta, \varphi) + E_h^o(\theta, \varphi) \end{Bmatrix} \tag{4}$$

The electrical fields are separated into their even and odd symmetry components with respect to a vertical symmetry plane:

$$E_h^e(\theta,\phi)=E_h^e(\theta,\pi-\phi),\ E_h^o(\theta,\phi)=-E_h^o(\theta,\pi-\phi)$$

$$E_v^e(\theta,\phi)=E_v^e(\theta,\pi-\phi),\ E_v^o(\theta,\phi)=-E_v^o(\theta,\pi-\phi) \tag{5}$$

Note that in the elevation plane (the symmetry plane):

$$\overline{E}(\theta, \pi/2) = \begin{Bmatrix} E_h(\theta, \pi/2) = E_h^e(\theta, \pi/2) \\ E_v(\theta, \pi/2) = E_v^e(\theta, \pi/2) \end{Bmatrix} \tag{6}$$

Below, examples of radiation patterns of single and dual polarized antenna arrays consisting of probe-fed patches are disclosed.

Figure 3:
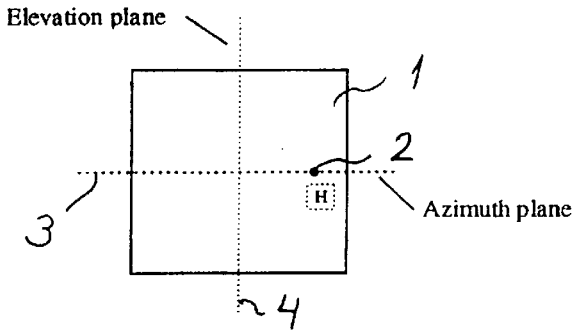
FIG. 3 is a top view of a probe-fed patch.

FIG. 3 shows a single polarized probe-fed microstrip patch antenna element 1.

The feeding point 2, i.e. the position of the probe, is indicated as a small dot. The probe connects the radiating patch antenna element to the feeding network. Two principal radiation planes 3, 4 are indicated on FIG. 3 and will be referred to in the following as the azimuth plane 3 and the elevation plane 4, respectively. The patch 1 is said to be horizontally polarized, as the patch 1 will radiate horizontally polarized electromagnetic waves in the azimuth plane.

Figure 4:
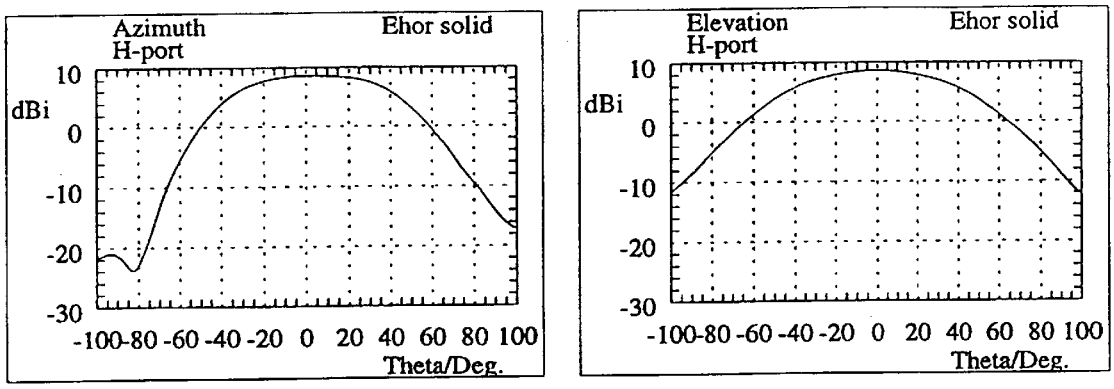
FIG. 4 is plots of horizontally polarized radiation patterns.

FIG. 4 shows the antenna element radiation pattern of a single probe-fed patch antenna element 1 as shown in FIG. 3 in the azimuth plane 3 and the elevation plane 4.

The antenna element radiation pattern is asymmetrical in the azimuth plane due to the asymmetrical location of the feeding probe 2. The vertically polarized (cross-polar) electrical field component (Ever) is not shown in FIG. 4.

Typically, a large antenna array consists of a plurality of identical antenna elements of identical orientation in the array. For reasons which will become obvious later, the array is divided into a plurality of groups, each of which consists of two antenna elements. A two-antenna element group 5 of probe-fed square patch antenna elements 6, 7 is shown in FIG. 5.

FIG. 6 shows the azimuth radiation pattern from the two-antenna element group 5. The feeding of signals to the patches are identical, i.e. the probes of the patches 6, 7 are positioned at identical positions 8, 9 in relation to the respective patch to the right of the respective centres of the patches and two identical electrical signals, i.e. the amplitudes and the phases of the signals are identical, are fed to the patches. This is indicated with +1 in FIG. 5.

FIG. 7 shows a first group of four elements as shown in FIG. 5 and the corresponding group-factor in the azimuth plane with an element spacing equal to 2 times $d_x$. Feeding of signals to the four elements in the group are identical. In the following, the group-factor for this group is designated the sub-array group factor.

FIG. 8 shows the group-factor 10 in the azimuth plane for a second four element group with an element spacing equal to $4\times2\times d_x$. The feeding of signals to all elements in the group are identical. In the following, this group-factor 10 is designated the panel group factor.

The sub-array and panel group factors can be multiplied into the 16 antenna element group factor 11 shown in FIG. 9. This is the group factor for 16 identical elements spaced $2\times d_x$ equal to 1.4 free space wavelengths.

FIG. 10 shows the radiation pattern 12 for an antenna array made up of 32 identical probe-fed square patches 1.

The array radiation pattern 12 shown in FIG. 10, can be found by multiplying the radiation pattern of the two-antenna element group 5 in FIG. 5 with the 16 antenna element group factor 11 of FIG. 9.

It should be noted, that the radiation pattern from the two-antenna element group 5 has a null at a θ-value of app. 46 degrees. Contrary to this, the 16 antenna element group-factor 11 shown in FIG. 9 has a maximum at the same θ-value. Thus, the null at a θ-value of app. 46 degrees in the array radiation pattern 12 shown in FIG. 10 is caused by the null of the radiation pattern of the two-antenna element group 5. For the remaining part of this description, this is a very important observation.

In FIG. 11 a dual polarized probe-fed square patch is shown. Signals fed to the feeding point 15 excite primarily horizontally polarized electromagnetic waves and signals fed to the feeding point 16 excite primarily vertically polarized electromagnetic waves. Both feeding points are asymmetrically positioned at an axis of symmetry in relation to the patch 14. A dual polarized probe-fed patch 17 with two probes for each polarization is shown in FIG. 12. Antenna arrays comprising such symmetrical patches 17 requires a very complicated feeding network compared to feeding network of antenna arrays comprising patches 14 of the above-mentioned kind and, thus, patches 17 with two probes for each polarization are not practical in most applications for implementations of arrays with more than a few antenna elements.

The radiation pattern 18 of the patch 14 is shown in FIG. 13. The radiation pattern shown is a measured radiation pattern. Below, the radiation pattern 18 will be used for calculations of radiation patterns of antenna arrays comprising a plurality of patches 14.

The radiation pattern 19 is the co-polarized radiation pattern in the azimuth plane of a horizontally polarized electromagnetic radiation resulting from the patch being excited from the probe positioned at position 15 and with no signal on the probe positioned at position 16 and the radiation pattern 20 is the cross-polarized radiation pattern in the azimuth plane of a vertically polarized electromagnetic radiation resulting from the same excitation.

Likewise, the radiation pattern 21 is the co-polarized radiation pattern in the elevation plane of a horizontally polarized electromagnetic radiation resulting from the patch being excited from the probe positioned at position 15 and with no signal on the probe positioned at position 16 and the radiation pattern 22 is the cross-polarized radiation pattern in the elevation plane of a vertically polarized electromagnetic radiation resulting from the same excitation.

The radiation pattern 23 is the co-polarized radiation pattern in the azimuth plane of a vertically polarized electromagnetic radiation resulting from the patch being excited from the probe positioned at position 16 and with no signal on the probe positioned at position 15 and the radiation pattern 24 is the cross-polarized radiation pattern in the azimuth plane of a horizontally polarized electromagnetic radiation resulting from the same excitation.

The radiation pattern 25 is the co-polarized radiation pattern in the elevation plane of a vertically polarized electromagnetic radiation resulting from the patch being excited from the probe positioned at position 16 and with no signal on the probe positioned at position 15 and the radiation pattern 26 is the cross-polarized radiation pattern in the elevation plane of a horizontally polarized electromagnetic radiation resulting from the same excitation.

In the remaining figures showing plots of radiation patterns, the same signatures and designations of the plotted curves are used as in FIG. 13.

The steps of calculating radiation patterns of various antenna arrays described previously will now be repeated for two polarizations in order to calculate radiation patterns of various dual polarized antenna arrays consisting of a plurality of dual polarized patches 14.

A dual polarized antenna element group 27 consisting of two antenna elements is shown in FIG. 14 and the radiation pattern 28 of the two-antenna element group is shown in FIG. 15. The plotted curves correspond to the curves plotted in FIG. 13.

The radiation pattern for a dual polarized antenna array consisting of 1×32 identical probe-fed square patches 14 as shown in FIG. 16 may, as previously described, be calculated by multiplying the two-antenna element radiation pattern 28 shown in FIG. 15 with the 16 antenna element group factor 11 shown in FIG. 9. The resulting radiation pattern 29 is shown in FIG. 16.

It should be noted that the shapes of the plotted two co-polarized radiation patterns are very similar (although of course orthogonal) and both are similar to the radiation pattern 12 shown in FIG. 10.

The magnitude of the cross-polarized radiation relative to the corresponding co-polarized radiation for both polarizations is the same as for the single dual polarized patch 14, i.e. the cross-polarized curves lie approx. −25 dB below the co-polarized curves.

The cross-polarized radiation may be suppressed further by changing the positions and excitations of the probes in a group 30 of two dual polarized patches as shown in FIG. 17.

The two antenna elements 31, 32 are fed with identical signals at their vertical feeding points 35, 36 (indicated by a +1 at both feeding points) and the vertical feeding points 35, 36 have identical positions in relation to the corresponding patches 31, 32. The horizontal feeding points 33, 34 are positioned at mirrored positions in relation to the corresponding vertical axis of symmetry of the patches and signals of identical amplitudes but opposite phases are fed to the patches at their horizontal feeding points 33, 34 (indicated by +1 and −1 at the feeding points 33, 34). The antenna element spacing is $d_x$.

Below, subscripts H and V are used for electrical fields generated by excitation of the H- and V-port, respectively.

When the patch is excited at the H-port (using the H-probe), $E_{Hh}$ is the desired field component. It will be dominated by $E_{Hh}^e$. Due to the asymmetric location of the feed probe with respect to the plane of symmetry, $E_{Hh}^o$ is also significant. The undesired or cross-polar field component $E_v$ is partly generated by the H-probe and partly generated by the V-probe as a result of coupling between the H- and V-ports. $E_{Hv}^e$ forms the major part of $E_v$ generated when the patch is excited at the H-port.

The same applies to corresponding field components when the patch is excited at the V-port (using the V-probe).

The radiation pattern of an antenna array consisting of identical antenna elements is equal to the radiation pattern of an individual antenna element multiplied by the array group factor as given by (2). It is obvious that for an array consisting of antenna elements with identical radiation patterns of identical orientations, the ratio between the co- and cross-polar field components is exactly the same as for the individual antenna element. Typically, this ratio is 15–25 dB which is insufficient in many applications of dual polarized antennas.

The field generated by the left antenna element in the two-antenna element group shown in FIG. 17 is given by:

$$\overline{E_L}(\theta, \varphi) = \begin{Bmatrix} E_h(\theta, \varphi) \equiv E_h^e(\theta, \varphi) + E_h^o(\theta, \varphi) \\ E_v(\theta, \varphi) \equiv E_v^e(\theta, \varphi) + E_v^o(\theta, \varphi) \end{Bmatrix} \tag{7}$$

The field generated by the right antenna element provided that it is excited in a way identical to the excitation of the left antenna element for symmetry reasons is given by $$\overline{E_R}(\theta,\varphi)=\begin{Bmatrix}-E_h(\theta,\pi-\varphi)\equiv-E_h^e(\theta,\pi-\varphi)-E_h^o(\theta,\pi-\varphi)\\ E_v(\theta,\pi-\varphi)\equiv E_v^e(\theta,\pi-\varphi)+E_v^o(\theta,\pi-\varphi)\end{Bmatrix}\tag{8}$$

Using the even and odd symmetry properties, one finds:

$$\overline{E_R}(\theta,\varphi)=\begin{Bmatrix}-E_h^e(\theta,\varphi)+E_h^o(\theta,\varphi)\\ E_v^e(\theta,\varphi)-E_v^o(\theta,\varphi)\end{Bmatrix}\tag{9}$$

The excitations for the left and right patch are denoted $A_L$ and $A_R$, respectively. To radiate radiation of horizontal polarization, the H-ports are fed so that $A_L=-A_R=A_H$ and to radiate radiation of vertical polarization, the V-ports are fed so that $A_L=A_R=A_V$. The locations of the two antenna elements are $(x_L, y_L, z_L)=(-d_x/2, 0, 0)$ and $(x_R, y_R, z_R)=(d_x/2, 0, 0)$, i.e. $d_x$ is the horizontal spacing between the antenna elements. (When the excitation of the H-port of the left patch is equal to minus the excitation of the H-port of the right patch in a mirrored patch pair, the patches are said to have same effective excitation).

The combined radiation pattern from the two-mirrored-antenna element group of FIG. 17 is found using (1):

$$\begin{aligned}\overline{E}(\theta,\varphi)&=G_L(\theta,\varphi)\overline{E_L}(\theta,\varphi)+G_R(\theta,\varphi)\overline{E_R}(\theta,\varphi)\\ G_L(\theta,\varphi)&=A_Le^{-jB}\\ G_R(\theta,\varphi)&=A_Re^{jB}\\ B&=\frac{k_0d_x}{2}\sin\theta\cos\varphi\end{aligned}\tag{10}$$

Note that B=0 for $\phi=\pi/2$ (the elevation plane). Substituting (7) and (9) into (10) for excitation at the H-ports:

$$\begin{aligned}\overline{E_H}(\theta,\varphi)&=A_H(e^{-jB}\overline{E_{LH}}(\theta,\varphi)-e^{jB}\overline{E_{RH}}(\theta,\varphi))\\ &=A_H\begin{Bmatrix}e^{-jB}(E_{Hh}^e(\theta,\varphi)+E_{Hh}^o(\theta,\varphi))-e^{jB}(-E_{Hh}^e(\theta,\varphi)+E_{Hh}^o(\theta,\varphi))\\ e^{-jB}(E_{Hv}^e(\theta,\varphi)+E_{Hv}^o(\theta,\varphi))-e^{jB}(E_{Hv}^e(\theta,\varphi)-E_{Hv}^o(\theta,\varphi))\end{Bmatrix}\\ &=2A_H\begin{Bmatrix}\cos BE_{Hh}^e(\theta,\varphi)-j\sin BE_{Hh}^o(\theta,\varphi)\\ -j\sin BE_{Hv}^e(\theta,\varphi)+\cos BE_{Hv}^o(\theta,\varphi)\end{Bmatrix}\end{aligned}\tag{11}$$

Substituting (7) and (9) into (10) for excitation at the V-ports:

$$\begin{aligned}\overline{E_V}(\theta,\varphi)&=A_V(e^{-jB}\overline{E_{LV}}(\theta,\varphi)+e^{jB}\overline{E_{RV}}(\theta,\varphi))\\ &=A_V\begin{Bmatrix}e^{-jB}(E_{Vh}^e(\theta,\varphi)+E_{Vh}^o(\theta,\varphi))+e^{jB}(-E_{Vh}^e(\theta,\varphi)+E_{Vh}^o(\theta,\varphi))\\ e^{-jB}(E_{Vv}^e(\theta,\varphi)+E_{Vv}^o(\theta,\varphi))+e^{jB}(E_{Vv}^e(\theta,\varphi)-E_{Vv}^o(\theta,\varphi))\end{Bmatrix}\\ &=2A_H\begin{Bmatrix}-j\sin BE_{Vh}^e(\theta,\varphi)+\cos BE_{Vh}^o(\theta,\varphi)\\ \cos BE_{Vv}^e(\theta,\varphi)-j\sin BE_{Vv}^o(\theta,\varphi)\end{Bmatrix}\end{aligned}\tag{12}$$

In the elevation plane:

$$E_H(\theta,\pi/2)=2A_H\begin{Bmatrix}E_{Hh}^e(\theta,\pi/2)\\ E_{Hv}^o(\theta,\pi/2)\end{Bmatrix}=2A_H\begin{Bmatrix}E_{Hh}^e(\theta,\pi/2)\\ 0\end{Bmatrix}\tag{13}$$

-continued $$E_V(\theta,\pi/2)=2A_V\begin{Bmatrix}E_{Vh}^o(\theta,\pi/2)\\ E_{Vv}^e(\theta,\pi/2)\end{Bmatrix}=2A_V\begin{Bmatrix}0\\ E_{Vv}^e(\theta,\pi/2)\end{Bmatrix}$$

Comparison of (13) to (6) shows that the field from the two-mirrored-antenna element group in the elevation plane only contains the desired field component. This is caused by the fact that for H-port excitation, the two $E_{Hv}^e$ components (which are the primary contributors to the cross-polar field) generated by the two antenna elements, respectively, cancel each other. The same applies to the corresponding field components for V-port excitation. In the elevation plane, the cancelling field components are identical leading to a total cancellation of the resulting cross-polarized field, however, also outside the elevation plane, the undesired field is suppressed namely by the factor $$\sin B=\sin\left(\frac{k_0d_x}{2}\sin\theta\cos\varphi\right).$$

Thus, by feeding the antenna elements in pairs as described above, an antenna array can be formed having better polarization purity than the individual antenna element.

However, undesired side lobes are generated in the azimuth radiation pattern of an antenna array with many antenna elements disposed along the azimuth axis, each pair of antenna elements being excited as shown in FIG. 17.

The undesired side lobes, also denoted grating lobes, appear at an angle $\theta_J$ for which the two-antenna element group factor $\cos B=\cos(k_0d_x/2\sin\theta_J\cos\phi)$ is equal to 0, i.e. $k_0d_x/2\sin\theta_J\cos\phi=\pm\pi/2$. Assuming $d_x\cong0.7\lambda_0$ (a typical case) in the azimuth plane, i.e. $\phi=0$, $\sin\theta_J\cong\pm1/1.4$ or $\theta_J\cong\pm45.6°$. In an antenna array containing identical antenna elements as shown in FIG. 16, the antenna radiation pattern has a zero for $\theta=\theta_J$ because of the two-antenna element group radiation pattern shown in FIG. 15. For the two-mirrored-antenna element groups described above it is deduced from (11) and (12) (note: when cos B =0, sin B=1)

$$\overline{E_H}(\theta_J,0)=2A_H\begin{Bmatrix}-jE_{Hh}^o(\theta_J,0)\\ -jE_{Hv}^e(\theta_J,0)\end{Bmatrix}\tag{14}$$

-continued $$\overline{E_V}(\theta_J, 0) = 2A_V \begin{Bmatrix} -jE_{Vh}^{e}(\theta_J, 0) \\ -jE_{Vv}^{o}(\theta_J, 0) \end{Bmatrix}.$$

From (14) it is seen that the azimuth radiation pattern for $\theta=\theta_J$ in general is not zero. In large arrays consisting of many of the two-mirrored-antenna element groups, grating lobes are generated.

FIG. 18 shows the radiation pattern 37 of a two-antenna element group 30 as shown in FIG. 17.

It should be noted that the plotted curve of the horizontally co-polarized radiation shown in FIG. 18 has an app. −24 dB null only at a θ-value of app. 46 degrees which null should be compared with the true null of the radiation pattern shown in FIG. 6 This is an important observation. Furthermore, it should be noted that the magnitudes of the cross-polarized radiations are much lower than for the two-antenna element group 27 shown in FIG. 14.

FIG. 19 shows the radiation pattern 38 for a dual polarized antenna array consisting of 16 two-antenna element groups 30 is, as previously described, calculated by multiplying the two-antenna element radiation pattern 37 shown in FIG. 18 with the 16 antenna element group factor 11 shown in FIG. 9.

As should be expected for uniformly excited and equidistantly spaced arrays of many antenna elements, the shape of the radiation pattern 38 is very similar to the shape of the radiation pattern shown in FIG. 16. However, a pair of undesired side lobes 39, 40 appears in the radiation pattern at a θ-value of app. ±46 degrees. Corresponding side lobes are not seen on the radiation pattern 29 shown in FIG. 16.

The undesired side lobes 39, 40 are denoted grating lobes.

As already described above, the undesired grating lobes are generated as a result of the fact that the radiation pattern 37 shown in FIG. 18 of the two-antenna element group 30 shown in FIG. 17 does NOT have an infinitely deep null at θ-values of app. ±46 degrees. As the 16 antenna element group-factor 11 shown in FIG. 9 does indeed have a local maximum at θ-values of app. ±46 degrees, the resulting radiation pattern has side lobes, i.e. grating lobes, in this direction of radiation.

Thus, the "mirroring" described above of the positions of the feeding probes in relation to the patches leads to a "missing" null in the radiation pattern of the antenna element group 30 which again leads to generation of grating lobes.

As already mentioned, the radiation pattern 38 shown in FIG. 19 are calculated from the measured radiation patterns 18 shown in FIG. 13 of a probe-fed square patch 14 shown in FIG. 11.

For comparison, FIG. 20*a* shows a 7×32 antenna element C-band antenna array consisting of two-antenna element groups 30 and the measured radiation pattern 41 of the array. It is noted that the radiation pattern has grating lobes 42, 43 as predicted by the calculations described above (there is a minor difference in the exact location of the side lobe due to a slight difference of the $d_x$/wavelength parameter of the two antennas).

Although only antenna arrays radiating electromagnetic radiation of horizontal and vertical polarizations have been considered explicitly in the previous sections, it should be recognized that the principle for making antennas with excellent cross-polarization properties described above is not limited to this kind of antenna arrays, but can also be used to make single or dual polarization antennas for radiation of electromagnetic radiation of other polarizations than linear, e.g. circular, by proper excitation of the individual H- and V-ports of the antenna.

It is an object of the present invention to provide an antenna array comprising many antenna elements, e.g. more than ten antenna elements in which formation of grating lobes are inhibited in selected directions of the radiation and cross-polarization within the main lobe is suppressed at least 30 dB below the main lobe peak value.

According to the invention this and other objects are fulfilled by an antenna array for radiation or reception of electromagnetic radiation, comprising a plurality of antenna elements including at least one group of four adjacent antenna elements, the antenna elements having radiation patterns selected from a group consisting of a first, second, third and fourth radiation pattern, the first and second radiation patterns being different and being mirror images of one another with respect to a selected first plane of symmetry, the third and fourth radiation patterns being different and being mirror images of one another with respect to the selected first plane of symmetry, the first and fourth radiation patterns being different and being mirror images of one another with respect to a second selected plane of symmetry that is perpendicular to the first selected plane of symmetry, and the second and third radiation patterns being different and being mirror images of one another with respect to the second selected plane of symmetry, characterized in that either the antenna elements of the at least one group of four adjacent antenna elements have substantially identical radiation patterns two by two, respectively, and are positioned either in a substantially rectangular grid in such a way that the two antenna elements having substantially identical radiation patterns are positioned on opposite sides of a plane that is substantially perpendicular to the rectangular grid and includes selected centres of each of the other two antenna elements of the group, or substantially along an axis in such a way that the two antenna elements positioned at the innermost positions of the group have substantially identical radiation patterns and the two antenna elements positioned at the outmost positions of the group have substantially identical radiation patterns, or the four radiation patterns of the antenna elements of the at least one group of four adjacent antenna elements are different from one another and the antenna elements are positioned substantially along an axis, whereby formation of grating lobes are inhibited in selected directions of the radiation and cross-polarization within the main lobe is suppressed at least 30 dB below the main lobe peak value.

It is another object of the present invention to provide a method of suppressing cross polarization and grating lobes of dual polarized antenna arrays.

According to the invention this and other objects are fulfilled by a method of coupling signals to be radiated or received as electromagnetic radiation by an antenna array comprising a plurality of antenna elements, the method comprising the steps of providing antenna elements, the antenna elements having radiation patterns selected from a group consisting of a first, second, third and fourth radiation pattern, the first and second radiation patterns being different and being mirror images of one another with respect to a selected first plane of symmetry, the third and fourth radiation patterns being different and being mirror images of one another with respect to the selected first plane of symmetry, the first and fourth radiation patterns being different and being mirror images of one another with respect to a second selected plane of symmetry that is perpendicular to the first selected plane of symmetry, and the second and third radiation patterns being different and being mirror images of one another with respect to the second selected plane of symmetry, and positioning antenna elements that have substantially identical radiation patterns two by two, respectively, adjacently to one another either in a substantially rectangular grid in such a way that the two antenna elements having substantially identical radiation patterns are positioned on opposite sides of a plane that is substantially perpendicular to the rectangular grid and includes selected centres of each of the other two antenna elements of the group, or substantially along an axis in such a way that the two antenna elements positioned at the innermost positions of the group have substantially identical radiation patterns and the two antenna elements positioned at the outmost positions of the group have substantially identical radiation patterns, or positioning four antenna elements having four different radiation patterns, respectively, and the antenna adjacently substantially along an axis, whereby formation of grating lobes are inhibited in selected directions of the radiation and cross-polarization within the main lobe is suppressed at least 30 dB below the main lobe peak value.

An antenna array according to the invention may be used for transmission of a signal by radiation of electromagnetic waves from the array or for reception of electromagnetic waves-impinging on the array or for both transmission and reception of electromagnetic waves.

The antenna array may comprise individual antenna elements of any type or group of antenna elements in any combination that can be utilized for transmission and/or reception of electromagnetic radiation of one or two polarizations, such as probe-fed patches, aperture coupled patches, proximity coupled patches, dipole or aperture groups, antenna elements of phased arrays, reflectarray antenna elements, such as patches with microstrip delay lines connected to its feeding points, etc.

The antenna elements may include parasitic elements. For example, it is known to expand the frequency range of a patch by positioning parasitic elements adjacent to the patch.

The antenna array may be utilized for transmission and/or reception of electromagnetic radiation of two polarizations of the same or of different frequencies.

Further the antenna array may be utilized for simultaneous transmission and/or reception of electromagnetic radiation of two polarizations.

The antenna elements of the antenna array may be positioned in a three-dimensional grid, typically formed from a two-dimensional grid wrapped around a curved surface, such as a cylinder.

It is preferred that the antenna elements having substantially identical radiation patterns are antenna elements of the same type and dimensions and being positioned at identical orientations in a regular grid. It is obvious that the radiation pattern of an antenna element when operated alone as a single element antenna is modified according to its position in the antenna array because of the influence of other antenna elements and of other electrical or mechanical members such as support structures or edges. E.g. the antenna elements at the outermost positions of the antenna array have radiation patterns that differ slightly from the antenna elements positioned at the centre of the antenna array. However, throughout the present document, the radiation pattern of an antenna element refers to the radiation pattern of the antenna element when operated alone, as a single element antenna without influence from other antenna elements, etc.

The term identical radiation pattern is used about the radiation patterns of two different antenna elements $\overline{E_1}(\theta,\phi)$ and $\overline{E_2}(\theta,\phi)$ if one antenna element can be moved to a position relative to the other antenna element with the same orientation as the other antenna element, in such a way that for all values of (6,p) (C is a complex constant): $\overline{E_2}(\theta,\phi)=C^*\overline{E_1}(\theta,\phi)$.

The term mirrored radiation pattern is used to designate radiation patterns that, apart from a complex constant, are mirror images of one another with respect to a selected plane of symmetry, e.g. if the elevation plane is the selected plane of symmetry the original radiation pattern $\overline{E_o}(\theta,\phi)$ and the mirrored radiation pattern $\overline{E_M}(\theta,\phi)$ fulfil the equation (C is a complex constant):

$$\overline{E_O}(\theta,\varphi)=\begin{Bmatrix} E_{Oh}(\theta,\varphi) \\ E_{Ov}(\theta,\varphi) \end{Bmatrix}$$

$$\overline{E_M}(\theta,\varphi)=\begin{Bmatrix} E_{Mh}(\theta,\varphi) \\ E_{Mv}(\theta,\varphi) \end{Bmatrix}=C*\begin{Bmatrix} -E_{Oh}(\theta,\pi-\varphi) \\ E_{Ov}(\theta,\pi-\varphi) \end{Bmatrix}$$

Two antenna elements with mirrored radiation patterns need not be positioned symmetrically with respect to the plane of symmetry of the radiation patterns.

Four antenna elements that are positioned in a substantially rectangular grid are said to be adjacent when a closed path connecting centres of the four adjacent antenna elements is the shortest possible path that can be formed between four elements in the grid.

Four neighbouring antenna elements that are positioned substantially along an axis are said to be adjacent.

As will be described in further detail below with reference to the drawing, it is an important aspect of the present invention that by positioning antenna elements in an antenna array in such a way that neighbouring antenna elements have mirrored radiation patterns, the undesirable grating lobes shown in FIGS. 19 and 20 A are suppressed and simultaneously the desirable cross polarization characteristics of the dual polarized two-antenna element group shown in FIG. 18 is improved.

According to a preferred embodiment of the invention an antenna array is provided, comprising first coupling means for transmission of first signals to be radiated or received by the antenna array as electromagnetic radiation of at least one specific polarization and having a first set of first feed lines for transmission of the first signals to the antenna elements, each feed line being connected to a first coupling arrangement for transmission of first signals between the first feed lines and the corresponding antenna elements and being positioned in relation to the corresponding antenna element in such a way that the antenna element attains the desired radiation pattern.

According to another embodiment of the invention a dual polarized antenna array is provided, comprising first coupling means for transmission of first signals to be radiated or received by the antenna array as electromagnetic radiation of a first polarization, and second coupling means for transmission of second signals to be radiated or received by the antenna array as electromagnetic radiation of a second polarization which in a selected direction of radiation is substantially orthogonal to the first polarization.

The first coupling means may comprise a first set of first feed lines for transmission of the first signals to the antenna elements, each first feed line being connected to a first coupling arrangement for transmission of first signals between the first feed lines and the corresponding antenna elements and being positioned in relation to the corresponding antenna element in such a way that the antenna element attains the desired radiation pattern of the electromagnetic radiation of the first polarization, and the second coupling means may comprise a second set of second feed lines for transmission of the second signals to the antenna elements, each second feed line being connected to a second coupling arrangement for transmission of second signals between the second feed lines and the corresponding antenna elements and being positioned in relation to the corresponding antenna element in such a way that the antenna element attains the desired radiation pattern of the electromagnetic radiation of the second polarization.

The coupling means are adapted for transmission of signals from a signal generator to the antenna elements of the antenna array or for transmission of signals received by the antenna elements to a receiver adapted to process the received signals or for transmission of signals to the antenna elements of the antenna array and transmission of signals received by the antenna elements of the antenna array.

The coupling means may comprise a feeding network, i.e. an arrangement of feed lines, such as coaxial cables, waveguides, microstrip lines, etc.

In a reflectarray antenna, the coupling means comprise e.g. a feed horn and delay lines connected to the antenna elements of the reflectarray.

The amplitude and phase of a signal transmitted to an individual antenna element for radiation by the antenna element is denoted the antenna element excitation. The radiated energy of the antenna array is determined by the antenna element excitations combined with their radiation patterns.

The feeding network of a dual polarized antenna array has a first port connected the first set of feed lines and a second port connected to the second set of feed lines. It is desired that when a signal is transmitted to the antenna elements of the antenna array through one port, electromagnetic radiation of substantially one of the two orthogonal polarizations is radiated without radiating electromagnetic radiation of the other polarization, and when a signal is transmitted to the antenna elements through the other port, electromagnetic radiation of the other of the two orthogonal polarizations of the antenna element is radiated. In real antenna elements, signal isolation between the two ports will never be ideal, and therefore the electromagnetic radiation radiated by exciting each of the ports will never be exactly orthogonal.

A signal is transmitted between an antenna element of the antenna array and a corresponding feed line positioned at the antenna element by a coupling arrangement, such as an aperture, a microstrip line, a probe, a delay line, etc. The antenna element and the feed line may or may not be galvanically interconnected. For example in an aperture coupled antenna element, there is no galvanic interconnection while patches fed form a microstrip line feeding network may be galvanically interconnected to corresponding feed lines.

The coupling arrangement is preferably positioned at a position which has the feature that, when the antenna array is transmitting a signal, a signal coupled to the antenna element at that position will excite primarily one of two orthogonal polarizations.

Positions of coupling arrangements with the features described above are typically located along one or more axis of the antenna element. For example, for a rectangular probe-fed microstrip patch, the two axis of symmetry comprises line segments consisting of points having positions with this feature. However, also axis positioned adjacent to or close to the axis of symmetry comprise line segments consisting of points having positions with this feature.

It is presently preferred to utilize antenna elements having two axis of symmetry in dual polarized antenna arrays, such as circular patches, rectangular patches, quadratic patches, etc.

According to a preferred embodiment of the invention, the antenna elements of the antenna array comprise probe-fed patches, preferably rectangular patches, more preferred ;square patches. Further, it is preferred that the feed probes are positioned at the axis of symmetry of the square or rectangular patches.

FIG. 21 shows a four antenna element group according to the invention. The upper antenna element pair is identical to the antenna element pair shown in FIG. 17 while the positions of the interconnections at the lower antenna element pair is different from the corresponding positions of the upper pair. The phases of the feeding signals of the antenna elements are indicated by +1 and −1, respectively, as in FIG. 17. As above, the horizontal antenna element spacing is $d_x$ and the vertical antenna element spacing is $d_y$. Typically, the values of $d_x$ and $d_y$ are around 0.7 free space wavelengths.

The upper two antenna elements comprise the two-mirrored-antenna element group shown in FIG. 17. The lower two-antenna element group is identical to the upper group, except that the H-polarization feed points have been moved to the mirrored location. The antenna elements are referred to with subscripts TL (top left) and BR (bottom right), etc.

To radiate horizontally polarized radiation from the group, $A_{TL}=-A_{TR}=-A_{BL}=A_{BR}=A_H$.

To radiate vertically polarized radiation from the group, $A_{TL}=A_{TR}=A_{BL}=A_{BR}=A_V$.

The fields from the upper two-mirrored-antenna element group are given by (11) and (12).

The fields from the lower two-mirrored-antenna element group are given by:

$$\begin{aligned}\overline{E_{BH}}(\theta,\varphi) &= A_H(-e^{-jB}\overline{E_{RH}}(\theta,\varphi)+e^{jB}\overline{E_{LH}}(\theta,\varphi)) \\ &= A_H\begin{Bmatrix}-e^{-jB}(-E^e_{Hh}(\theta,\varphi)+E^o_{Hh}(\theta,\varphi))+e^{jB}(E^e_{Hh}(\theta,\varphi)+E^o_{Hh}(\theta,\varphi)) \\ -e^{-jB}(E^e_{Hv}(\theta,\varphi)-E^o_{Hv}(\theta,\varphi))+e^{jB}(E^e_{Hv}(\theta,\varphi)+E^o_{Hv}(\theta,\varphi))\end{Bmatrix} \\ &= 2A_H\begin{Bmatrix}\cos BE^e_{Hh}(\theta,\varphi)+j\sin BE^o_{Hh}(\theta,\varphi) \\ j\sin BE^e_{Hv}(\theta,\varphi)+\cos BE^o_{Hv}(\theta,\varphi)\end{Bmatrix}\end{aligned} \tag{15}$$

-continued $$\overline{E_{BV}}(\theta,\varphi) = A_V(e^{-jB}\overline{E_{RV}}(\theta,\varphi) + e^{jB}\overline{E_{LV}}(\theta,\varphi)) \tag{16}$$

$$= A_V\begin{Bmatrix} e^{-jB}(-E^e_{Vh}(\theta,\varphi) + E^o_{Vh}(\theta,\varphi)) + e^{jB}(E^e_{Vh}(\theta,\varphi) + E^o_{Vh}(\theta,\varphi)) \\ e^{-jB}(E^e_{Vv}(\theta,\varphi) - E^o_{Vv}(\theta,\varphi)) + e^{jB}(E^e_{Vv}(\theta,\varphi) + E^o_{Vv}(\theta,\varphi)) \end{Bmatrix}$$

$$= 2A_V\begin{Bmatrix} j\sin BE^e_{Vh}(\theta,\varphi) + \cos BE^o_{Vh}(\theta,\varphi) \\ \cos BE^e_{Vv}(\theta,\varphi) + j\sin BE^o_{Vv}(\theta,\varphi) \end{Bmatrix}$$

The resulting field from the four antenna element group is given by:

$$\overline{E}(\theta,\varphi) = G_B(\theta,\varphi)\overline{E_B}(\theta,\varphi) + G_T(\theta,\varphi)\overline{E_T}(\theta,\varphi) \tag{17}$$

$$G_B(\theta,\varphi) = e^{-jC}$$

$$G_T(\theta,\varphi) = e^{jC}$$

$$C = \frac{k_0 d_y}{2}\sin\theta\sin\varphi$$

Note that C=0 for $\phi=0$ (the azimuth plane).

For excitation at the H-ports:

$$\overline{E_H}(\theta,\varphi) = e^{-jC}\overline{E_{BH}}(\theta,\varphi) + e^{jC}\overline{E_{TH}}(\theta,\varphi) \tag{18}$$

$$= 2A_H\begin{Bmatrix} e^{-jC}(\cos BE^e_{Hh}(\theta,\varphi) + j\sin BE^o_{Hh}(\theta,\varphi)) + e^{jC}(\cos BE^e_{Hh}(\theta,\varphi) - j\sin BE^o_{Hh}(\theta,\varphi)) \\ e^{-jC}(+j\sin BE^e_{Hv}(\theta,\varphi) + \cos BE^o_{Hv}(\theta,\varphi)) + e^{jC}(-j\sin BE^e_{Hv}(\theta,\varphi) + \cos BE^o_{Hv}(\theta,\varphi)) \end{Bmatrix}$$

$$= 4A_H\begin{Bmatrix} \cos C\cos BE^e_{Hh}(\theta,\varphi) + \sin C\sin BE^o_{Hh}(\theta,\varphi) \\ \sin C\sin BE^e_{Hv}(\theta,\varphi) + \cos C\cos BE^o_{Hv}(\theta,\varphi) \end{Bmatrix}$$

For excitation at the V-ports:

$$\overline{E_V}(\theta,\varphi) = e^{-jC}\overline{E_{BV}}(\theta,\varphi) + e^{jC}\overline{E_{TV}}(\theta,\varphi) \tag{19}$$

$$= 2A_V\begin{Bmatrix} e^{-jC}(j\sin BE^e_{Vh}(\theta,\varphi) + \cos BE^o_{Vh}(\theta,\varphi)) + e^{jC}(-j\sin BE^e_{Vh}(\theta,\varphi) + \cos BE^o_{Vh}(\theta,\varphi)) \\ e^{-jC}(\cos BE^E_{Vv}(\theta,\varphi) + j\sin BE^o_{Vv}(\theta,\varphi)) + e^{jC}(\cos BE^e_{Vv}(\theta,\varphi) - j\sin BE^o_{Vv}(\theta,\varphi)) \end{Bmatrix}$$

$$= 4A_V\begin{Bmatrix} \sin C\sin BE^e_{Vh}(\theta,\varphi) + \cos C\cos BE^o_{Vh}(\theta,\varphi) \\ \cos C\cos BE^E_{Vv}(\theta,\varphi) + \sin C\sin BE^o_{Vv}(\theta,\varphi) \end{Bmatrix}$$

In the elevation plane ($\phi=\pi/2$=>sin B=0, cos B=1):

$$\overline{E_H}(\theta,\pi/2) = 4A_H\begin{Bmatrix} \cos CE^e_{Hh}(\theta,\pi/2) \\ \cos CE^o_{Hv}(\theta,\pi/2) \end{Bmatrix} = 4A_H\begin{Bmatrix} \cos CE^e_{Hh}(\theta,\pi/2) \\ 0 \end{Bmatrix} \tag{20}$$

$$\overline{E_V}(\theta,\pi/2) = 4A_V\begin{Bmatrix} \cos CE^o_{Vh}(\theta,\pi/2) \\ \cos CE^e_{Vv}(\theta,\pi/2) \end{Bmatrix} = 4A_V\begin{Bmatrix} 0 \\ \cos CE^e_{Vv}(\theta,\pi/2) \end{Bmatrix}$$

It is seen (as for the two-mirrored-antenna element group described previously) that in the elevation plane only the desired field components are generated.

In the azimuth plane ($\phi=0$=>sin C=0, cos C=1):

$$\overline{E_H}(\theta,0) = 4A_H\begin{Bmatrix} \cos BE^e_{Hh}(\theta,0) \\ \cos BE^o_{Hv}(\theta,0) \end{Bmatrix} \tag{21}$$

$$\overline{E_V}(\theta,0) = 4A_V\begin{Bmatrix} \cos BE^o_{Vh}(\theta,0) \\ \cos BE^e_{Vv}(\theta,0) \end{Bmatrix}$$

It is seen that in the azimuth plane 1) the cross-polar field suppression is improved as the 1) the cross-polar field components $E_{Hv}^e$ for H-port excitation, and $E_{Vh}^e$ for H-port excitation have vanished, and that
2) the undesired grating lobes have disappeared as cos B=0 for $\theta=\theta_J$.

FIG. 22 shows plots of radiation patterns in the azimuth and elevation planes for the group shown in FIG. 21. It should be noted that in the following $d_x \cong 0.7\lambda_0$ and $d_y \cong 0.56\lambda_0$.

It is seen that the horizontally polarized electromagnetic radiation in the azimuth plane has the infinite nulls at θ-values of app. ±46 degrees and that magnitude of the cross-polarization radiation is very low.

For comparison with the radiation patterns shown in FIG. 22, FIGS. 23 and 24 show the corresponding radiation patterns of four antenna element groups known in the art.

The radiation pattern for a dual polarized antenna array consisting of 16 four antenna element groups shown in FIG. 21 is calculated by multiplying the four-antenna element radiation pattern in FIG. 22 with the 16 antenna element is group factor in FIG. 9. The calculated patterns are shown in FIG. 25.

It should be noted that the radiation patterns do not have grating lobes. Furthermore, the magnitude of the cross-polarized radiation is significantly suppressed compared to the corresponding radiation of the simple array (shown in FIG. 16) and compared to the corresponding radiation of an array of the simple two-antenna element group (shown in FIG. 19).

FIG. 26 illustrates alternative configurations of coupling positions of antenna elements arranged in four antenna element groups according to the invention.

EXAMPLE 1

In FIG. 29 measurements of radiation patterns in the azimuth and elevation planes of a 2×8 element L-band antenna according to the invention are plotted.

FIG. 28 shows a cross section of one element (stacked patch) of the L-band antenna.

The overall physical size of the antenna array is 1.35×0.31 ×0.11 m (L×H×D). The array consists of 4 identical panels 50. Each panel 50 consists of four probe-fed microstrip stacked patch antenna elements 51, 52, 53, 54 as shown in FIG. 21. The upper parasitic patches 55*a*, 56*a*, 57*a*, 58*a* and the lower driven patches 55, 56, 57, 58 shown in FIG. 27 are copper squares with side lengths of app. 85 mm and 100 mm, respectively. The lower patches 55, 56, 57, 58 are fed using one probe 61 per polarization, each probe being spaced 27 mm from the corresponding radiating edge. The patches are etched on a 0.381 mm thick Rogers RT/duroid 5870 substrate 162.

The dielectric 163 between the upper patches 55*a*, 56*a*, 57*a*, 58*a* and the lower patches 55, 56, 57, 58 and between the lower patches 55, 56, 57, 58 and the ground plane 164 is Rohacell 31 HF low permittivity ($\in_r$=1.08 at 1.25 GHz) 16 mm and 8 mm thick, respectively, foam material. The lower foam is glued onto a 3 mm thick silver-plated aluminum ground plane 164. On the other side of the aluminum ground plane, the microstrip patch feeding network 165 is produced on a 1.52 mm thick Rogers R03003. The feeding network 165 is also glued onto the aluminum ground plane. Each probe 61 connects the corresponding feed line 166 of the feeding network 165 to the corresponding lower patch 55 through the ground plane 164.

The patch feeding network feeding the four patches in a panel is designed so that the patches are excited as shown in FIG. 21.

Simple microstrip circuits in the feeding network impedance match each dual polarized patch to 50 ohm in the frequency range from 1.2 GHz to 1.3 GHz.

In FIG. 27, the microstrip feeding network 60 for the L-band antenna element panel (four antenna elements) is shown. The phases of the signals fed to the patches are indicated by the numbers +1 and −1 as in FIG. 21.

According to a preferred embodiment of the invention, identical signals (+1) are fed to the vertical ports 61, 62, 63, 64 of the patches 55, 56, 57, 58, while signals of alternating phase (+1, −1) are fed to the horizontal ports 65, 66, 67, 68 corresponding to the positioning of the interconnection between the probe and the patch in question.

The effect of breaking up the repetitive pattern of probe is positions of an array consisting of the groups of two antenna elements 30 shown in FIG. 17 by forming an array consisting of the groups of four antenna elements 50 shown in FIG. 21 is that the cancellation of cross coupling between the two input ports of the antenna element (as described in U.S. Pat. No. 4,464,663) is preserved for all pairs of antenna elements and that, simultaneously, grating lobes do not appear in the radiation pattern of the array as the group of four antenna elements 50 has an infinite null at θ-values of app. ±46 degrees in the azimuth plane. Further, the cross-polarization properties of the antenna array are improved.

Thus, according to the invention single or dual polarized antenna arrays are provided with very low cross-polarization and without grating lobes.

The panel feeding network feeds the four panels with an amplitude taper being (0.6, 1.0, 1.0, 0.6) in order to shape the far-out side lobes for the purpose which the array is designed for.

In FIG. 30, the calculated radiation patterns of the L-band antenna element is plotted. The radiation patterns are calculated by multiplying the four antenna element group pattern shown in FIG. 22 by a sub-group factor similar to the sub-group group factor 9 shown in FIG. 7 however, taking into account the above-mentioned amplitude taper.

It is seen that the measured radiation pattern does not have the predicted nulls in the elevation pattern. The reason is believed to be that the ground plane for the real antenna only extends slightly beyond the edges of the patches causing the radiation patterns for the upper and lower patches to be perturbed in opposite directions. This is also believed to be the reason why the cross-polar fields in azimuth are higher than predicted.

For comparison with the radiation patterns shown in FIG. 30, FIGS. 31 and 32 show the corresponding radiation patterns of 16 antenna element groups known in the art.

In FIG. 33, the measured input reflection coefficients are plotted for the horizontal and vertical ports of the antenna element together with measurements of transmission between the ports.

In the analysis of the four element group above, it was assumed that the upper and lower two antenna element subgroups have the same effective excitations. It is, however, possible to maintain suppression of grating lobes and cross-polarization for antenna arrays according to the invention in which the antenna elements do not have the same effective excitations.

EXAMPLE 2

The measured elevation pattern of the C-band synthetic aperture radar antenna shown in FIG. 20*a* may be obtained by excitation of the seven rows of antenna elements of the array as shown in the table below:

| Row | Effective excitation |
|---|---|
| 1 | 0.112 < 135° |
| 2 | 0.079 < 30° |
| 3 | 0.631 < 0° |
| 4 | 1.0 < 0° |
| 5 | 0.631 < 0° |
| 6 | 0.079 < −30° |
| 7 | 0.112 < −135° |

FIG. 20B shows the calculated radiation pattern of a 7×32 antenna element C-band antenna array using the four-element group 50 according to the invention with effective excitations of the rows of antenna elements as shown in the table above. It is seen by comparing FIG. 20B with FIG. 20A that the grating lobes are suppressed and that the cross-polarization suppression is very good.

EXAMPLE 3

FIG. 34 shows a four antenna element aperture coupled microstrip antenna group 70 according to the invention. The group consists of four patches 71, 72, 73, 74 having narrow apertures 75–82 for excitation of electromagnetic radiation of a polarization perpendicular to the longitudinal axis of the aperture. The feeding network of the group comprises feed lines located underneath the patches and including lines 83, 84 of 180° electrical length to provide the desired phase shift of the feeding signals. The upper and lower patches are fed by substantially identical signals. The group may be used for transmission of electromagnetic radiation of a single polarization by utilization of the corresponding port only.

EXAMPLE 4

FIG. 35 shows four antenna elements 86, 87, 88, 89 of a planar inverted-F antenna array 85 according to the invention, which is a compact wideband antenna (it is also known as a shunt-driven inverted L antenna-transmission line with an open end). Typically, the inverted-F antenna is utilized in single polarization applications, however, a dual polarized antenna array of this type may be advantageous at lower frequencies ranges at which physical dimensions of microstrip substrates become impractical. In the upper part of FIG. 35, the wide black end of the elements indicate the grounding end of the element. The feeding point is indicated as a dot 90 in the lower part of FIG. 35 showing a single element in perspective. Two elements 91, 92 are mounted above each other and above a ground plane 93. Due to the proximity of the two antenna elements, their mutual coupling will be significant. However, in the configuration of the antenna elements shown in FIG. 35, the transmission between the horizontal and vertical ports of the array can be cancelled.

EXAMPLE 5

Below, various single polarization linear and planar antenna arrays according to the invention are disclosed. Antenna arrays for radiation of electromagnetic radiation of horizontal polarization and vertical polarization, respectively, utilizing probe-fed microstrip patches are disclosed. The dots on the figures indicate the feeding points of the antenna elements. In the examples, the element spacing used is 0.7 free-space wavelengths in both directions (i.e. $d_x=d_y=0.7\lambda_0$).

FIG. 36 shows an antenna array 100 designed to radiate horizontal polarization made from asymmetrical radiating antenna elements positioned in a regular grid. The radiation pattern of the array is also shown. "E-co" and "E-cr" designate the co- and cross-polarization radiation patterns, respectively.

Four antenna element groups 100 as shown in FIG. 36 may be used to form a 16 antenna element group 101 as shown in FIG. 37.

The antenna array 101 shown in FIG. 37 has a radiation pattern that is slightly asymmetrical in the azimuth plane due to the asymmetrical radiation patterns of the antenna elements. Further, the cross-polarization properties of the array in the elevation plane is not improved compared to the cross-polarization properties of each antenna element. Typically, the cross-polarization in the main lobe of array 101 is in the order of −25 dB.

In order to improve the cross-polarization properties of the antenna array 100, 101 configuration mirroring of radiating elements may be invoked as shown in FIG. 38.

Four groups 102 of antenna elements shown in FIG. 38 may be utilized to form a 16 element group 103 as shown in FIG. 39.

As in the examples of dual-polarized antenna arrays disclosed above, the array configuration 102, 103 has a radiation pattern that is symmetrical in the azimuth plane. The cross-polarization is significantly suppressed in the main lobe. Grating lobes, however, are generated in the azimuth plane due to the "missing null" in the radiation pattern of the four-element group.

FIG. 40 shows a four antenna element group 104 wherein the "missing nulls" of the four-element group shown in FIG. 38 are restored, thus, formation of grating lobes are inhibited and wherein the significant suppression of cross-polarization in the main lobe is maintained.

Four of the groups 104 shown in FIG. 40 may be utilized to form a 16 element group 105 according to the invention as shown in FIG. 41.

The radiation pattern of the antenna array 105 shown in FIG. 41 is asymmetrical in the azimuth plane with no grating lobes. The cross-polarization suppression in the main lobe of the array is excellent.

Two alternative embodiments of the invention are shown in FIGS. 42 and 43.

Contrary to the array configuration 106, the array configuration 107 has a radiation pattern that is symmetrical in the azimuth plane. The cross-polarization in the main lobe of the array is excellent.

FIG. 44 shows the layout and radiation pattern of a horizontally polarized planar array 110 according to the invention consisting of 2*4 antenna elements.

Four of the groups 110 shown in FIG. 44 may be utilized in a 2*16 antenna element array 111 as shown in FIG. 45.

According to the invention, in the antenna array 111 shown in FIG. 45 formation of grating lobes are inhibited in both the azimuth plane and the elevation plane and the cross-polarization suppression in the main lobe is significant.

Corresponding to the description of horizontally polarized antenna arrays above, vertically polarized antenna arrays may utilize asymmetrical radiating antenna elements as shown in FIG. 46.

Four antenna element groups 120 as shown in FIG. 46 may be used to form a 16 antenna element group 121 as shown in FIG. 47.

The antenna array shown in FIG. 47 has a radiation pattern that is slightly asymmetrical in the elevation plane due to the asymmetrical radiation patterns of the antenna elements. Further, the cross-polarization properties of the array in the azimuth plane is not improved compared to the cross-polarization properties of each antenna element. Typically, the cross-polarization in the main lobe of array 121 is in the order of −25 dB.

In order to improve the cross-polarization properties of the antenna array 120, 121 configuration mirroring of radiating elements may be invoked as shown in FIG. 48.

Four groups of antenna elements shown in FIG. 48 may be utilized to form a 16 element group as shown in FIG. 49.

As in the examples of dual-polarized antenna arrays disclosed above, the array configuration 122 has a radiation pattern that is symmetrical in the azimuth plane. The cross-polarization is significantly suppressed in the main lobe. Grating lobes, however, are generated in the azimuth plane due to the "missing zero" in the cross-polar radiation pattern of the four-element group 122.

FIG. 50 shows a four antenna element group 124 wherein the "missing nulls" of the four-element group shown in FIG. 48 are restored, thus, formation of grating lobes are inhibited and wherein the significant suppression of cross-polarization in the main lobe is maintained.

Four of the groups 124 shown in FIG. 50 may be utilized to form a 16 element group 125 as shown in FIG. 51.

The radiation pattern of the antenna array shown in FIG. 51 is symmetrical in the azimuth plane with no grating lobes. The cross-polarization suppression in the main-beam of the array is excellent.

Two alternative embodiments of the invention are shown in FIGS. 52 and 53.

FIG. 52 and FIG. 53 each shows a 16 antenna element group 126 and 127, respectively, wherein the "missing nulls" of the four-element group shown in FIG. 48 are restored, thus, formation of grating lobes are inhibited and wherein the significant suppression of cross-polarization in the main lobe is maintained.

The array configuration 127 has a radiation pattern that is symmetrical in the azimuth plane. The cross-polarization in the main lobe of the array is excellent.

FIG. 54 shows the layout and radiation pattern of a vertically polarized planar array 130 according to the invention consisting of 2*4 antenna elements.

Four of the groups 130 shown in FIG. 54 may be utilized in a 2*16 antenna element array 131 as shown in FIG. 55.

According to the invention, in the antenna array 131 shown in FIG. 55 formation of grating lobes are inhibited in both the elevation plane and the azimuth plane and the cross-polarization suppression in the main lobe is significant.

EXAMPLE 6

Throughout the following calculated examples, dual-linearly polarization antenna arrays of 8×16 elements are considered. The radiating elements used in the antenna arrays described in this example is the microstrip patch antenna shown in FIG. 11, having the radiation pattern shown in FIG. 13. In the examples, the element spacing used is 0.7 free-space wavelengths in both directions (i.e. $d_x=d_y=0.7\ \lambda_0$). All elements in the arrays shown in FIGS. 56 through 64 are fed with identical magnitudes (i.e. these arrays are equi-spaced planar arrays with uniform excitations in both directions). In the examples shown in FIGS. 65 through 67 the excitations of the elements have been tapered along both directions using a Taylor distribution. The orientation of the radiating elements follows the same notation as used previously in the patent application (i.e. the dot indicates the microstrip patch probe feeding point).

FIGS. 56 through 59 show four 2×2 element dual-linearly polarization antenna arrays. FIG. 56 is similar to FIG. 23, FIG. 57 is similar to FIG. 24 and FIG. 58 is similar to FIGS. 21/22. The reason why e.g. FIG. 56 is not fully identical to FIG. 23 is, that the examples described previously in the patent application used element spacings $d_x$ and $d_y$ slightly different from being exactly 0.7 $\lambda_0$ (in order to allow for a comparison in the patent application between the measured antenna and the computed radiation patterns). The four-element groups shown in FIGS. 56 through 59 will be used in the following examples (shown in FIGS. 60 through 67) for the construction of larger antenna arrays. On the figures the "Phi=0 Deg." plots show the azimuth plane radiation pattern, "Phi=45 Deg." plots show the diagonal plane radiation pattern and "Phi=90 Deg." plots show the elevation plane radiation pattern.

FIG. 60 shows a simple 8×16 element dual-polarization antenna array, where no elements (or pairs of elements) have been mirrored. The array of FIG. 60 is constructed from the 2×2 element array shown in FIG. 56. As can be seen from the array radiation pattern, no improvement is obtained in the cross-polarization level of the overall array compared to that for the individual element: The cross-polarization level remains the same as that of the isolated element. FIG. 60 is closely related to FIG. 16 and FIG. 31 (i.e. all these arrays are having the same basic construction). The radiation pattern in both directions is that expected from "large" antenna arrays of equi-spaced elements with uniform excitations in both directions: The sin (x)/x-like pattern roll-off from the mainbeam towards the sidelobe region.

FIG. 61 shows a 8×16 element dual-polarization antenna array, wherein pairs of elements have been mirrored according to prior art (i.e. according to U.S. Pat. No. 4,464,663). The array of FIG. 61 is constructed from the 2×2 element array shown in FIG. 57. As can be seen from the array radiation pattern, the cross-polarization vanishes in the elevation plane, and is improved over large parts of the azimuth plane, compared to that for the individual element (and compared to the radiation pattern of the array shown in FIG. 60). A pair of grating lobes, however, occur at approx. ±46° in the azimuth direction for the horizontal polarization. The grating lobes are only approx. 17 dB below the mainbeam peak. The grating lobes are a result of the "missing nulls" of the two-element group shown in FIG. 57. The grating lobes are inherent and unavoidable, if using the technique described in U.S. Pat. No. 4,464,663. FIG. 61 is closely related to FIG. 19, FIG. 20A and FIG. 32 (i.e. these arrays all have the same basic construction).

FIG. 62 shows a 8×16 element dual-polarization antenna array, wherein pairs of elements have been mirrored in a fashion according to this new invention. The array of FIG. 62 is constructed from the 2×2 element array shown in FIG. 58. As can be seen from the array radiation pattern, the cross-polarization vanishes in both the elevation plane and in the azimuth plane. No grating lobes (e.g. compared to FIG. 61) are seen. In the 45 degree radiation pattern cut of the array shown in FIG. 62 is seen, that the result of using the same four-element group everywhere in the array is, that the former pair of azimuth grating lobes are now split up into two smaller pairs of lobes, which show up in the diagonal planes with maximum level at approx. ±80°. Although the level of these diagonal-plane lobes is approx. 25 dB below the mainbeam peak they may still be desired to be further suppressed in certain applications. FIG. 62 is closely related to FIG. 20B, FIG. 25 and FIG. 30 (i.e. these arrays all have the same basic construction).

FIG. 63 shows a 8×16 element dual-linearly polarization antenna array, wherein pairs of elements have been mirrored in a fashion according to prior art, both in azimuth and in elevation. The array of FIG. 63 is constructed from the 2×2 element array shown in FIG. 59. As can be seen from the array radiation pattern, the cross-polarization vanishes both in the azimuth plane and in the plane elevation. Pair of grating lobes, however, again occur at approx. ±46° both in azimuth, for the horizontal polarization, and in elevation for the vertical polarization. The grating lobes are only approx. 17 dB below the main beam peak. The grating lobes are again a result of the "missing nulls" of the four-element group shown in FIG. 59.

FIG. 64 shows a 8×16 element dual-linearly polarization antenna array, wherein pairs of elements have been mirrored in a fashion according to this new invention, and wherein the four-element groups comprising the array have also been arranged in accordance with the basic idea of the invention. The array of FIG. 64 is constructed from the 2×2 element array shown in FIG. 58. As can be seen from the array radiation pattern, the cross-polarization completely vanishes in both the elevation plane and in the azimuth plane. No grating lobes (e.g. compared to FIG. 61 and 63) neither in azimuth, nor in elevation, are seen. It is seen, that the result of using different four-element groups (but all four-element groups in accordance with the invention) leads to an array with outstanding cross-polarization properties, and an array having no grating lobes in any planes. FIG. 64 is closely related to FIG. 26 a) and b) (i.e. these arrays all have the same basic construction). It is seen in FIG. 64, that the radiation pattern of FIG. 60 has now been almost completely restored; no grating lobes occur. The outstanding cross-polarization performance of FIG. 64 versus FIG. 60 should be noted.

Above, we have been assumed uniform excitations for all elements in the arrays. In many applications it is desirable to taper the excitations in azimuth as well as in elevation, e.g. to achieve a lower sidelobe level, than the sin (x)/x level (a such lowering of the sidelobe level is at the expense, however, of a beam broadening of the main lobe and an associated loss in the peak directivity of the array). FIG. 65 shows a 8×16 element dual-linearly polarization antenna array, having the same array layout as the array shown in FIG. 64, where a Taylor taper has been applied to the element excitations in azimuth and elevation. The taper has been designed to obtain a first-sidelobe level of −30 dB. As can be seen from the array radiation pattern, the cross-polarization completely vanishes in both the elevation plane and in the azimuth plane. No grating lobes neither in azimuth, nor in elevation, are seen. Note, that in this case, due to the Taylor taper, neighbouring elements in general do not have identical effective excitations. Comparing FIG. 65 with FIG. 64 shows that the same qualitative properties with respect to suppression of cross-polarization and undesired sidelobes are the same.

The invention may also be applied in scanned arrays. FIG. 66 and FIG. 67 shows the azimuth plane radiation pattern of an array with the layout as shown in FIG. 65, where the mainbeam has now been steered to −9 degrees and −18 degrees in the azimuth plane, respectively, by applying a linear phase taper to the individual array element excitations (i.e. the linear phase taper has been applied along the azimuth direction of the array). The slight decrease in peak directivity compared to FIG. 64 (most clearly seen in FIG. 67) is due to the element pattern roll-off. It is seen that the radiation pattern of the scanned Taylor array exhibits the same improvement in cross-polarization and sidelobe level as obtained in the non-scanned Taylor array of FIG. 65.

The above-described principle of the construction of a dual-polarization antenna array according to the invention may of course also be applied to the construction of a single-polarization antenna array. The final single-polarization array, where the basic invention is invoked at several levels (neighbour-elements mirrored in accordance with the invention, and groups of groups also mirrored in accordance with the invention), will achieve the same ultimate high performance as explained and achieved for the dual-polarization antenna array shown in FIG. 64.

We have considered only radiation pattern properties, and not issues related to feeding the radiating elements. It is well known, that the network feeding the two elements in a mirrored pair can be designed to cancel the coupling between the H- and the V-ports. This effect is very important when designing arrays with good cross-polarization suppression using for instance microstrip patches fed by a passive feed network. If the array consists of active T/R modules, each using a single element as radiator, the issue of isolation between ports is no longer meaningful but the radiation pattern can still be improved using the methods described in the patent application.

EXAMPLE 7

FIG. 69 shows a four-element linear group according to the invention. Elements having identical radiation patterns are designated with the same letter.

FIG. 68 shows a triangular grid configuration of an antenna array comprising the group shown in FIG. 69 and the corresponding calculated radiation pattern. A Taylor taper has been applied to the element excitations in the azimuth and elevation directions. It is seen that cross-polarization and grating lobe suppression is excellent.

Figure 70:
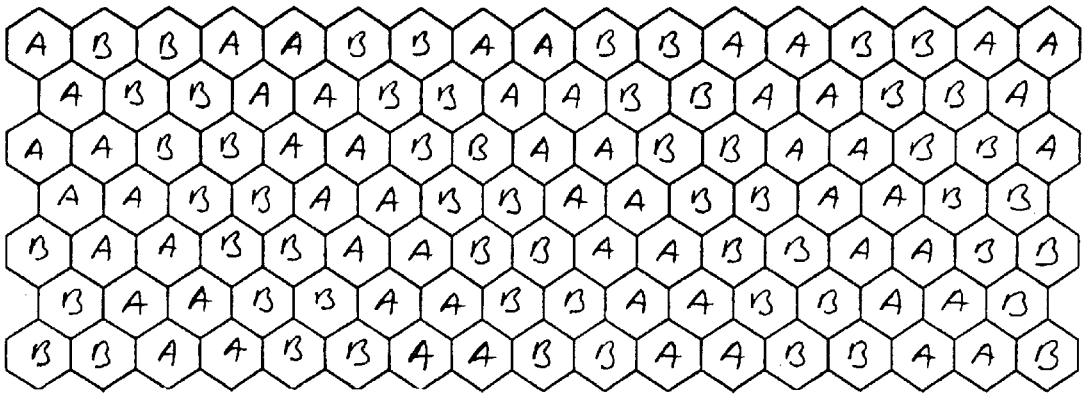
Figure 71:
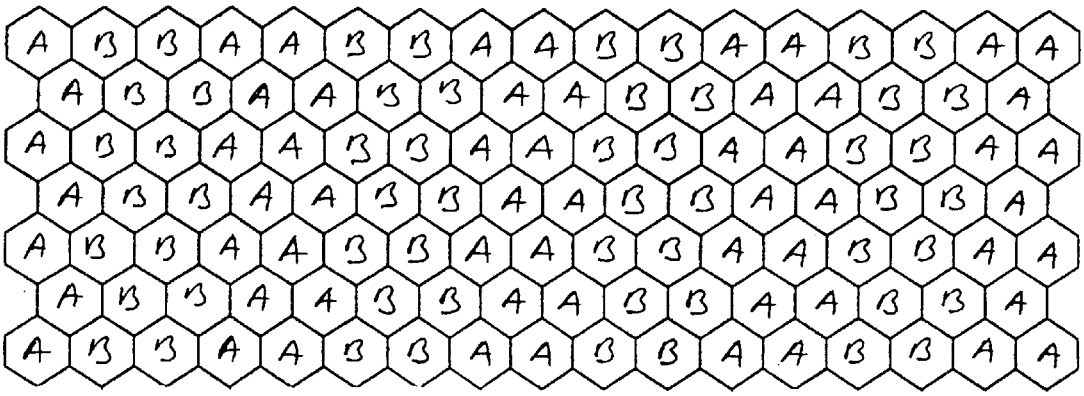
Figure 72:
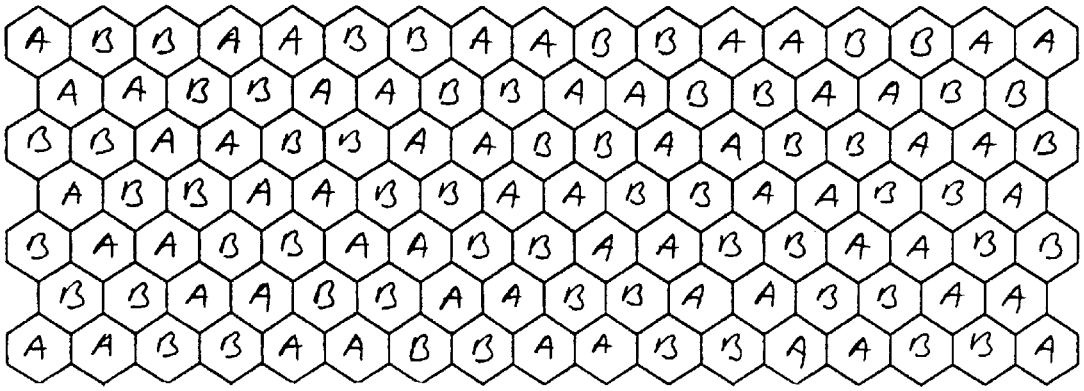
Figure 73:
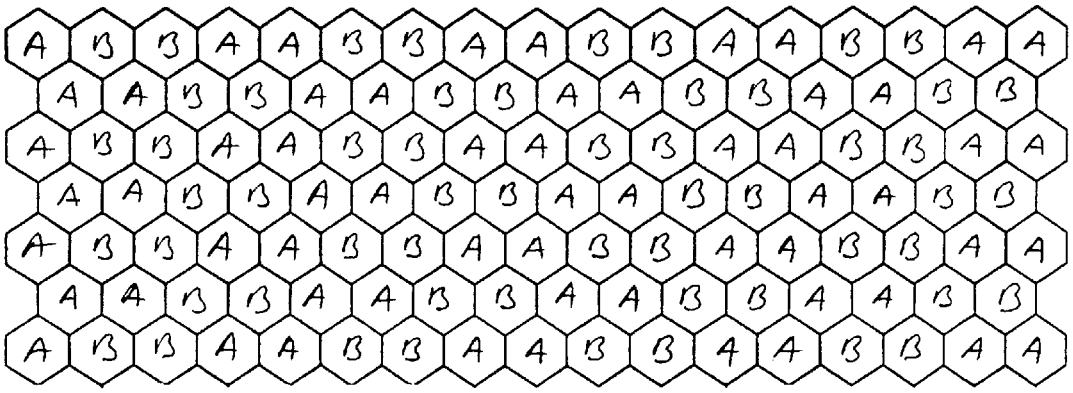
Figure 74:
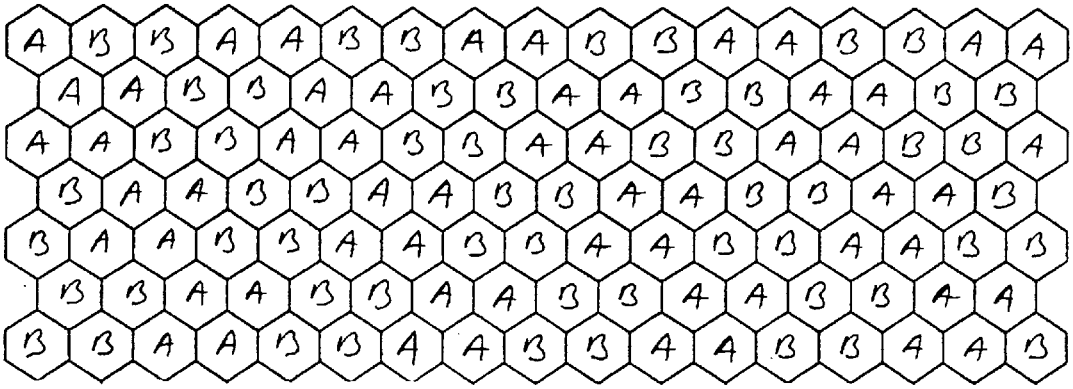
Figure 75:
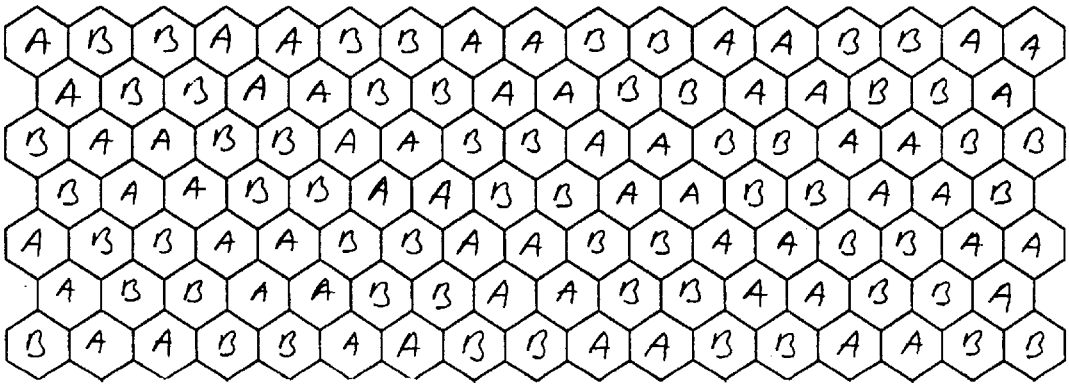

FIGS. 70–75 show schematically various triangular grid embodiments of the invention, the schematic shown in FIG. 70 corresponds to the lay-out shown in FIG. 68. Elements having identical radiation patterns are designated with the same letter. As indicated in FIG. 69, the radiation pattern of elements designated A are mirror images of the radiation patterns of elements designated B.

EXAMPLE 8

FIG. 76 shows three different four-element linear groups according to the invention, in which the four radiation patterns of the antenna elements are different from one another and the antenna elements are positioned substantially along an axis.

FIG. 77 shows an antenna array comprising the upper four-element group shown in FIG. 76 and the corresponding calculated radiation pattern. The elements are uniformly excited. It is seen that cross-polarization and grating lobe suppression is excellent.

FIGS. 78–80 show various alternative lay-outs of antenna arrays comprising the same four-element group as the array shown in FIG. 77.

What is claimed is:

1. An antenna array for radiation or reception of electromagnetic radiation, comprising:

a plurality of antenna elements including at least one group of four adjacent linearly polarized antenna elements, the antenna elements having radiation patterns selected from a group consisting of a first, second, third and fourth radiation pattern, the first and second radiation patterns being different and being mirror images of one another with respect to a selected first plane of symmetry, the third and fourth radiation patterns being different mirror images of one another with respect to the selected first plane of symmetry, the first and fourth radiation patterns being different and being mirror images of one another with respect to a second selected plane of symmetry that is perpendicular to the first selected plane of symmetry, and the second and third radiation patterns being different and being mirror images of one another with respect to the second selected plane of symmetry, characterized in that either the antenna elements of the at least one group of four adjacent antenna elements have substantially identical radiation patterns two by two, respectively, and are positioned either in a substantially rectangular grid in such a way that the two antenna elements having substantially identical radiation patterns are positioned on opposite sides of a plane that is substantially perpendicular to the substantially rectangular grid and includes selected centers of each of the other two antenna elements of the group, or substantially along an axis in such a way that the two antenna elements positioned at innermost positions of the group have substantially identical radiation patterns and the two antenna elements positioned at outmost positions of the group have substantially identical radiation patterns, or the four radiation patterns of the antenna elements of the at least one group of four adjacent antenna elements are different from one another and the antenna elements are positioned substantially along an axis, whereby formation of grating lobes are inhibited in selected directions of the radiation and cross-polarization within the main lobe is suppressed at least 30 dB below the main lobe peak value.

2. An antenna array according to claim 1, comprising first coupling means for transmission of first signals to be radiated or received by the antenna array as electromagnetic radiation of at least one specific polarization and having a first set of first feed lines for transmission of the first signals to the antenna elements, each feed line being connected to a first coupling arrangement for transmission of first signals between the first feed lines and the corresponding antenna elements and being positioned in relation to the corresponding antenna element in such a way that the antenna element attains the desired radiation pattern.

3. An antenna array according to claim 1, comprising first coupling means for transmission of first signals to be radiated or received by the antenna array as electromagnetic radiation of a first polarization, and second coupling means for transmission of second signals to be radiated or received by the antenna array as electromagnetic radiation of a second polarization which in a selected direction of radiation is substantially orthogonal to the first polarization.

4. An antenna array according to claim 3, wherein the first coupling means comprise a first set of first feed lines for transmission of the first signals to the antenna elements, each first feed line being connected to a first coupling arrangement for transmission of first signals between the first feed lines and the corresponding antenna elements and being positioned in relation to the corresponding antenna element in such a way that the antenna element attains the desired radiation pattern of the electromagnetic radiation of the first polarization, and a second set of second feed lines for transmission of the second signals to the antenna elements, each second feed line being connected to a second coupling arrangement for transmission of second signals between the second feed lines and the corresponding antenna elements and being positioned in relation to the corresponding antenna element in such a way that the antenna element attains the desired radiation pattern of the electromagnetic radiation of the second polarization.

5. An antenna array according to claim 4, wherein substantially all of either the first coupling arrangements or the second coupling arrangements are positioned at substantially identical positions in relation to the corresponding antenna elements.

6. An antenna array according to any of claim 3, comprising a plurality of groups of antenna elements in which positions of corresponding coupling arrangements at corresponding antenna elements of the groups are substantially identical.

7. An antenna array according to claim 1, wherein the antenna elements of the array are divided into a plurality of groups of four antenna elements each.

8. An antenna array according to claim 1, comprising at least one resonant radiating patch.

9. An antenna array according to claim 8, wherein each resonant radiating patch is a symmetric resonant radiating patch having at least two axis of symmetry.

10. An antenna array according to claim 2, wherein the coupling means comprise probes for excitation of the antenna elements.

11. An antenna array according claim 9, wherein each symmetric resonant radiating patch is fed by two probes, each of which is positioned on or close to a different one of the axis of symmetry of the resonant radiating patch.

12. An antenna array according to claim 1, wherein the antenna is adapted to be positioned on a curved-surface.

13. A method of coupling signals to be radiated or received as electromagnetic radiation by an antenna array comprising a plurality of antenna elements, the method comprising the steps of:

providing linearly polarized antenna elements, the antenna elements having radiation patterns selected from a group consisting of a first, second, third and fourth radiation pattern, the first and second radiation patterns being different and being mirror images of one another with respect to a selected first plane of symmetry, the third and fourth radiation patterns being different and being mirror images of one another with respect to the selected first plane of symmetry, the first and fourth radiation patterns being different and being mirror images of one another with respect to a second selected plane of symmetry that is perpendicular to the first selected plane of symmetry, and the second and third radiation patterns being different and being mirror images of one another with respect to the second selected plane of symmetry, and positioning antenna elements that have substantially identical radiation patterns two by two, respectively, adjacently to one another either in a substantially rectangular grid in such a way that the two antenna elements having substantially identical radiation patterns are positioned on opposite sides of a plane that is substantially perpendicular to the substantially rectangular grid and includes selected centers of each of the other two antenna elements of the group, or substantially along an axis in such a way that the two antenna elements positioned at innermost positions of the group have substantially identical radiation patterns and the two antenna elements positioned at outmost positions of the group have substantially identical radiation patterns, or positioning four antenna elements having four different radiation patterns, respectively, adjacently substantially along an axis, whereby formation of grating lobes are inhibited in selected directions of the radiation and cross-polarization within the main lobe is suppressed at least 30 dB below the main lobe peak value.

14. A method according to claim 13, further comprising the steps of providing first coupling means for transmission of first signals to be radiated or received by the antenna array as electromagnetic radiation of at least one specific polarization, with a first set of first feed lines for transmission of first signals to the antenna elements, each feed line being connected to a first coupling arrangement for transmission of the first signals between the first feed lines and the corresponding antenna elements, and positioning each of the first coupling arrangements in relation to the corresponding antenna element in such a way that the antenna element attains the desired radiation pattern.

15. A method according to claim 14, comprising the step of providing first coupling means for transmission of first signals to be radiated or received by the antenna array as electromagnetic radiation of a first polarization, and second coupling means for transmission of second signals to be radiated or received by the antenna array as electromagnetic radiation of a second polarization which in a selected direction of radiation is substantially orthogonal to the first polarization.

16. A method according to claim 15, wherein the first coupling means comprise a first set of first feed lines for transmission of the first signals to the antenna elements, each first feed line being connected to a first coupling arrangement for transmission of first signals between the first feed lines and the corresponding antenna elements and a second set of second feed lines for transmission of the second signals to the antenna elements, each second feed line being connected to a second coupling arrangement for transmission of second signals between the second feed lines and the corresponding antenna elements and comprising the step of positioning the first and second coupling arrangements in relation to the corresponding antenna element in such a way that the antenna element attains the desired radiation patterns of the electromagnetic radiation of the first and second polarizations, respectively.

* * * * *